US008424852B2

(12) United States Patent
Anson et al.

(10) Patent No.: US 8,424,852 B2
(45) Date of Patent: Apr. 23, 2013

(54) KIT FOR A BARRIER SYSTEM

(76) Inventors: Benjamin Anson, Beaconsfield (CA); Andrew Anson, Montréal (CA)

( * ) Notice: Subject to any disclaimer, the term of this patent is extended or adjusted under 35 U.S.C. 154(b) by 290 days.

(21) Appl. No.: 12/508,794

(22) Filed: Jul. 24, 2009

(65) Prior Publication Data

US 2010/0187491 A1 Jul. 29, 2010

Related U.S. Application Data

(60) Provisional application No. 61/202,100, filed on Jan. 28, 2009.

(51) Int. Cl.
*E04H 17/00* (2006.01)

(52) U.S. Cl.
USPC ..... 256/68; 256/37; 256/49; 256/52; 256/45

(58) Field of Classification Search ..... 256/23, 256/45, 48, 49, 52, 54, 55, 34, 68, 69
See application file for complete search history.

(56) References Cited

U.S. PATENT DOCUMENTS

| | | | | | |
|---|---|---|---|---|---|
| 294,493 | A * | 3/1884 | Miner | 256/59 |
| 406,642 | A | 7/1889 | Frost | |
| 417,077 | A * | 12/1889 | Osborn et al. | 256/59 |
| 753,227 | A * | 3/1904 | Bounds | 256/52 |
| 997,725 | A | 7/1911 | Wilson | |
| 3,756,568 | A * | 9/1973 | Mocny et al. | 256/59 |
| 3,880,405 | A * | 4/1975 | Brueske | 256/59 |
| 3,938,619 | A * | 2/1976 | Kurabayashi et al. | 182/113 |
| 4,093,187 | A * | 6/1978 | Robinson | 256/49 |
| 4,480,819 | A | 11/1984 | Lopez | |
| 4,932,634 | A * | 6/1990 | Sura | 256/12.5 |
| 5,314,167 | A * | 5/1994 | Holloman | 256/69 |
| 6,010,116 | A * | 1/2000 | Knott, Sr. | 256/47 |
| 6,015,139 | A | 1/2000 | Weber | |
| 6,021,702 | A * | 2/2000 | Rexroad | 87/12 |
| 6,038,829 | A * | 3/2000 | Franks | 52/645 |
| 6,053,281 | A | 4/2000 | Murray | |
| 6,131,885 | A * | 10/2000 | Berg et al. | 256/19 |
| 6,336,623 | B1 | 1/2002 | McCarthy | |
| 7,080,967 | B2 | 7/2006 | Ackerman | |
| 7,338,033 | B2 | 3/2008 | Anson et al. | |
| 7,566,047 | B2 * | 7/2009 | Wall | 256/48 |
| 2008/0173854 | A1 * | 7/2008 | Meaux et al. | 256/23 |

* cited by examiner

*Primary Examiner* — Joshua Kennedy
(74) *Attorney, Agent, or Firm* — Fay Sharpe LLP

(57) ABSTRACT

A removable barricade or barrier which has one or more horizontally tensioned straps and one or more vertically extending elevation support elements associated therewith. The barricade or barrier may be erected and dismantled as desired.

50 Claims, 71 Drawing Sheets

KIT FOR A BARRIER SYSTEM

CROSS-REFERENCE TO RELATED APPLICATIONS

The present application requests priority on U.S. Provisional Patent Application Ser. No. 61/202,100 filed on Jan. 28, 2009 and incorporated herein in its entirety

BACKGROUND OF THE INVENTION (1) Field of the Invention

This invention relates to temporary barricades or barrier systems which may be erected and dismantled as desired or necessary. More specifically, the present invention relates to a (portable) barrier kit as well as a temporary barrier (system) erectable therefrom. A barrier system, erectable from the barrier kit, may be used for temporarily barricading dangerous areas such as elevated floor side edges, holes, openings, etc. The present invention also relates to strap-rail kits for barrier systems.

(2) Description of Related Art

A barrier system of the present invention (including a kit therefore) may by way of example be exploited in relation to building construction sites. However, a barrier system of the present invention (including a kit therefore) may be used in relation to other environmental contexts where a barrier is desired; e.g. in any area where a barricade may be sought for example to prevent entry into unauthorized or dangerous areas.

In the (building) construction industry some type of barrier or barrier system is invariably needed to prevent people as well as objects from entering a danger zone and in particular from falling from dangerous heights. Thus, for example, during the construction of a multi-floor building, it is common to first put in place the floors, ceilings and intermediate support pillars or posts interconnecting the floors and ceilings; stairwells, elevator shafts, etc. are also put in place. Thereafter the outer and inner side walls for the floors are put in place. However, the period during which floor sidewalls are not yet in place represents a particularly dangerous time, since there is an ever present risk that people may accidentally pass over unguarded floor side edges or through floor openings and fall to their injury or even death. There is also an ever present risk that objects may also accidentally pass (e.g. be kicked) over unguarded floor side edges or through floor openings and fall below risking injury or even death to unwary persons below.

Barriers are known which comprise some type of rigid fencing (e.g. rigid rails) components. The various components of such known rigid barriers are relatively heavy and bulky. Such known types of rigid barriers thus present transportation and storage challenges as well as challenges related to the erection and removal thereof with respect to a given worksite. For example, since the rigid components of such known rigid barriers are heavy and bulky there is a significant storage space requirement as well as transportation requirement (i.e. to and from a worksite). Examples of rigid barriers with rigid rail members may be seen in U.S. Pat. Nos. 6,015,139; 6,336,623; and 7,338,033.

Barriers are also known which comprise some type of flexible fencing (e.g. flexible rail) components. Examples of barriers with flexible rail members may be seen in U.S. Pat. No. 3,880,405 (strap rail); U.S. Pat. No. 4,480,819 (cable rail); and U.S. Pat. No. 6,336,623 (cable rail).

Barriers are further known which comprise some type of flexible fencing (e.g. rail) components which include means for subjecting the flexible rail component to tension.

Examples of barriers with tensioned flexible rail members may be seen in U.S. Pat. Nos. 406,642; 997,725; and 6,053,281.

A portable barricade is in particular disclosed in U.S. patent application Ser. No. 11/656,886 published under US 20080173854. The portable barricade of this U.S. application has a plurality of horizontally extending straps. The horizontally extending straps are attached to the provided support poles. The horizontally extending straps may be set to a desired tension between terminal support poles by a disclosed tension producing ratchet device(s). The barricade also has a plurality of vertical straps which are disposed between and interconnect the horizontal straps.

However, a problem with respect to known barriers or barricades having strap-rail members (i.e. flexible elongated members) is that (even under tension) such a strap-rail member in the region spanning between terminal structural support members may undesirably sag or more significantly be displaced downwardly under the weight of a person or heavy object. Such downward displacement can effectively defeat the barrier function of the strap-rail member and lead to undesired injury, spill over, etc. It would be advantageous to have a barrier system which could attenuate or avoid such intermediate sagging of the strap-rail member.

A further problem with respect to known barriers is that rail support structures are provided by the barrier system itself. It would be advantageous to be able to have a barrier system that may, for example, be able to exploit support structures which are presently available (i.e. on site) for use as rail support structures and in particular as terminal anchor element(s). The support structures available on site may, for example, be structures such as columns, pillars, posts or the like (and, as the case may be, walls as well).

BRIEF SUMMARY OF THE INVENTION

Accordingly it would be advantageous to have a barrier system which may be relatively easily erected and thereafter dismantled; which may attenuate intermediate strap-rail member sag; and/or which may be able to exploit, as support members for a barrier system, support structures such as, for example, columns, pillars, posts or the like (and, as the case may be, walls as well). It would in particular be advantageous if a barrier system may be configured so as to be able to exploit on site support structures.

It would be advantageous to have means for automatic or controlled disposition of the strap-rail member at a (predetermined) height relative to an underlying support structure (e.g. floor, ground etc.) as may be required to conform to safety regulations.

It would be advantageous to have means whereby a barrier system may be constructed in modular fashion, e.g. to be able to daisy chain rail members together to alter the length of a barrier system.

It is further well known in the art that safety barriers typically have to conform to certain government safety regulations, and even regulations maintained by owners of properties or structures.

It would be advantageous to have a removable barrier system which is easy to erect and dismantle and which may be configured to comply with government guidelines for barriers or barricade systems.

Thus the present invention, as described herein, relates not only to a (removable or temporary) barrier system itself but also to a kit for the construction of such a (removable or temporary) barrier system. In other words, a barrier system as described herein may be erected and dismantled as desired or necessary.

A barrier system as described herein may, for example, be designed as a safety barrier meeting government regulations for the prevention of damage to equipment as well as injuries to persons.

It to be understood herein that the terms "strap means", "strap member" "strap element" and the like refer to an elongated object (of pliant material) which has sufficient flexibility so as to be able to be rolled or coiled up and includes without limitation such objects in the form of a web, strap, band, strip, ribbon, rope, line, cable, chain or the like. It is further to be understood herein that any "strap means", "strap member" and the like may (keeping in mind the purpose thereof) be of any (suitable) metallic, plastic, composite material, as well as any combinations thereof. Thus for example a strap member may be manufactured of woven type material and may, for example, have a form similar to a seat belt. Any such woven type of material is of course to be formed so as to provide the elongated object with characteristics lending itself to the prevention of persons and/or objects such as equipment from passing therethrough.

It is to be understood herein that the expression "height support member" as used in relation to a "strap member", a "strap anchor segment", and the like, refers to a member which is rigid as defined herein.

Thus it is in particular to be understood that as used herein the word "rigid" characterizes an element, member, component, segment, etc. as at least being able to resist deformation thereof (i.e. compression, bowing or otherwise) when subjected to compressive forces as well as bending forces in the context of the use to which a strap support element (of the barrier as herein described) is to be put—i.e. in order to resist vertically downward displacement of the strap member—including but not limited to being incapable of bending.

Thus in accordance with the present invention, a height support member of a strap-support component is for example to be understood as being resistant to compression and/or bending.

It is to be understood herein that the expression "predetermined height level" includes not only a specific height (e.g. above a support such as the ground, a floor or other equivalent surface) but a height range as well. For example, the expression "predetermined height level" includes a height which is equivalent to a desired or necessary height above for example a floor; in other words, this expression includes any height (e.g. range) which for all intents and purposes is acceptable, keeping in mind the purposes of a desired or necessary barrier system.

It is to be understood herein, that an "anchor component", may take any form whatsoever keeping in mind the purpose thereof as described herein, i.e. to provide an anchor function. An anchor component may, for example, comprise one or more (e.g. one, two, two or more, etc.) anchor elements (as defined herein).

It is in particular to be understood herein that the expression "anchor element" (unless there is an indication (e.g. context) to the contrary), is to be taken as being a reference to a pillar member or, as the case may be, to a wall member.

It is further to be understood that as used herein the expression "pillar member" is to be understood as comprising any type of vertically extending (e.g. existing) columnar type support, whatsoever, whether free standing or disposed between horizontal structural and/or floor members (e.g. a pillar, a column, a piling, a post, and the like). A pillar member may, for example, take the form of an upstanding I-beam, a reinforced concrete column etc. A pillar member may have any cross sectional form whatsoever; a pillar member may for example have a cross section which is rectangular (e.g. square), circular, etc.

Furthermore as described herein a (tensioned) length of strap member may span the distance between "terminal" anchor elements (e.g. terminal pillar members) which may optionally be further separated by one or more intermediate pillar members so that any elevation support elements may not only be disposed between terminal anchor elements (e.g. terminal pillar members) but also (if desired) be associated with (i.e. attached to) intermediate pillar members.

Additionally, unless otherwise indicated or dictated by the context of the following description of the present invention, it is to be understood that a kit or a barrier system may be exploited by having recourse to tensioning (i.e. ratcheting) devices which may be commercially available; see also the above mentioned patent documents for particular examples of tensioning (i.e. ratchet) type devices.

Thus in accordance with an aspect the present invention relates to a barrier kit for the construction of a removable barrier system wherein said barrier system comprises an anchor component fixed to an underlying support structure, said kit comprising a barrier component, said barrier component comprising a removable strap-rail component

- said removable strap-rail component comprising strap means, anchor attachment means configured for the releasable attachment of a length (i.e. span or section) of the strap means to said anchor component, and tensioning means for releasable tensioning of said length (i.e. span) of said strap means when said length (i.e. span) of the strap means is attached to said anchor component by said anchor attachment means said kit further comprising height stabilization means for releasably maintaining the strap means at a predetermined height level relative to (i.e. above) said underlying support structure at one or more predetermined points along the tensioned length (i.e. span) of said strap means when said strap means is tensioned by said tensioning means.

In accordance with the present invention a height stabilization means may for example comprise clamp means. The clamp means may take any suitable form keeping in mind the purpose thereof as described herein. The clamp means may for example comprise a first clamp member, a second clamp member, and clamp adjustment means for displacement of the first and second clamp members relative to each other for engagement and disengagement of said strap means therebetween.

A height stabilization means may, for example, comprise a removable strap-support component as described herein.

Thus in accordance with another particular aspect the present invention provides a barrier kit for the construction of a removable barrier system wherein said barrier system comprises an anchor component (e.g. an anchor component comprising two terminal anchor elements) fixed to an underlying support structure, said kit comprising a barrier component, said barrier component comprising a removable strap-rail component and a removable strap-support component,

- said removable strap-rail component comprising a strap member, a first anchor attachment member, and a second anchor attachment member, said anchor attachment members being configured for the releasable attachment of a length (i.e. span) of the strap member to said anchor component,
- said removable strap-rail component further comprising tensioning means for releasable tensioning of said length (i.e. span) of strap member when said length of strap member is attached to said anchor component by said first and second anchor attachment members wherein said removable strap-support component comprises at least one elevation support element comprising a height support member (or segment) and a releasable strap engagement member connected to said height support member, said height support member comprising a ground engagement element for engagement with said underlying support structure, and wherein said releasable strap engagement member and said height support member are configured such that said releasable strap engagement member is disposed to releasably maintain said length of strap member at a first predetermined height level relative to said underlying support structure when said length of strap member is tensioned by said tensioning means.

As mentioned, in accordance with the present invention an anchor component may take any form whatsoever keeping in mind the purpose thereof as described herein. An anchor component may, for example comprise on site (i.e. in situ) components of a (building) structure (e.g. a wall type structure). An anchor component may, for example, be derived from on site (i.e. in-situ) support columns/posts fixed to an underlying support structure (e.g. floor) of a building. Although an anchor component may be derived from on site structures, an anchor component may also be derived from structures brought in from off site and (releasably) installed on site. In any event, an anchor component as mentioned above may take any form whatsoever keeping in mind the purpose thereof as described herein, i.e. to provide an anchor function.

As mentioned above, an "anchor component" may relate to anchor elements. Thus, for example, an anchor component may comprise anchor elements wherein one (or more) of the anchor elements is a (e.g. on site or in situ) pillar member. In accordance with the present invention when one (or more) of the anchor elements is a pillar member, there may also be provided means for releasable attachment of at least one elevation (i.e. span) support element to a respective pillar member.

As mentioned the present invention further relates to a barrier system itself. Thus in accordance with another aspect the present invention provides a removable barrier system comprising an anchor component (e.g. an anchor component comprising two terminal anchor elements) and a barrier component, said anchor component being fixed to an underlying support structure, said barrier component comprising a removable strap-rail component and a removable strap-support component, said removable strap-rail component comprising a strap member, a first anchor attachment member, and a second anchor attachment member, said anchor attachment members releasably attaching a length (i.e. span) of the strap member to said anchor component, said removable strap-rail component further comprising tensioning means releasably tensioning said length (i.e. span) of strap member attached to said anchor component by said first and second anchor attachment members wherein said removable strap-support component comprises at least one elevation support element comprising a height support member and a releasable strap engagement member connected to said height support member, said height support member comprising a ground engagement element engaging said underlying support structure, and wherein said releasable strap engagement member and said height support member are configured such that said releasable strap engagement member is disposed to releasably maintain said tensioned length of strap member at a first predetermined height level relative to said underlying support structure at a predetermined point along the tensioned length of said strap member.

In accordance with the present invention an anchor component may comprise two or more anchor elements fixed to an underlying support structure. An anchor component may comprise two or more anchor elements, at least one of which may be a terminal anchor element and the remaining anchor element(s) may be (an) intermediate anchor element(s). As may be understood in the case of a single terminal anchor element, such single terminal anchor element will act as a common terminal anchor element to which both attachment ends of a strap member are attached (i.e. for tensioning); the strap member in this example case also engages (an) intermediate anchor element(s), such engagement not affecting the tensioning in relation to the common terminal anchor element. However, the invention will in particular be described herein in relation to strap members connected to an anchor component comprising two terminal anchor elements.

In accordance with the present invention one or more of the anchor elements of the anchor component may be a pillar member (e.g. an intermediate pillar member). The anchor component may for example comprise two or more pillar members. The anchor component may in particular comprise two terminal pillar members and optionally one or more intermediate pillar members disposed between the two terminal pillar members. Alternatively, the anchor component may comprise two terminal wall members and optionally one or more intermediate pillar members disposed between the two terminal wall members. As a further alternative one terminal anchor element may be a terminal pillar member and the other terminal anchor element may be a terminal wall member.

It is to be understood herein that in accordance with the present invention, an elevation support element may be configured so as to maintain a strap member at any desired or necessary height level; for example a height level determined by an individual site or by government regulation.

In accordance with the present invention a barrier component may as desired or necessary comprise one or more strap-rail components exploited in association with one or more common elevation support elements.

Thus in accordance with the present invention a barrier component may comprise a farther (i.e. second) removable strap-rail component as defined herein, said further strap-rail component being a second strap-rail component comprising a respective tensioning means for releasable tensioning of a respective length (i.e. span) of the respective strap member thereof when said length of said respective strap member is attached to said anchor component by respective first and second anchor attachment members of said second strap rail component, wherein said elevation support element of the removable strap-support component comprises an additional (i.e. second) releasable strap engagement member, and wherein said additional releasable strap engagement member and said height support member are configured such that said additional releasable strap engagement member is disposed to releasably maintain the respective length of the strap member of the second strap-rail component at a second predetermined height-level below said first predetermined height-level when said respective length of strap member is tensioned by the respective tensioning means of said second strap rail component.

In accordance with the present invention the second strap-rail component may be a toe-strap rail component, and the additional releasable strap engagement member and said height support member may be configured such that said additional releasable strap engagement member is disposed to releasably maintain the respective length of the strap member of the toe-strap rail component at a second predetermined height-level below said first predetermined height-level and adjacent said underlying support structure.

In accordance with the present invention a barrier system may be based on one or more barrier components. Thus in accordance with the present invention a barrier system may for example be based on three of the barrier components, wherein one of said barrier components is a top-rail barrier component, another of said barrier components is a toe-rail barrier component and the remaining barrier component is a mid-rail barrier component, wherein the elevation support element of the top-rail barrier component comprises a top-rail releasable strap engagement member, the top-rail releasable strap engagement member and the height support member of the top-rail barrier component being configured such that the top-rail releasable strap engagement member of the top-rail barrier component is disposed to releasably maintain the strap member of the top-rail barrier component at said first predetermined height-level, wherein the elevation support element of the mid-rail barrier component comprises a mid-rail releasable strap engagement member, the mid-rail releasable strap engagement member and the height support member of the mid-rail barrier component being configured such that the mid-rail releasable strap engagement member of the mid-rail barrier component is disposed to releasably maintain the strap member of the mid-rail barrier component at a second predetermined height-level, said second predetermined height-level being below said first predetermined height-level, wherein the elevation support element of the toe-rail barrier component comprises a toe-rail releasable strap engagement member, the toe-rail releasable strap engagement member and the height support member of the toe-rail barrier component being configured such that the toe-rail releasable strap engagement member of the toe-rail barrier component is disposed to releasably maintain the strap member of the toe-rail barrier component at a third predetermined height-level, said third predetermined height level being below said second predetermined height-level and adjacent said underlying support structure.

In accordance with the present invention, as desired or as necessary, a barrier system may exploit or be based on the exploitation of a common elevation support element (i.e. one or more such elements) which defines the elevation support element of each of the top-rail, mid-rail and toe-rail barrier components.

In accordance with the present invention a ground engagement element or member may take any form whatsoever keeping in mind its purpose as described herein. A ground engagement element may simply be configured for abutting (i.e. unfixed) engagement with the underlying support structure; alternatively a ground engagement element may be configured for being releasably fixed (in any suitable manner, e.g. be provided with a foot member boltable) to an underlying support structure. However, abutting engagement is an advantageous structure since it facilitates minimal installation and dismantling steps.

In accordance with the present invention, a releasable strap engagement member for a (e.g. at least the top-rail) barrier component may comprise clamp means, said clamp means comprising a first clamp member, a second clamp member, and clamp adjustment means for displacement of the first and second clamp members relative to each other for engagement and disengagement of said strap member there between. In accordance with the present invention, a height support member may define one of such clamp members.

As mentioned above, in accordance with the present invention, an anchor component may, for example, comprise one (i.e. common) or two (i.e. different) terminal anchor elements. An anchor component may also optionally (i.e. as desired or as necessary) comprise one or more intermediate anchor elements, e.g. one or more intermediate anchor elements may be disposed between two such terminal anchor elements.

As mentioned, a strap member (i.e. a length thereof) may be tensioned in relation to an anchor component which may comprise a single common terminal anchor element and one or more (suitable) intermediate anchor elements. In this case the anchor attachment members may share elements thereof (e.g. a common girdle element). Alternatively, a strap member (i.e. a length thereof) may be tensioned in relation to an anchor component which may, for example, may comprise two terminal anchor elements. In any case, the strap member (i.e. a length thereof) is attached to the terminal part of the anchor component by respective anchor attachment members, as the case may be, so as to facilitate tensioning of the strap member to the terminal part of the anchor component. More particularly, an anchor component may comprise two such terminal anchor elements and each terminal anchor element may be associated with a respective anchor attachment member as described herein.

As described herein, a barrier system may comprise more than one strap member. If two or more strap members are (to be) exploited for a barrier system, the strap members, for tensioning purpose, may each be associated with the same (i.e. common) and/or different terminal anchor elements. In other words, if, for example, one strap member is used to define a top-rail of a barrier system and another strap member is used define a lower-rail of the same barrier system, the top strap member and the lower strap member may be associated with different anchor elements as their respective terminal anchor elements (see FIG. 11); alternatively, the strap members may share one (or both) common terminal anchor elements (see FIG. 12).

In accordance with the present invention a height location means may be provided for releasable maintenance of the (tensioned) length of strap member at a first predetermined height level at least adjacent to (e.g. at) a respective terminal anchor element. The height location means may take any desired or necessary form. Such height location means may, for example, take the form of an elevation support element as described herein.

In any event, an anchor attachment member may be configured, in any (suitable) manner whatsoever, keeping in mind its function, namely, the releasable immobilization or attachment of the (tensioned) length of strap member to a respective terminal anchor element.

As mentioned, an anchor element may be a pillar member. Thus an anchor attachment member may be configured to releasably attach a (tensioned) length of strap member to a terminal pillar member.

In accordance with the present invention, an anchor attachment member may for example, be configured for defining a [respective] removable girdle element about a [respective] terminal pillar member. A girdle element may, for example, take the form of a loop, noose, ring, eye, or the like which is (releasably) disposable about a terminal pillar member for girdle engagement (i.e. embracing/surrounding/encircling engagement) of the terminal pillar member.

An anchor attachment member may, in general, comprise a strap anchor segment (for) defining a girdle element about a terminal pillar member. An anchor attachment member may further comprise a strap attachment element (for) attaching a respective girdle element to the strap member.

As mentioned, an anchor attachment member may comprise a strap anchor segment (for) defining a girdle about a terminal pillar member. The strap anchor segment may be integral with the strap member, i.e. the strap member may comprise the strap anchor segment. Alternatively, the strap anchor segment may be separate (i.e. distinct) from the strap member. If the strap anchor segment is separate from the strap member, the strap anchor segment may take the form of a belt member. The belt member may be associated with a belt fastener for (releasably) defining a girdle element about a pillar member. A belt fastener may take any desired or necessary form whatsoever. A belt fastener may for example take the form of a tensioning device or a belt-buckle as described herein.

A belt-buckle is advantageous in that a friction type buckle (such as described herein, see FIG. 90 as well as FIGS. 80A, 80B and 80C)) is for all intents and purposes self-locking once the anchor attachment member (of which it is a part) and the strap member to which the anchor attachment member is connected are placed under tension. The self-locking feature is an advantageous safety feature since, once subjected to tension, the girdle element may not be (inadvertently) manually disengaged from a pillar member. Such undesirable release may occur with respect to a ratchet type belt-fastener as shown herein; a ratchet type belt-fastener as shown herein may thus as desired or necessary have to have a locking type mechanism to lock the fastener in place (e.g. a hole and padlock type mechanism analogous to that as shown in the figures; see for example FIG. 32).

As mentioned an anchor attachment member also comprises a strap attachment element for (e.g. releasable) attachment of the girdle element to the strap member. A strap attachment element may be configured or take on any form whatsoever for attachment (e.g. releasable attachment) of a girdle element to the strap member; a strap attachment element may, for example, take the form of a ring or loop connector.

The strap member may itself comprise (or define) both a strap anchor segment and an associated strap attachment element (see FIG. 59). Alternatively the strap attachment element may be defined by a separate (i.e. distinct) element such as for example a ring connector (see FIG. 66). Thus, in accordance with the present invention, a strap member may itself comprise the strap anchor segment of one or both anchor attachment members associated therewith. Alternatively, a strap anchor segment of one or both anchor attachment members may be separate from the respective strap member.

As shall be described herein below, a belt member (e.g. a respective strap anchor segment) and a respective belt fastener (e.g. belt-buckle) may be part of a pillar engagement element. In accordance with the present invention, an anchor attachment member may thus comprise a strap attachment element as well as a pillar engagement element for defining a [respective] removable girdle element about a [respective] terminal pillar member.

In particular, in accordance with another aspect, the present invention provides a strap-rail kit for a removable barrier system wherein said barrier system comprises an anchor component fixed to an underlying support structure, said anchor component comprising a (e.g. two) terminal pillar member(s) fixed to said underlying support structure, said kit comprising a strap member (or element), and a pillar engagement element, wherein said (i.e. each) pillar engagement element, for defining a [respective] removable girdle element about a [respective] terminal pillar member, comprises a respective belt-fastener (e.g. belt-buckle) and a respective belt member (i.e. a respective strap anchor segment), wherein said kit further comprises a strap attachment element configured for (e.g. releasable) attachment of said [respective] girdle element to the strap member. and wherein said strap member comprises tensioning means for releasable tensioning of said strap member when said strap member is attached to said girdle element and said girdle element is disposed about said terminal pillar member.

In accordance with the present invention, the belt-fastener may be a belt-buckle. The belt-buckle may comprise a buckle body (i.e. frame) defining at least two belt thread apertures. The buckle body may be configured (i.e. in any suitable manner) to allow a respective belt member to be threaded through the said apertures (e.g. in double pass (i.e. loop) fashion) for releasable (i.e. frictional type) engagement with said belt-buckle so as to define a respective girdle element about a respective pillar member.

In accordance with the present invention a belt member may, for example have a first proximal (portion or) end and a second distal (portion or) end. The first proximal end may be attached to the buckle body while the second distal end may be a free end (i.e. an end which is not directly attached to the buckle body). The first proximal end may be mounted to the buckle body in any suitable manner provided that such attachment in conjunction with the belt thread apertures is configured to allow the second distal free end of the belt member to be threaded through said apertures (e.g. in double pass (i.e. loop) fashion) for releasable frictional engagement of said belt member with said belt-buckle so as to define a respective girdle element about a respective pillar member.

A strap-rail kit of the present invention may comprise two pillar engagement elements as well as two strap attachment elements, i.e. the kit may comprise a pair of anchor attachment members.

In accordance with the present invention a strap-rail kit which may have a pair of anchor attachment members is provided wherein each strap attachment element may comprise a respective ring quick connect connector element, wherein the strap member may comprise a pair of spaced apart connector loops, and wherein each ring quick connect connector element may be configured for the releasable attachment of a respective connector loop of the strap member to a respective girdle element.

In accordance with the present invention a strap-rail kit having a pair of anchor attachment members is provided wherein each of said ring quick connect connector element may comprise a nut member and a rectangular loop element, said rectangular loop element defining a strap aperture and being split by a gap (i.e. providing strap access between the exterior and interior of the strap aperture—see blow), said rectangular loop element comprising a pair of threaded members disposed on opposite sides of said gap, said nut member being rotationally displaceable about said threaded members between an open position wherein said bolt member engages one of said thread members and said gap is unobstructed by said bolt member and a closed position wherein said nut member engages both of the threaded members such that the gap is obstructed (i.e. closed off) by said nut member, said gap, when unobstructed by said bolt member, being configured for releasable displacement (i.e. in and out displacement) of a respective connector loop and a respective girdle element there through, into said strap aperture, for attachment of said connector loop to said girdle element.

In accordance with the present invention a strap-rail kit is provided wherein said kit may further comprise height stabilization means for releasably maintaining the strap member at a predetermined height level relative to said underlying support structure at one or more predetermined points along the tensioned length of said strap means when said strap member is tensioned by said tensioning means.

Turning back to the barrier system, in accordance with the present invention a barrier system may exploit an anchor component which may comprise two of the above mentioned terminal anchor elements, and wherein the removable strap-support component may further comprise two terminal support elements, wherein each of said terminal support elements comprises a terminal height support member for a respective strap anchor segment, each terminal height support member comprising a ground engagement element for engagement with said underlying support structure, wherein each of said terminal support elements further comprises a strap anchor segment engagement means connected to a respective terminal height support member, wherein a respective strap anchor segment engagement means and a respective terminal height support member are configured such that said respective strap anchor segment engagement means is disposed to releasably maintain the girdle element at said first predetermined height level above said underlying support structure.

In accordance with the present invention each of the terminal support elements may comprise means for releasable immobilization thereof to a respective terminal anchor element. As mentioned the strap anchor segment of each of said anchor attachment members may be separate from the strap member.

In accordance with the present invention a barrier system may exploit, as mentioned, in addition to terminal anchor elements (i.e. which may be the same as or different for each barrier component) an anchor component which may further comprise one or more intermediate anchor elements which may each be a pillar members. A barrier system may also further comprise means for releasable immobilization of at least one elevation support element to each of the respective intermediate pillar members.

In accordance with the present invention an anchor component may comprise two spaced apart terminal anchor elements, each of the terminal anchor elements (which may be defined by a separate respective anchor element) being fixed to the underlying support structure and wherein each anchor attachment member is configured for the releasable attachment of the strap member to a respective terminal anchor element. For this configuration an elevation support element(s) may her be disposed independently between the terminal anchor elements.

In accordance with the present invention an anchor component may as desired or necessary further comprise one or more intermediate anchor elements disposed between the terminal anchor elements and wherein height location means may be provided for releasable maintenance of a strap member at a first (or other) predetermined height level adjacent to or at said terminal as well as at the intermediate anchor elements. For this configuration an elevation support element(s) may be disposed independently between the terminal anchor elements and the intermediate anchor elements as well as between intermediate anchor elements as the case may be.

Although two terminal anchor elements may be a usual configuration, an anchor component may comprise two or more spaced apart anchor elements but wherein the terminal anchor elements are defined by a common anchor element fixed to the underlying support structure (i.e. the terminal anchor elements are a shared (i.e. common) anchor element).

As mentioned above the present invention may exploit a releasable strap engagement member (for the elevation support element of a strap-support component) which may comprise a clamp structure as mentioned herein. However, a releasable strap engagement member may take any desired or necessary form keeping in mind the function thereof. Thus, a releasable strap engagement member may comprise or be a releasable grip means. A releasable grip means may for example comprise a clamp means, a loop element, a split loop element etc.

A releasable strap engagement member may if desired comprise a closed loop such as a closed U-shaped member which is described below; however such a closed loop allows only for a longitudinal freedom of movement of a strap member through the strap aperture thereof. Thus a strap member would have to be longitudinally threaded thru the closed loop prior to anchoring of the strap member(s) to for example a pillar member as well as prior to tensioning of the strap member(s).

On the other hand, a releasable strap engagement member may if desired comprise a loop element which may be split by a strap opening (as described herein) which may allow for a second degree of freedom of movement of a strap member i.e. allow for sideways or lateral engagement of a strap member already attached to an anchor element or even if the strap member is already tensioned.

For example, a releasable strap engagement member may comprise grip means which may generally comprise a loop element, i.e. a grip means (e.g. having a loop element) may be configured for inhibiting sideways displacement of the strap member with respect to a respective height support member. The loop element may define an aperture for (longitudinally) receiving the strap member but may also be split by a straight or by a convoluted lateral strap opening (i.e. slot, passageway, etc.) for lateral (i.e. manual) displacement of a strap member into and out of the aperture.

If the loop element is a convoluted lateral strap opening (i.e. slot, passageway, etc.), the loop element and the strap opening may be configured such that lateral displacement of the strap member out of the loop aperture thru such a convoluted strap opening is inhibited (e.g. when the strap member is under tension). For this type of structure the loop element and said convoluted strap opening may be configured for sideways threading of the strap member through the convoluted the strap opening into and out of the aperture; in other words for this type of grip means, the strap member in untensioned state is to be deformed relative to the tensioned state thereof and in the deformed state may be passed into or out of the aperture defined by the loop element. The convoluted opening is however, configured such that when the strap member is in a tensioned state the convoluted nature of the lateral strap opening inhibits lateral or sideways displacement of the strap member out of the aperture of the loop element.

As mentioned the loop element may also be split by a straight lateral strap opening (i.e. slot, passageway, etc.). An example embodiment of this type of grip means may take the form of simple U-shaped member. The open mouth of such U-shaped member may be disposed so as to face upwardly when a strap member, under (horizontal) tension, is disposed in the aperture thereof. Such a grip means may rely on the tension of the strap member to maintain the strap member in the aperture of the loop element. If desired however, the elevated support element may be associated with lock means (e.g. a padlock type mechanism) for closing off the mouth of the U-shaped member during use. However, for example in the case of a toe-rail strap member the mouth of the U-shaped member may be disposed so as to face downwardly such that the U-shaped mouth is adjacent the underlying support structure, i.e. when a strap member, is under (horizontal) tension, the underlying support structure essentially block off the mouth of the U-shaped opening.

Alternatively a releasable strap engagement member may comprise grip means, the grip means comprising a loop element defining an aperture for receiving the strap member, said loop element being split by a strap opening dimensioned/configured for passage of the strap member through said strap opening into and out of said aperture, said grip means further comprising a closure means displaceable between an open position and a closed position, said loop element and closure means being configured for inhibiting displacement of the strap member out of said aperture thru said strap opening when the closure means is in said closed position, and said loop element and said closure means being configured such that when said closure means is in said open position, said strap opening is unobstructed by the closure means with respect to passage of the strap member thru said strap opening.

In particular, a releasable strap engagement member may comprise grip means wherein the grip means comprises a loop element defining an aperture for receiving the strap member, said loop element being split by a strap opening dimensioned/configured for lateral passage of the strap member through said strap opening into and out of said aperture, said grip means further comprising a lock swing arm mounted to the loop element for pivotal displacement between an open position within said aperture and a closed position, said lock swing arm being biased in said closed position, said loop element and said swing arm being configured for inhibiting displacement of the strap member out of said aperture thru said strap opening when the swing arm is in said closed position, and said loop element and said swing arm being configured such that when said swing arm is in said open position, said strap opening is unobstructed by the swing arm with respect to passage of the strap member thru said strap opening.

As an additional example a releasable strap engagement member may comprise grip means which may comprise a [displaceable] (i.e. slider) first grip element and a second grip element, said second grip element and said first grip elements being configured such that said first grip element is (e.g. Linearly) displaceable relative to said second element between a strap lock-in position and a strap release position wherein, when said first grip element is in said strap lock-in position, said second grip element and said first grip element define a closed loop element, said closed loop element defining an aperture for receiving the strap member, said closed loop element being configured for inhibiting sideways (radial) (i.e. lateral and vertical) displacement (passage) of the strap member out of the aperture defined thereby, wherein, when said first grip element is in said strap release position, said second grip element and said first grip element define an open loop element, said open loop element defining a respective strap aperture and being split by a strap opening dimensioned/configured for sideways displacement (passage) of the strap member through said strap opening into and out of said respective strap aperture, In accordance with an additional example a releasable strap engagement member means may comprise grip means which comprises a first slider grip element and a second grip element, said second grip element and said first slider grip elements being configured such that said first slider grip element is linearly displaceable relative to said second element between a strap lock-in position and a strap release position wherein, when said first slider grip element is in said strap lock-in position, said second grip element and said first slider grip element define a closed loop element, said closed loop element defining an aperture for receiving the strap member, said closed loop element being configured for inhibiting sideways (radial) (i.e. lateral and vertical) displacement of the strap member out of the aperture defined thereby, wherein, when said first slider grip element is in said strap release position, said second grip element and said first slider grip element define an open loop element, said open loop element defining a respective strap aperture and being split by a strap opening dimensioned/configured for passage of the strap member through said strap opening into and out of said respective strap aperture.

In accordance with the present invention the above mentioned additional releasable strap engagement member may comprise grip means, said grip means comprising a loop element defining an aperture for receiving the strap member, said loop element being split by a strap opening configured for unobstructed sidewise/lateral passage of the strap member through said strap opening into and out of said aperture, said loop element and said strap opening being configured such that said strap opening is disposed for cooperation with the underlying support structure for inhibiting displacement of the strap member out of said aperture thru said strap opening.

Thus in accordance with the present invention the above mentioned a releasable strap engagement member of a common strap stabilizer support element for a toe-rail barrier component may comprise grip means, said grip means comprising a loop element defining an aperture for receiving the strap member, said loop element being split by a strap opening configured for unobstructed sidewise/lateral passage of the strap member through said strap opening into and out of said aperture, said loop element and said strap opening being configured such that said strap opening is disposed for cooperation with the underlying support structure for inhibiting displacement of the strap member out of said aperture thru said strap opening.

In accordance with the present invention, each releasable strap engagement member of a common elevation support element may comprises grip means, said grip means comprising a loop element defining an aperture for receiving the strap member, said loop element being split by a [straight/convoluted] strap opening (i.e. slot, passageway, etc.), said loop element and said strap opening being configured such that displacement of the strap member out of said aperture thru said strap opening is inhibited, said loop element and said strap opening being configured for sideways threading of the strap member through said strap opening into and out of said aperture.

BRIEF DESCRIPTION OF THE DRAWINGS

In drawings which illustrate example embodiments of the present invention.

DETAILED DESCRIPTION OF EMBODIMENTS

In the following, unless indicated to the contrary or dictated from the context, common reference designations are used to designate common or similar elements.

Figure 1:
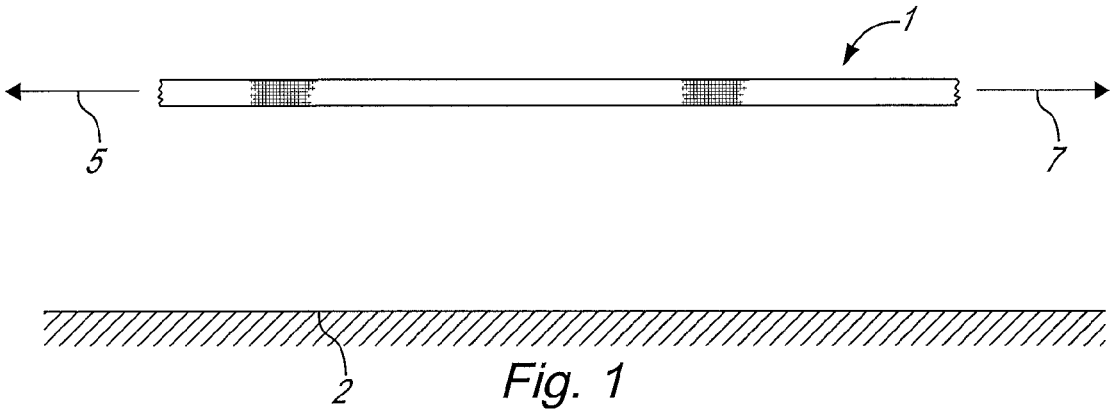
FIG. 1 is a schematic representation of a tensioned strap member.
Figure 2:
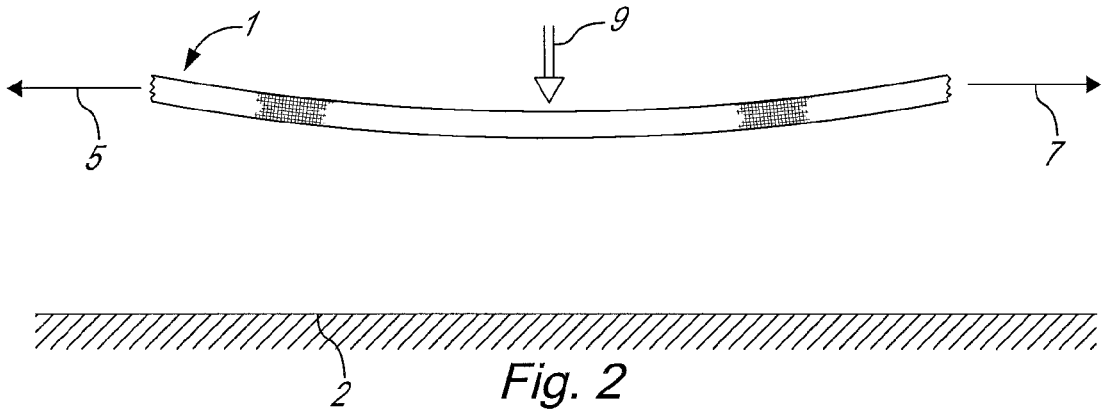
FIG. 2 is a schematic representation of a vertically stressed tensioned strap member of FIG. 1.

Turning to FIGS. 1 and 2, these figures illustrate in schematic fashion the problem related to undesired displacement (i.e. vertical) of a tensioned strap (rail) member.

FIGS. 1 and 2 illustrate (a length of) a strap member 1 which is (horizontally) tensioned (above a floor 2 or other similar type of support) in the direction of the horizontally outwardly pointing arrows 5 and 7. The ends of the strap member 1 are not shown but are each suitably anchored to a respective terminal anchor means such as for example a pillar or post member(s) or even a wall member(s) by suitable connectors, fasteners, etc. Similarly the tensioning device for subjecting the (length of the) strap member 1 spanning the distance between the terminal anchor elements is not shown; the tensioning device may, for example, be any (known) tensioning device such as for example a device(s) as described in US published patent application no. US 20080173854 mentioned above or in any of the other above mentioned U.S. patent documents.

FIG. 1 shows the tensioned length of strap member 1 in a vertically unstressed disposition wherein the length of strap member 1 shows no vertical deflection.

On the other hand, FIG. 2 shows the tensioned length of strap member 1 of FIG. 1 in a vertically stressed disposition wherein the length of strap member 1 shows vertical deflection in the direction of the deflection arrow 9, i.e. downwardly towards the floor 2. Such deflection may be induced for example by the weight of a person being applied in unrestrained fashion to the length (of tensioned) strap member 1 in the direction of the deflection arrow. In the absence of some means to inhibit such deflection, the deflection may be significant enough to result in the person being able to undesirably pass over the strap member.

Figure 3:
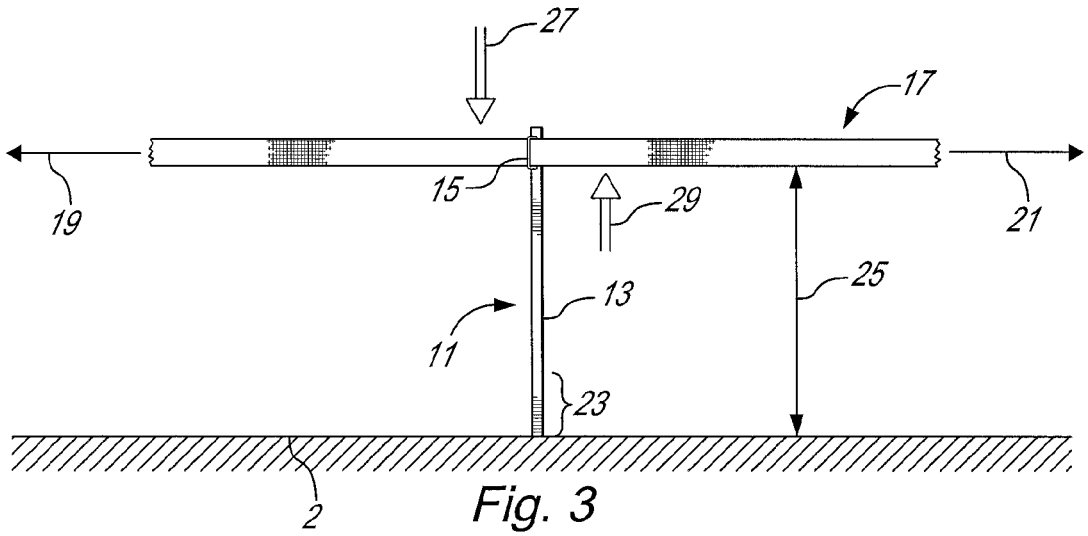
FIG. 3 is a schematic representation of an example embodiment barrier system in accordance with the present invention.

Referring to FIG. 3, this figure illustrates in general fashion (by way of example only) an aspect of the present invention, namely a strap-support component which comprises an elevation support element indicated generally by reference numeral 11. The elevation support element 11 comprises a height support member 13 and a releasable strap engagement member 15. As may be seen the height support member 13 extends vertically in relation to the floor. The (length of) strap member 17 is under tension (see arrows 19 and 21) as in the case for strap member 1 of FIGS. 1 and 2. The height support member 13 has a ground engagement element 23 which in the embodiment shown is able to simply sit on or abut the floor 2 (e.g. is not fixed to the floor). The releasable strap engagement member 15 has the form of a closed loop which is defined by a closed U-shaped member. The closed loop defines a strap opening (for horizontally) receiving the strap member 17 in longitudinal (i.e. lengthwise) fashion, i.e. the strap member is longitudinally threaded thru the closed loop before the strap member is attached to the anchor structures (not shown) and before the strap member is tensioned. The closed loop is connected to the height support member 13 (e.g. by welds, bolts, and the like) and is disposed such that, with the ground engagement element 23 sitting on the floor, the strap member 17 is able to be maintained at a predetermined height level 25 relative to the floor in the face of a downward stress indicated by the arrow 27. As shown the predetermined height level 25 is indicated as being between the floor 2 and the underside of the tensioned (length of) strap member 17; the predetermined height level could of course be taken from the top side of the tensioned strap member 17 or some point between the bottom and top sides of the length of tensioned strap member 17. The height support member 13 may be of a compression and/or bend resistant material (e.g. a metal such as aluminum, of a plastic material, etc.) such that it is able to provide a counterforce (indicated by arrow 29) to the downward stress indicated by arrow 27.

The closed loop defined by the closed U-shaped member inhibits (horizontal as well as vertical) lateral (or sidewise) displacement of the strap member 17 out of the strap opening (relative to the height support member); on the other hand horizontal (longitudinal) displacement of the strap member (in the direction of its length) through the strap opening is not inhibited by the structure of the closed loop. Other example embodiments of loop structures will be described below which while also inhibiting such lateral (or sidewise) displacement may allow for (manual) lateral displacement (i.e. manipulation) of the strap member into or out of the strap opening.

If desired or necessary the ground engagement element 23 may, for example, comprise (i.e. be provided with or be releasably engageble with) a stabilizer member. The stabilizer member may, for example, take the form of a foot member which may, for example, comprise a plate (not shown) or a counter weight such as shown for example in U.S. Pat. No. 7,338,033. A plate may for example be provided with a relatively large undersurface which may abut the floor surface. Such a foot member may be provided when it is desired or necessary for augmenting vertical stability of the height support member, i.e. to inhibit the height support member from a tendency to (laterally) pivot or rotate about the longitudinal axis of the strap member 17. The foot member may for example have a (seating) cavity for releasable engagement with the tip end of the ground engagement member or element.

Figure 4:
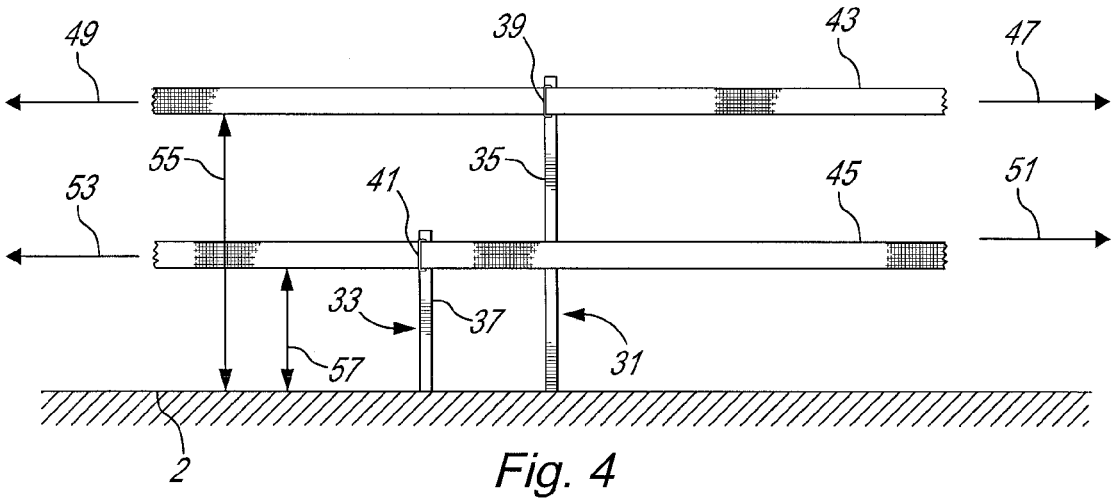
FIG. 4 is a schematic representation of an example barrier system in accordance with the present invention comprising two barrier components.

FIG. 4 illustrates an example barrier system having two barrier components, each barrier component comprising a respective independent elevation support element designated generally by the reference numerals 31 and 33. Each of the elevation support elements 31 and 33 has a respective height support member 35 or 37. Each of the elevation support elements 31 and 33 also has a respective releasable strap engagement member 39 or 41. As may be seen the elevation support members 35 and 37 extend vertically in relation to the floor 2. As in the case of the (length of the) strap member 1 of FIGS. 1 and 2, both of the (lengths of the) strap members 43 and 45 of FIG. 4 are shown as being tensioned as indicated by the respective pairs of arrows 47 and 49 and 51 and 53. As shown upper strap member 43 may, for example, be part of a top-rail component (i.e. be a top-rail strap member) and the lower strap member 45 may be part of a lower-rail component (i.e. be a mid-rail strap member). Accordingly, as may also be appreciated the height support member (33, 35) of each elevation support element (31, 33) in conjunction with a respective closed loop attached thereto, may maintain a respective strap member 43 or 45 at a respective predetermined height level above the floor 2, namely a respective first upper height level 55 and a respective second lower height level 57 below the first height level.

As shown in FIG. 4 each elevation support element and its corresponding height support member is distinct. Alternatively, the barrier system illustrated in FIG. 4 may be adapted so as to exploit a common elevation support element which has a single or common height support member associated with two releasable strap engagement members disposed so as to be able to engage the two (horizontally offset) strap members.

Figure 5:
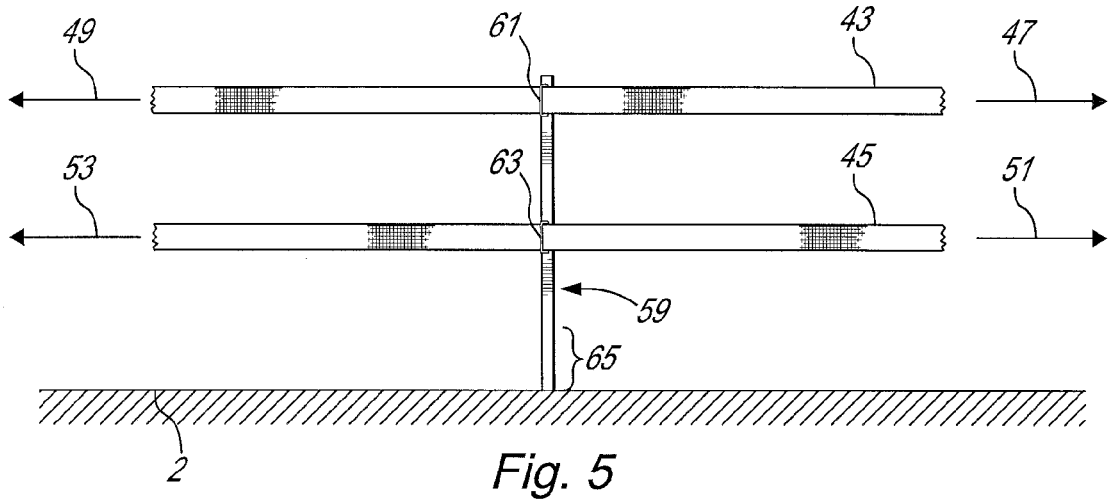
FIG. 5 is a schematic representation of an example barrier system in accordance with the present invention exploiting a common height support member.

Thus FIG. 5 illustrates an alternate example embodiment which differs from that as shown in FIG. 4 in that a single common height support member 59 is exploited to maintain the top-rail strap member 43 and the lower mid-rail strap member 45 at respective predetermined height levels. The common height support member 59 is associated with two releasable strap engagement members 61 and 63. The common height support member 59 has a ground engagement element 65 which in the embodiment shown also simple sits on or abuts the floor 2 (e.g. is not fixed to the floor). The dual engagement of both the upper and lower strap members connected to the common height support member 59 provides (vertical) stability to the vertically extending common height support member 59, i.e. the common height support member 59 is inhibited from a tendency to (laterally) pivot or rotate about the longitudinal axis of the (upper) strap member 43.

Thus it is to be appreciated that a barrier system as described herein may advantageously exploit common elevation support elements which may as desired or necessary have a single or common height support member associated with any desired or necessary number of releasable strap engagement members for engaging a plurality of horizontally offset strap members.

Referring to FIGS. 6 to 12, these figures show, in schematic fashion and by way of example only, various embodiments of barrier systems in accordance with the present invention.

The illustrated example barrier systems are shown as exploiting terminal pillar members (designated $\alpha$) as terminal anchor elements and intermediate pillar members (designated $\beta$) as intermediate anchor elements. Anchor pillar members (designated $\alpha/\beta$) are also shown which serve as a terminal anchor element for one (length of) strap member and also function as an intermediate anchor element for another (length of) strap member. The pillar members may for example be structural support members of a building or other similar covering structure; the pillar members may thus support and space apart a ceiling structural component from an underlying floor structural component. The ceiling structural component is not shown in the FIGS. 6-12. Furthermore, the upper portions of the pillar members connected to the ceiling structural component are shown as being cut away in FIGS. 6 to 12.

For the FIGS. 6 to 12, the tensioning devices for subjecting the various (lengths of the) strap members spanning the distances between the respective terminal anchor elements (i.e. between pillar members which are designated $\alpha$ and/or designated $\alpha/\beta$) are indicated by a common reference numeral, namely 67. The tensioning devices 67 are shown as being on the inner sides of the pillar members, i.e. between the pillar members. A tensioning device 67 may thus, as shown, be part of a tensioned length of a strap member. Alternatively, a tensioning device 67 may be disposed so as to be outside the tensioned length i.e. on an opposite or outer side of a terminal pillar member. The tensioning devices 67 for barrier components may of course be the same or different.

FIGS. 6 to 12, show elevation support elements which may as illustrated be span support elements, terminal support elements or both; the expression "elevation support element" may thus sometimes be used below to refer to one or all of such support elements.

In particular FIGS. 6 to 12 show span support elements for various (i.e. tensioned lengths of) strap members. The span support elements are disposed to engage the strap members at any of various (predetermined) points along the tensioned lengths of the strap members; in other words, a span support element is disposed to engage a strap member at a point along the length of the strap member spanning the distance between the terminal anchor elements (i.e. between pillar members which are designated $\alpha$ and/or designated $\alpha/\beta$).

As shown in FIGS. 6 to 12 span support elements may be freestanding span support elements, namely span support elements which are not associated with a pillar member i.e. are not attached or immobilized to a pillar member.

Span support elements are also shown in FIGS. 6 to 12 which alternatively are attached span support elements, namely span support elements which are associated with a pillar member functioning as an intermediate pillar member. Such attached span support elements are thus attached or immobilized to a pillar member designated β or to a pillar member designated α/β.

Terminal support elements are also shown in FIGS. 6 to 12 which are also attached support elements, namely terminal support elements which are associated with a pillar member functioning as a terminal pillar member. Such terminal support elements are thus attached or immobilized to a pillar member designated α or to a pillar member designated α/β.

Thus for FIGS. 6 to 12 as may be understood from the above:

a) Span support elements, which are freestanding and thus not attached or immobilized to a pillar member, are commonly designated with the reference numeral 69;
b) Span support elements which are attached or immobilized to an intermediate pillar member β, are commonly designated with the reference numeral 71;
c) Terminal support elements which are attached or immobilized to a terminal pillar member designated α, are commonly designated with the reference numeral 73; and
d) Elevation support elements which function both as a span support element and a terminal support element, and which are attached or immobilized to a pillar member α/β are commonly designated with the reference numeral 75.

In accordance with the present invention although the elevation support elements (whether freestanding or immobilized) are for illustration purposes given the above respective common designations for FIGS. 6 to 12, it is to be understood herein that the elevation support elements whether functioning as span support elements, terminal support elements or both, may each independently have the same or different configurations. Thus each of the span support elements, each of the terminal support elements, etc. as shown in FIGS. 6 to 12 may in particular, for example, have a configuration which may be independently selected from among those such as shall be described below by way of example in relation to FIGS. 13 to 53.

In the FIGS. 6 to 12 the elevation support elements whether functioning as span support elements, terminal support elements or both, and comprising a height support member (commonly designated by the reference numeral 76) may have a releasable top-rail strap engagement member (commonly designated with the reference numeral 77) for releasably engaging a top-rail strap member commonly designated by the reference numeral 78.

On the other hand, as the case may be, the elevation support elements whether functioning as span support elements, terminal support elements or both, and comprising a common height support member (commonly designated by the reference numeral 79) may also have a releasable toe-rail strap engagement member (commonly designated with the reference numeral 80) for releasably engaging a toe-rail strap member commonly designated by the reference numeral 82; and/or a releasable mid-rail strap engagement member (commonly designated with the reference numeral 84) for releasably engaging a mid-rail strap member commonly designated by the reference numeral 86.

With reference to FIGS. 6 to 12, a top-rail strap engagement member 77 is connected or attached to the height support member or common height support member for maintaining a respective length of tensioned strap member at a top predetermined height level indicated by the double headed arrow commonly designated by the reference numeral 88.

Figure 10:
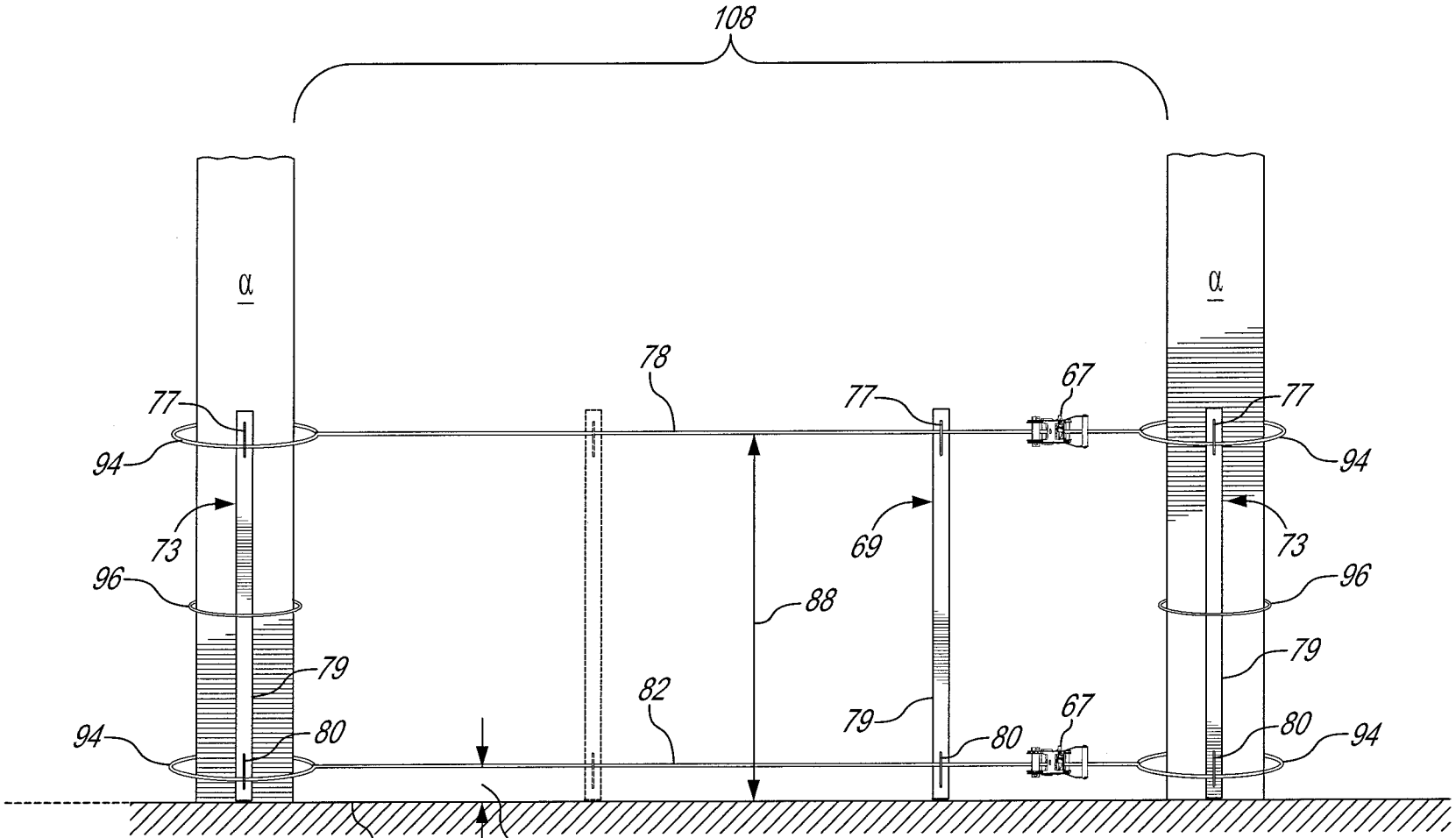
FIG. 10 is a schematic illustration of an example barrier system in accordance with the present invention comprising two barrier components exploiting common height support members.
Figure 11:
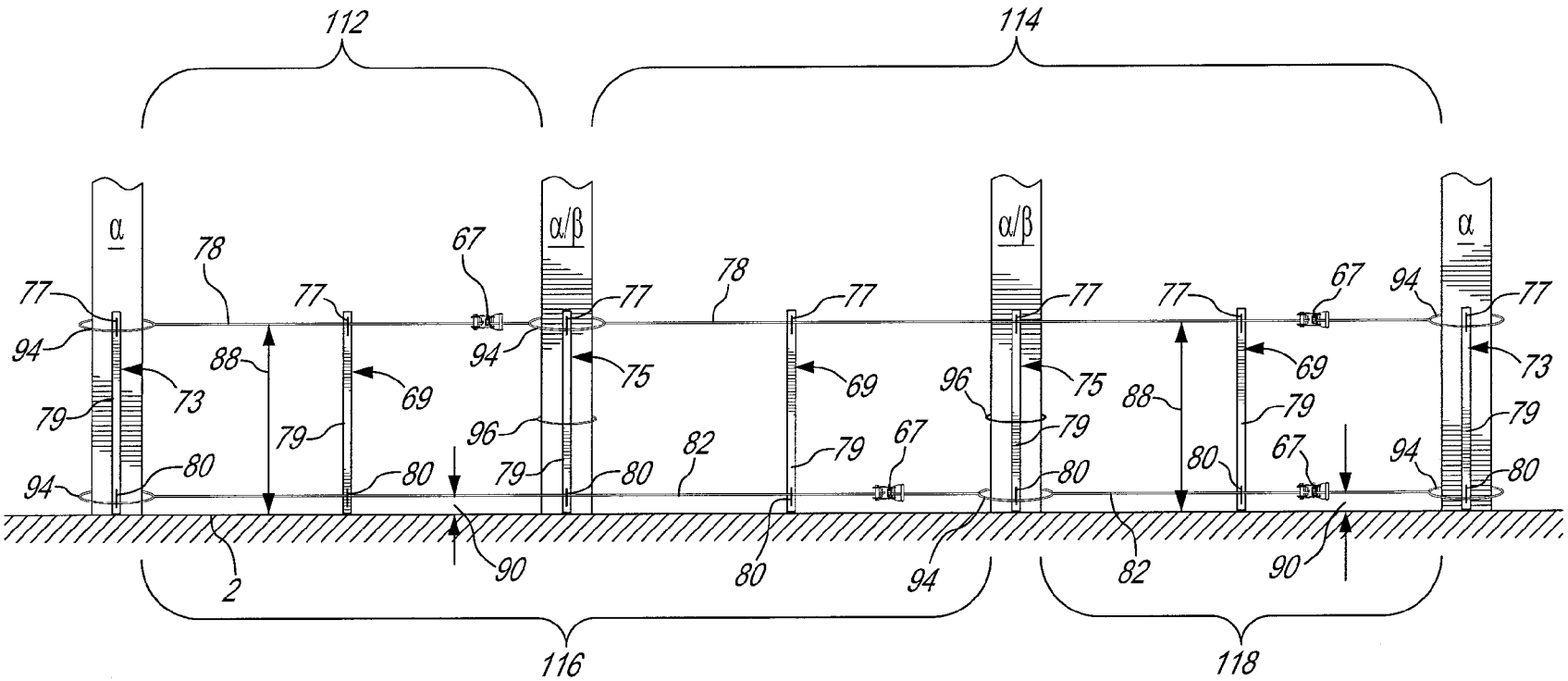
FIG. 11 is a schematic illustration of an example barrier system in accordance with the present invention comprising four barrier components exploiting common height support members.

With reference to FIGS. 10 and 11 a toe-rail strap engagement member 80 is connected or attached to the common height support members for maintaining a respective length of tensioned toe-rail strap member at a low predetermined height level indicated by the paired arrows and commonly designated by the reference numeral 90.

Figure 12:
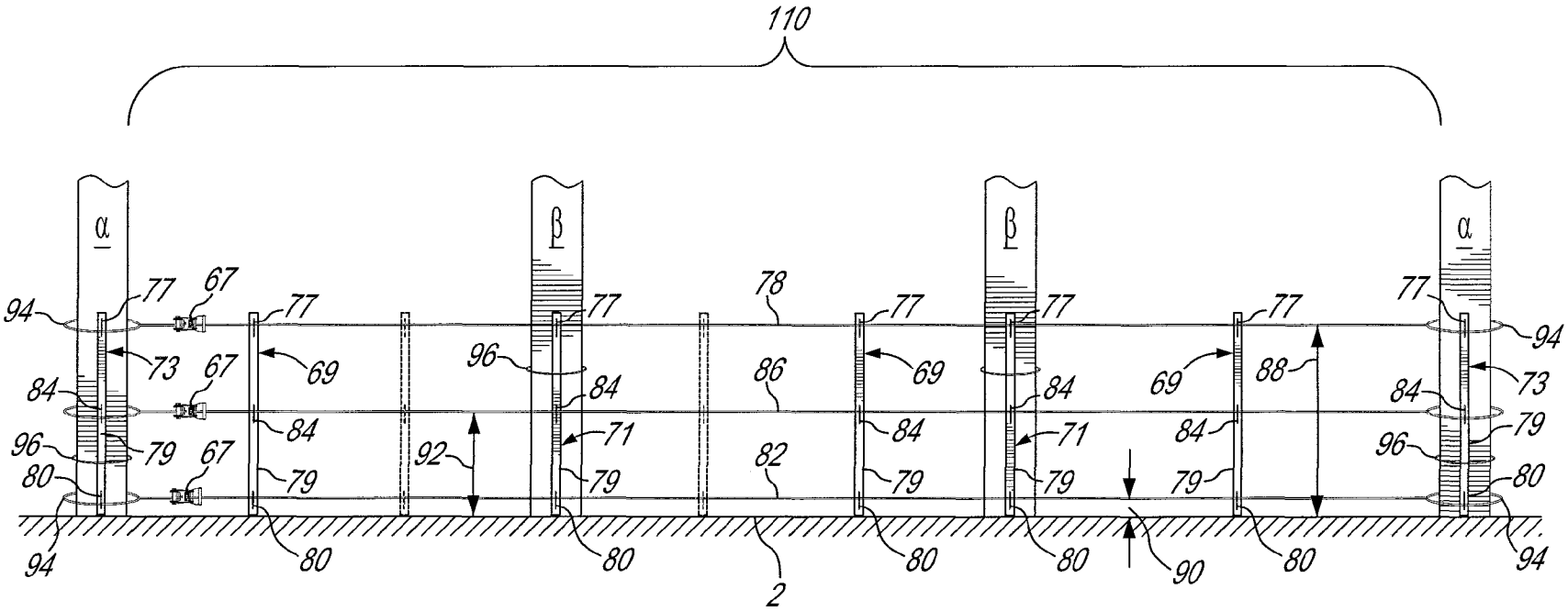
FIG. 12 is a schematic illustration of an example barrier system in accordance with the present invention comprising three barrier components exploiting common height support members.

With reference to FIG. 12 a mid-rail strap engagement member 84 is connected or attached to the common height support members for maintaining a respective length of tensioned mid-rail strap member 86 at a middle predetermined height level indicated by the double headed arrow commonly designated by the reference numeral 92.

As mentioned, as shown in FIGS. 6 to 12, the elevation support elements (whether as a freestanding or immobilized), each comprise a respective height support member. In each case, the height support member 76 or the common height support member 79 has a ground engagement element which in the embodiments shown is simply able to sit on or abut the floor 2 (e.g. is not fixed to the floor).

In FIGS. 6, and 8 to 12 the various lengths of the tensioned strap members is attached to a respective terminal pillar designated α or designated α/β by exploiting a girdle element disposed about the pillar member; the girdle elements are commonly identified in these figures by the reference numeral 94. The girdle elements 94 may be the same or different as desired or necessary. The girdle elements 94 may for example comprise a strap anchor segment and be attached to a respective strap member by a respective strap attachment element. Various examples of girdle elements and strap attachment techniques are described below.

In FIGS. 7, 8, 10, 11 and 12, immobilized elevation support elements (including terminal support elements) may be immobilized to respective pillar members designated α, designated β or designated α/β by respective strap/ratchet type elements having strap members which may be tensioned about the pillar members using known ratchet techniques; the strap/ratchet type elements are commonly identified in these figures by the reference numeral 96. The strap/ratchet type elements 96 may be the same or different as desired or necessary. An example strap/ratchet element is described below.

Figure 6:
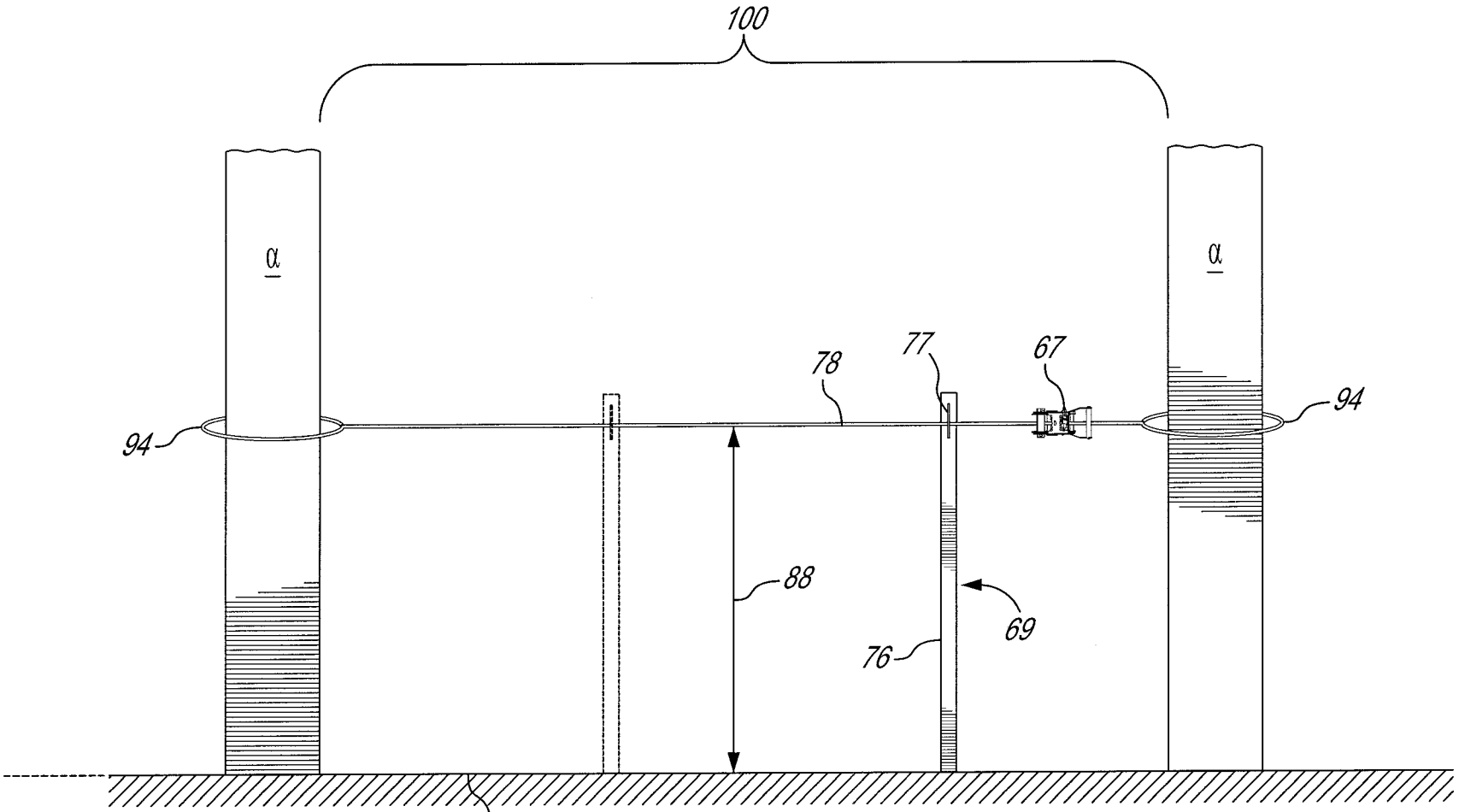
FIG. 6 is a schematic illustration of an example barrier system in accordance with the present invention comprising terminal pillar members.

Referring to FIG. 6, the illustrated barrier system has two terminal pillar members α. The strap member 78 tensioned between these two pillar members by the tensioning device 67 has a tensioned strap member length which is indicated by the parenthesis designated by reference numeral 100. Although the barrier system is shown with a single span support element 69 such a barrier system may have two or more of such span support elements; an additional span support element is shown in dotted outline. The span support element 69 may for example be centrally disposed between the pillar members α. If two such span support elements are exploited they may be disposed as desired or necessary along the span of tensioned strap member (e.g. they may be equidistantly spaced from a respective pillar member α).

Figure 7:
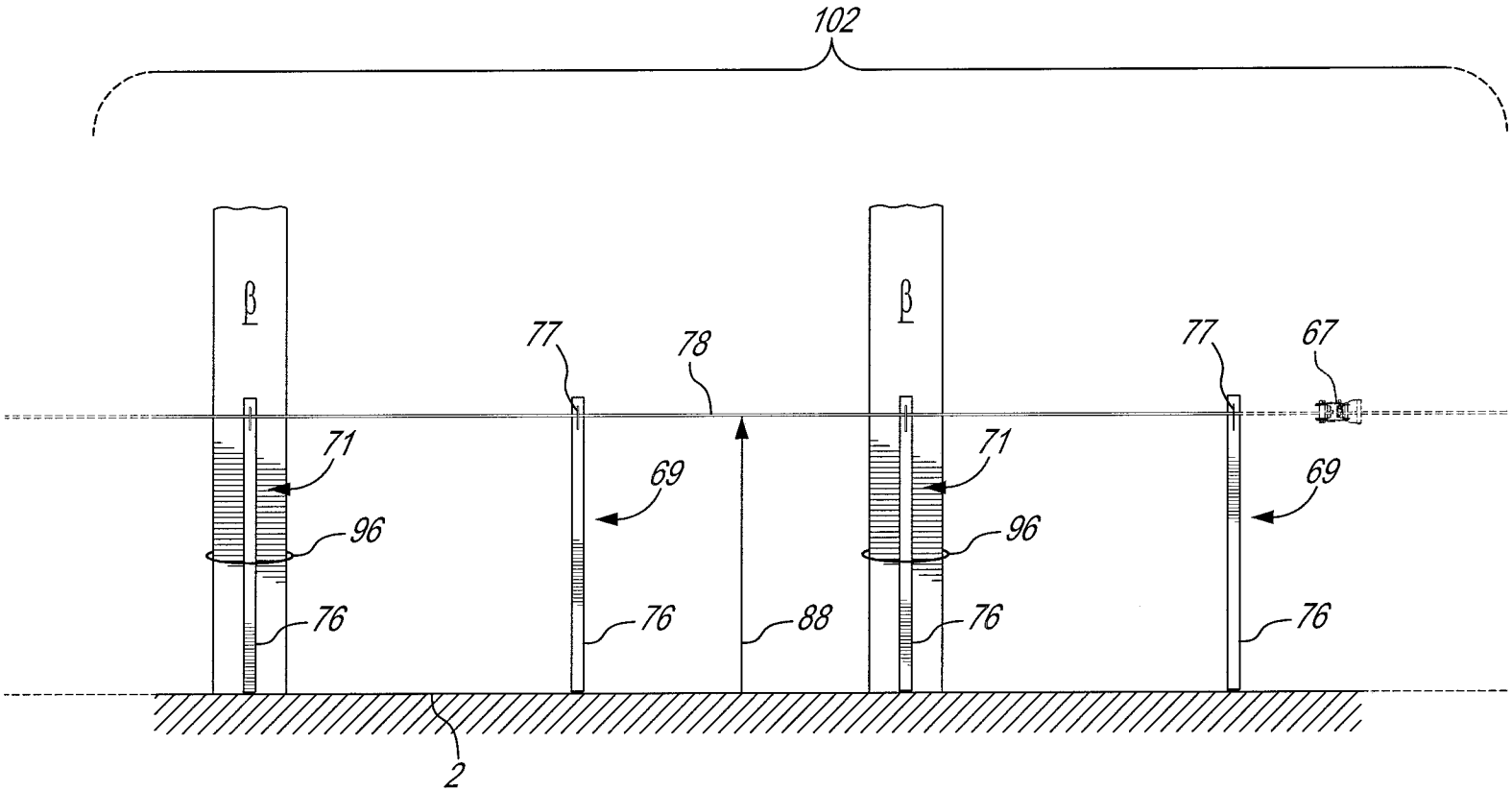
FIG. 7 is a schematic illustration of an example barrier system in accordance with the present invention comprising intermediate pillar members.

Referring to FIG. 7, the illustrated barrier system has two intermediate pillar members β. The parenthesis (designated by reference numeral 102) as well as the strap member 78 has terminal dotted lines to indicate that the illustrated barrier system may comprise additional intermediate pillar members β along with associated elevation support elements. The terminal dotted lines of the parenthesis 102 and strap member 78 are also to be understood as being indicative that while the terminal anchor elements may take the form of pillar members, the terminal anchor elements may alternatively take any other desired or necessary form provided that the strap member 78 is attached thereto by suitable connector means. As may be appreciated the strap member 78 is tensioned between two terminal anchor elements (not shown) by a tensioning device 67 indicated in dotted outline such that the strap member 78 has a tensioned strap member length which is indicated by the above mentioned parenthesis 102.

Figure 8:
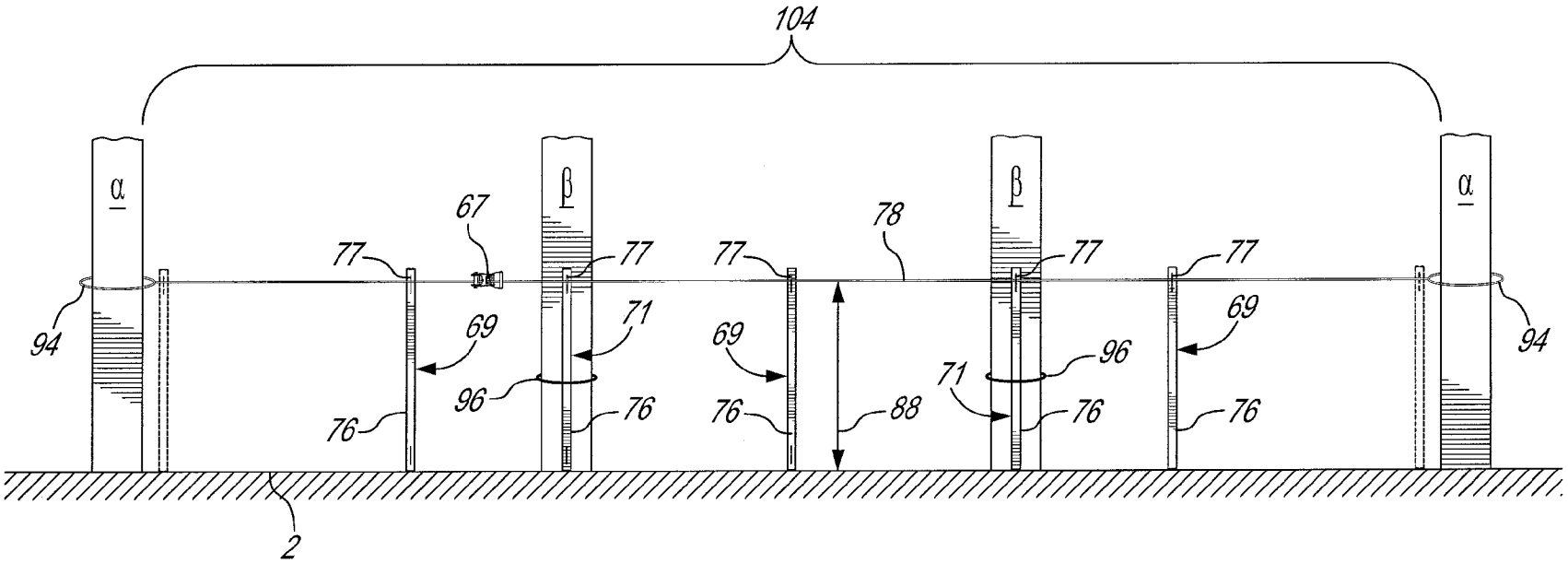
FIG. 8 is a schematic illustration of an example barrier system in accordance with the present invention comprising terminal and intermediate pillars.

FIG. 8 illustrates a barrier system which is a combination of the systems shown in FIGS. 6 and 7. Thus in FIG. 8, the illustrated barrier system has two terminal pillar members α and two intermediate pillar members β. The strap member 78 which is tensioned between the two pillar members α by the tensioning device 67 has a tensioned strap member length which is indicated by the parenthesis designated by reference numeral 104. The barrier system is shown with a single span support element 69 disposed between pillar members; as may be appreciated such a barrier system may have additional span support elements disposed between pillar members. Furthermore as desired or necessary the barrier system may also include one or more elevation support elements disposed just adjacent the pillar members α as shown in dotted outline; these additional adjacent elevation support elements may be so disposed so as to maintain strap member adjacent the pillar members a at the above mentioned top predetermined height level 88.

Figure 9:
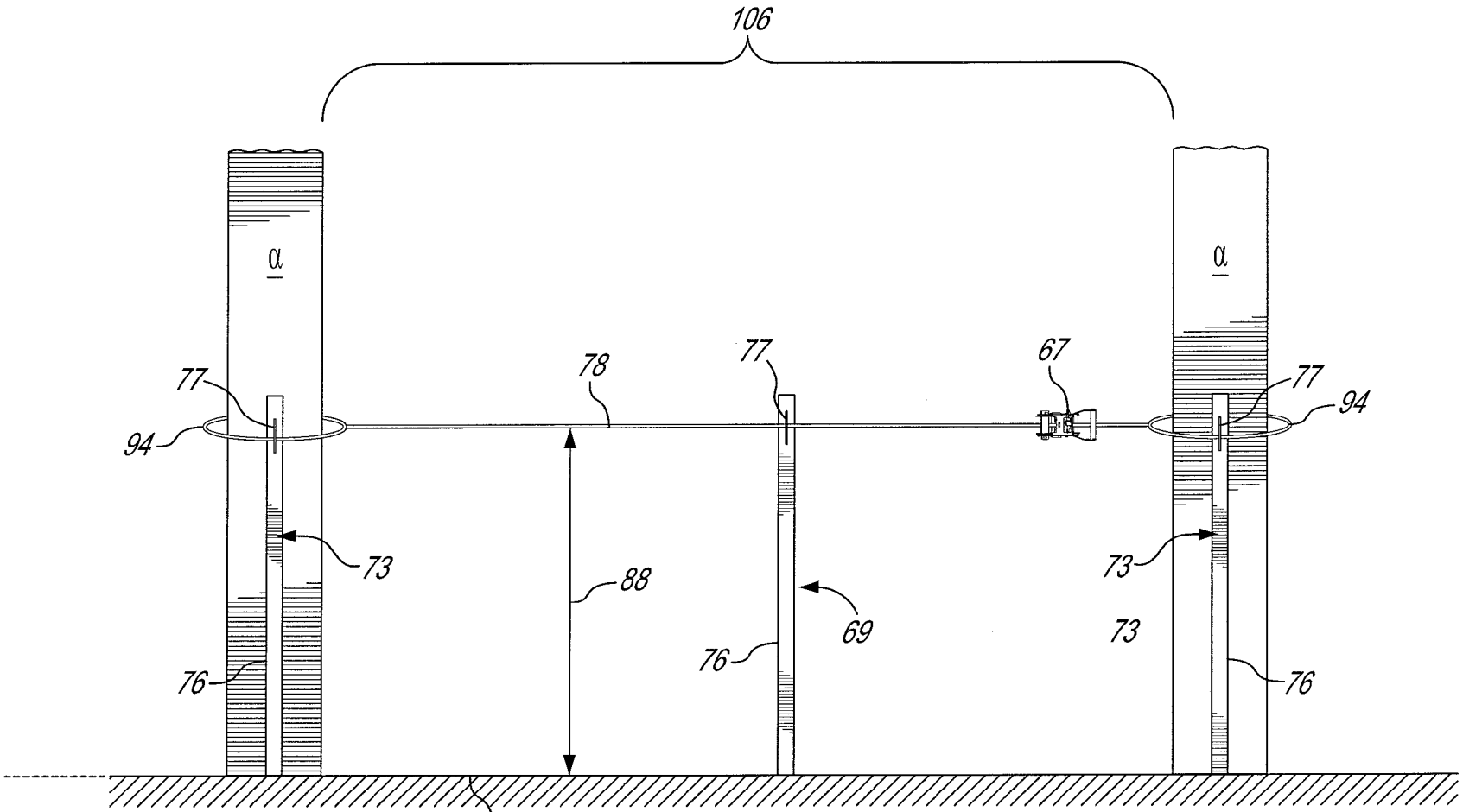
FIG. 9 is a schematic illustration of an example barrier system in accordance with the present invention comprising terminal (elevation) support element.

As an alternative to disposing elevation support elements just adjacent the pillar members α as shown in dotted outline in FIG. 8, the terminal pillar members α may be associated with respective terminal support elements which are immobilized thereto as shown in FIG. 9 by respective girdle elements 94. As in the case of FIG. 6, the strap member tensioned between these two pillar members a by the tensioning device 67 has a tensioned strap member length which is indicated by the parenthesis designated by reference numeral 106.

FIG. 10 shows a modified version of the barrier system indicated in FIG. 9. The illustrated modified barrier system of FIG. 10 has two barrier components one of which has the top-rail strap member 78 while the other has a toe-rail strap member 82. The illustrated barrier components however, share the same elevation support elements designated 69 and 73 which have a common height support member 79 for maintaining the top-rail strap member and the toe-rail strap member at respective predetermined height levels 88 and 90; as may be seen in the case of the toe-rail strap member, the second height level 90 is such that this strap member 82 is disposed adjacent the floor 2. An optional additional span support element is also shown in dotted outline. The strap members 78 and 82 which are each tensioned between the two pillar members α by respective tensioning devices 67, each have a tensioned strap member length which is indicated by the parenthesis designated by reference numeral 108.

Referring to FIG. 12, this figure illustrates a modified version of the barrier system indicated in FIG. 10. Thus in FIG. 12, the illustrated barrier system has two terminal pillar members α and two intermediate pillar members β. The illustrated modified barrier system of FIG. 12 also has three barrier components one of which has the top-rail strap member 78, another of which has the toe-rail strap member 82 and the remaining of which has a mid-rail strap member 86. The illustrated barrier components however, share the same elevation support elements designated 69, 71 and 73 which have a common height support member 79 for maintaining the top-rail strap member 78, the toe-rail strap member 82 and the mid-rail strap member 86 at respective predetermined height levels 88, 90 and 92. Optional additional shared elevation support member(s) are also shown in dotted outline. The strap members 78, 82 and 86 which are tensioned between the two pillar members α by the respective tensioning devices 67, each have a tensioned strap member length which is indicated by the same parenthesis designated by reference numeral 110.

Referring now to FIG. 11, this figure illustrates a modified version of the barrier system shown in FIG. 12. The barrier system of FIG. 11 differs from the system shown in FIG. 12 in that the barrier system of FIG. 11 does not exploit strap/ratchet type elements 96 to immobilize the elevation support elements 73 to the terminal pillar members; the elevation support elements 73 are immobilized by the girdle elements 94 alone. The barrier system of FIG. 11 also differs from the system shown in FIG. 12 in that the barrier system of FIG. 11 only has a top-rail structure and a toe-rail structure. The barrier system of FIG. 11 additionally differs from the system shown in FIG. 12 in that there are four barrier components each of which comprises a respective tensioned strap member length. In other words, there are four tensioned strap member lengths. The top rail structure is thus defined by the two (upper) tensioned strap member lengths designated by the two parenthesis indicated by reference numerals 112 and 114. The toe rail structure is defined by the two (underlying) tensioned strap member lengths designated by the tow parenthesis indicated by reference numerals 116 and 118. The illustrated barrier components, furthermore, share the same elevation support elements designated 69, 73 and 75 which have a common height support member 79 for maintaining the top-rail strap members 78 and the toe-rail strap members 82 at respective predetermined height levels 88 and 90.

Referring to FIGS. 13 to 53, these figures illustrate various example embodiments of elevation support elements which may be used as an elevation support element having a common height support member. Thus the illustrated elevation support elements each have a respective common height support member (which for illustration purposed herein is designated by the same reference numeral 120. The common height support members 120 each includes a respective ground engagement element (which for illustration purposes herein is designated by the same reference numeral 122).

In the FIGS. 13 to 53 three respective releasable strap engagement members are attached to a respective common height support member 120. Thus in the FIGS. 13 to 53 for illustration purposes releasable top-rail strap engagement members are commonly designated by the reference numeral 124; releasable mid-rail strap engagement members are commonly designated by the reference numeral 126; and releasable toe-rail strap engagement members are commonly designated by the reference numeral 128. These releasable strap engagement members are each attached to, connected to, or part of a respective common height support member 120 for releasably engaging a respective top-rail, mid-rail and toe-rail strap member (commonly designated in these figs by the reference numerals 130, 132 and 134). These rail strap members 130, 132 and 134 are to be understood as being untensioned unless they are shown is association with opposed arrows indicative of tensioning thereof.

In accordance with the present invention a releasable strap engagement member for a elevation support element may take any desired or necessary form keeping in mind the function thereof. As mentioned above, the present invention may be exploited by having recourse to a releasable strap engagement member for the elevation support element which may, for example, take the form of a clamp structure.

Figure 13:
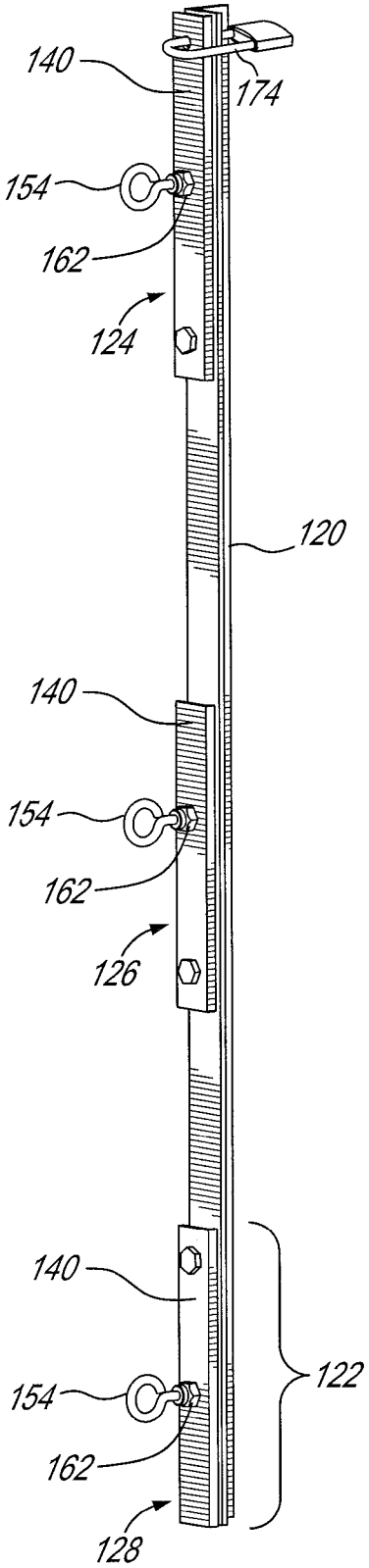
FIG. 13 is a side perspective view of an example elevation support element exploiting strap member clamp means.
Figure 14:
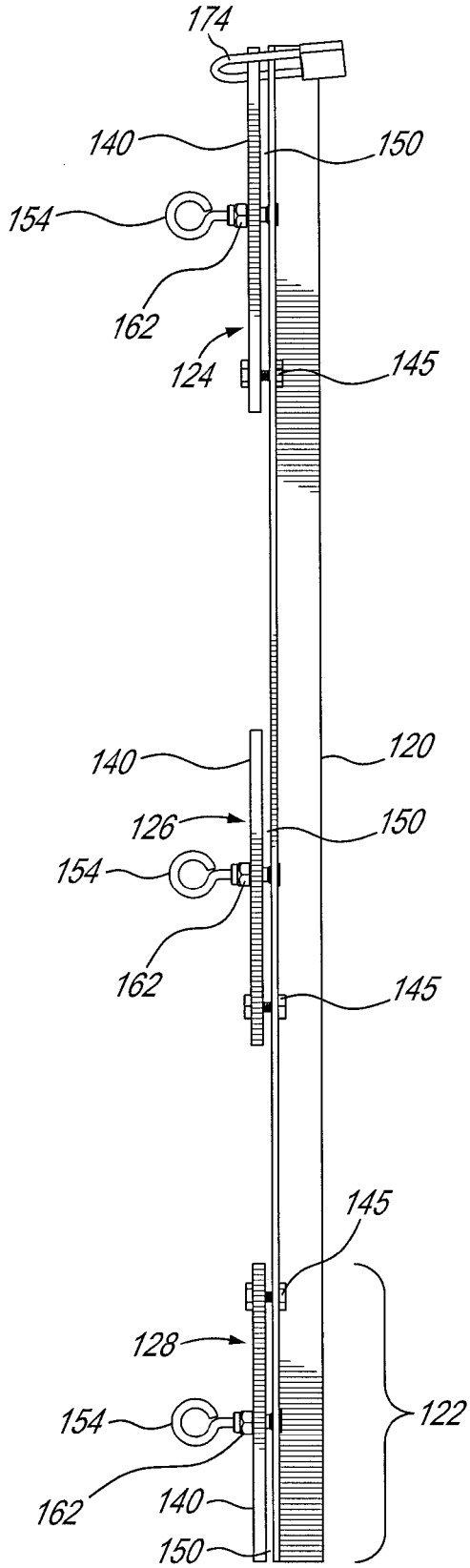
FIG. 14 is a side view of the example elevation support element of FIG. 13.
Figure 15:
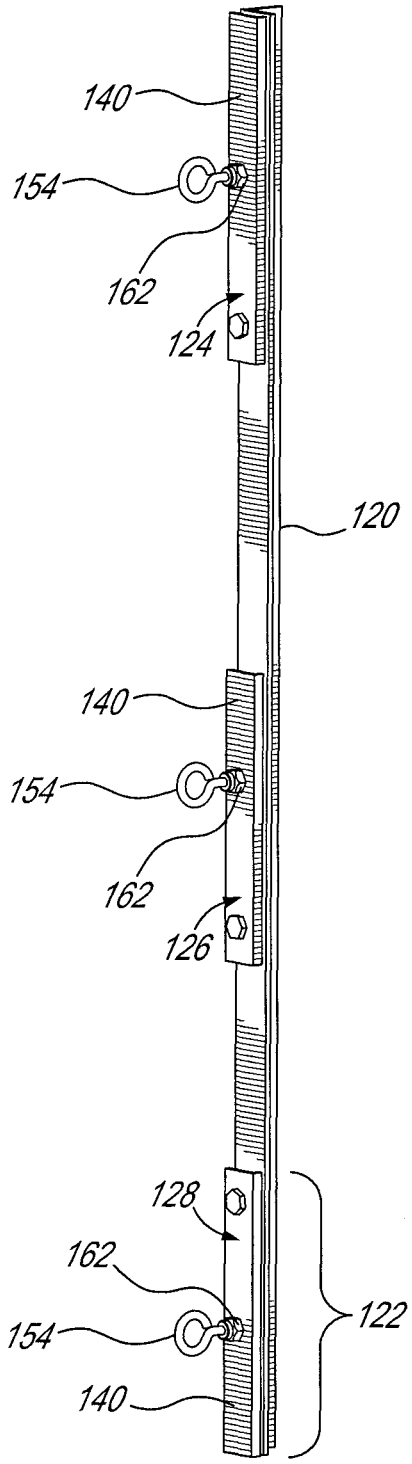
FIG. 15 is a side perspective view of a modified version of the example elevation support element of FIG. 13 (i.e. without a padlock)
Figure 16:
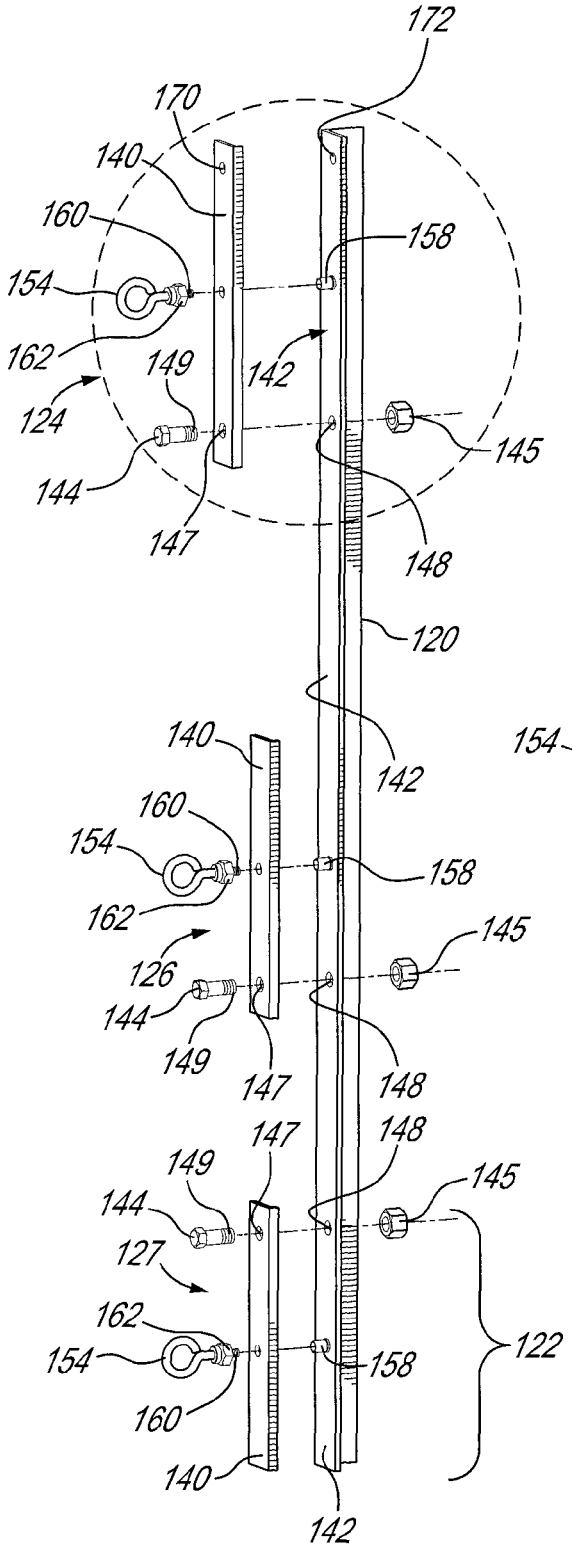
FIG. 16 is an exploded view of the example elevation support element of FIG. 13 but without an installed padlock.
Figure 17:
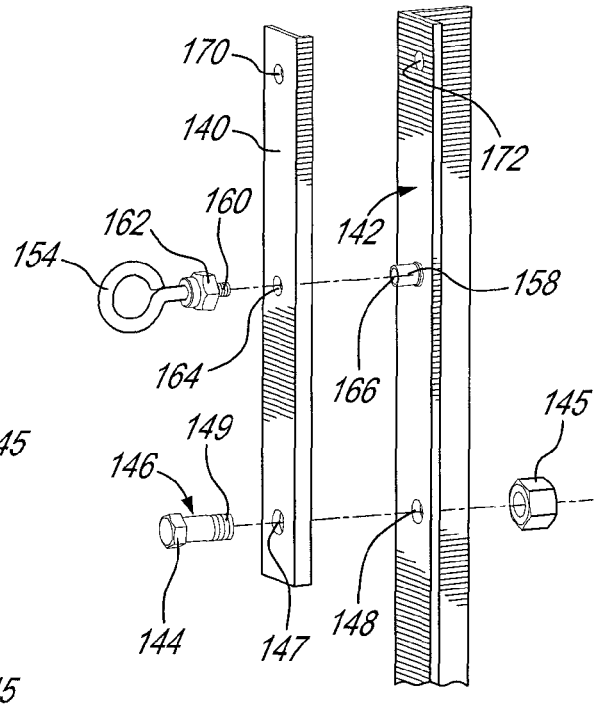
FIG. 17 is an enlarged view of the top releasable strap engagement member of the example elevation support element of FIG. 16.

FIGS. 13 to 20 illustrate elevation support elements having a clamp type structure which is essentially the same for all three respective releasable strap engagement members 124, 126 and 128. FIGS. 13 and 17 show the same type of elevation support elements except that the elevation support element of FIGS. 13 and 14 differs from that of FIG. 15 in that the elevation support element of FIGS. 13 and 14 is additionally associated with a padlock mechanism described below.

Referring in particular to FIGS. 16 and 17, each of the illustrated releasable clamp structures comprises a first clamp member 140 and a second clamp member 142; the second clamp member 142, as may be seen, is defined by a portion of the structure of the common height support member 120 which is juxtaposed with the first clamp member 140. The first clamp member 140 is connected to the height support structure by a connector element and by an adjustable locking element.

The connector element comprises a bolt member 144 and a mating nut member 145 The stem 146 of the bolt member 144 is able to pass through aligned openings 147 and 148 so that the threaded end 149 of the bolt member 144 is seated into the interior thread of the nut member 145 just enough to provide for a default clearance 150 (i.e. a clearance space) between the first and second clamp members. The default clearance 150 is at least sufficient to allow a (tensioned) rail strap member to pass between the first and second clamp members when the adjustable locking element is in a loosened state, i.e. for disposition of a strap member in and out of the space defined by the default clearance 150. The connector element is present to maintain this minimum connection between the first and second clamp members 140 and 142.

The adjustable locking element comprises an eye bolt member 154 and a nut like rivet member 158 which is machine pressed (in any known manner) to the height support member 120. The eye bolt member 154 has a threaded end 160 for screw engagement with the interior thread of the nut like member 158. The eye bolt member 154 also has a stopper member 162 which is fixed to its stem just rearward of the threaded end 160 so that the threaded end 160 is exposed. The exposed threaded end 160 is sized to pass through an opening 164 (in the first clamp member 140) which is aligned with the opening 166 of the threaded interior of the nut like member 158 so that the threaded end 160 can screw engage the threaded interior of the nut like member 158.

As may be appreciated the exposed threaded end 160 of eye bolt member 154 and the interior thread of the nut like member 158 are configured such that rotation of the threaded end 160 of the eye bolt into the nut like member (i.e. in a tightening rotational direction) will induce or cause the stopper member 162 to bear down on the first clamp member 140. As the stopper member 162 bears down on the first clamp member 140, the first clamp member 140 is urged (i.e. is displaced) towards the second clamp member 142 which in turn reduces the clearance between the first and second clamp members relative to the mentioned default clearance 150. If a rail strap member is disposed between the first and second members it will eventually be squeezed or clamped between these two clamp members. A rail strap member so clamped may be released by rotation of the threaded end 160 of the eye bolt out of the nut like member 158 so that the above mentioned default clearance 150 is obtained.

In more general terms the first clamp member is displaceable relative to the second clamp member by (eye bolt) adjustment means configured for facilitating displacement of the first and second clamp members relative to each other for engagement and disengagement of a strap member there between.

If desired, a releasable strap engagement member 124 may be provided with suitable means for locking the two clamp members 140 and 142 together in place. As may be seen in FIGS. 13, 14 and 17 such a locking mechanism, may comprise openings 170 and 172 (see FIG. 17) which are suitably provided in the first clamp member 140 and the second clamp member 142 respectively. As may be seen from FIGS. 13 and 14 the openings 170 and 172 may be configured to receive the U-shaped shackle 174 of a padlock mechanism for locking the first and second clamp members together. This type of locking mechanism may provide an extra security feature in that the tensioned strap member may, for example, not be undesirably tampered with i.e. disengaged from the clamp member. The padlock mechanism is of course installed once the releasable strap engagement member 124 engages a strap member.

Figure 18:
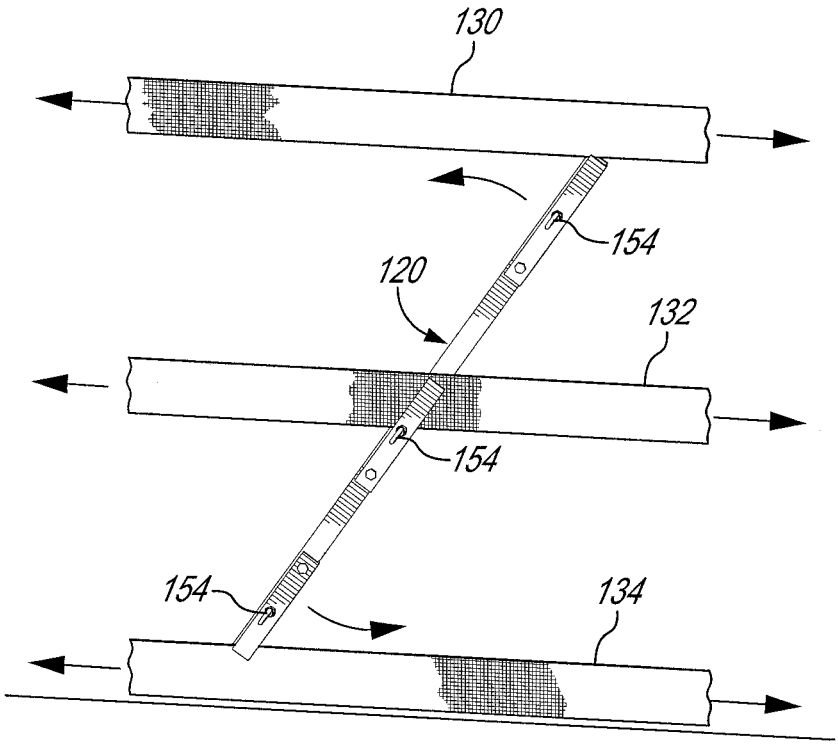
FIG. 18 is a schematic illustration of the example elevation support element of FIG. 15 being attached to tensioned strap members which are attached to anchor elements (not shown)
Figure 19:
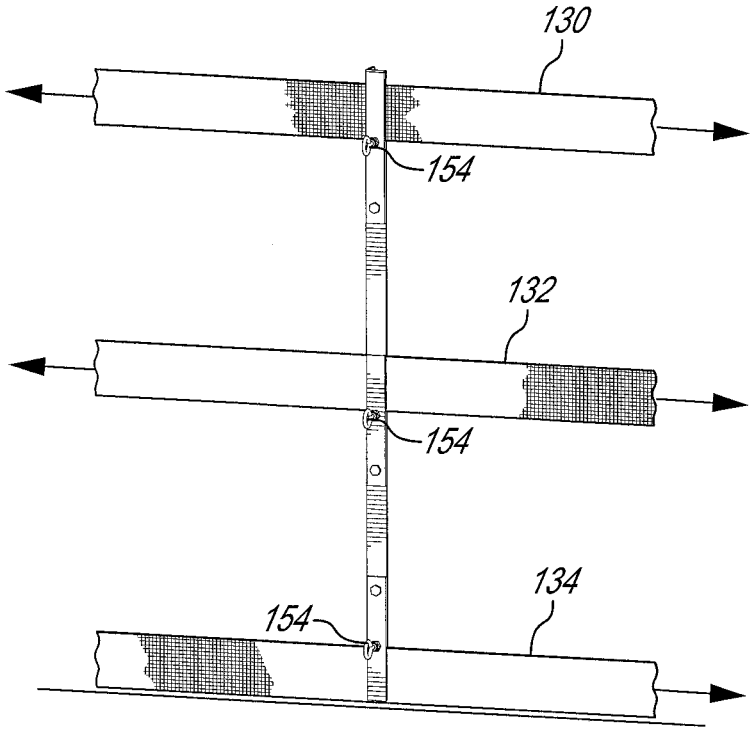
FIG. 19 is a schematic illustration of the example elevation support element of FIG. 15 attached in vertically upstanding fashion to tensioned strap members which are attached to anchor elements (not shown)
Figure 20:
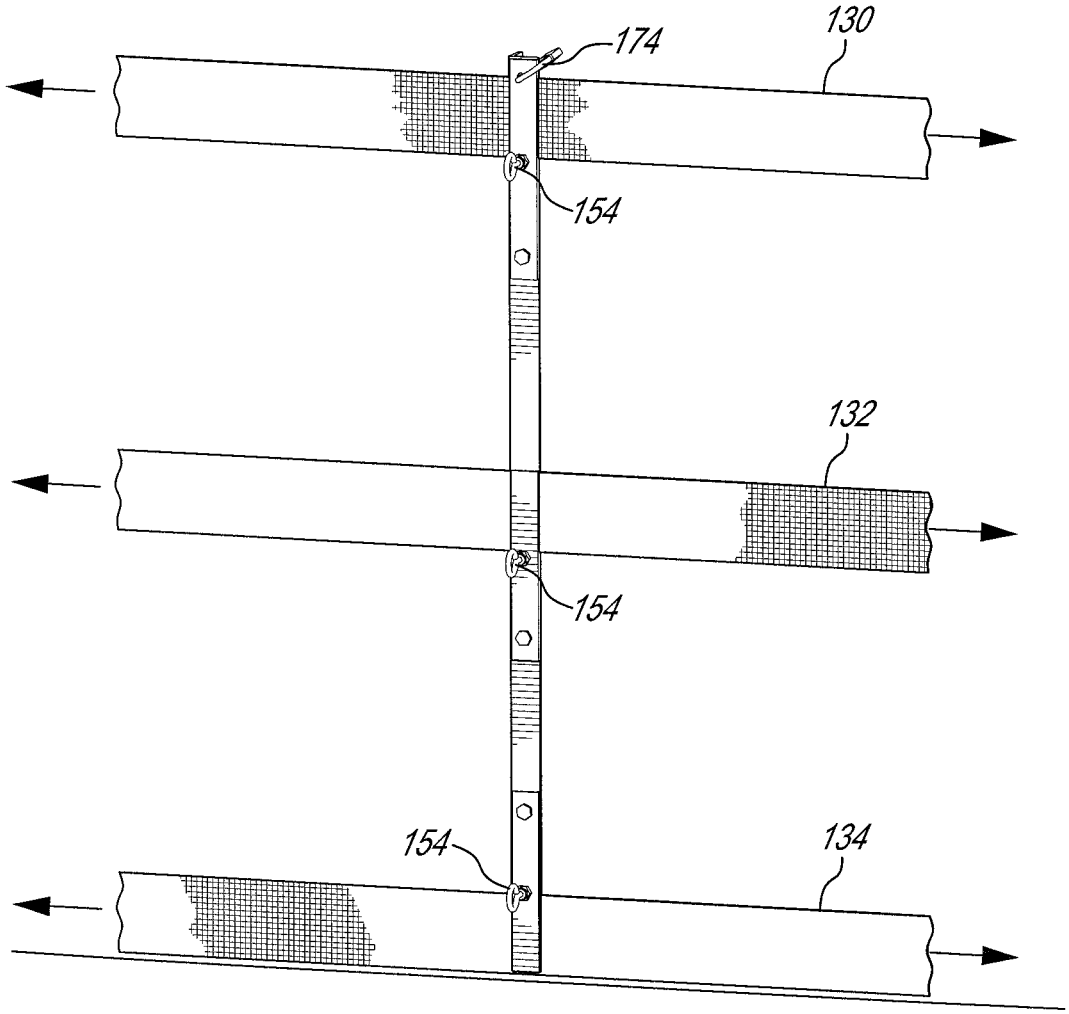
FIG. 20 is a schematic illustration of the example elevation support element of FIG. 13 attached in vertically upstanding fashion to tensioned strap members which are attached to anchor elements (not shown)

Turning to FIGS. 18 and 19 these figure illustrate the engagement of an elevation support element of FIGS. 13 to 17 with a tensioned top-rail strap member, a tensioned mid-rail strap member and a tensioned toe-rail strap member. In particular FIG. 18 shows in general the process for engagement of the clamp type elevation support element of FIGS. 13 to 17 into engagement with the three tensioned strap members 130, 132 and 134. For such engagement it is of course understood that the clamp structures are disposed so as to provide the default clearance 150 for insertion of the rail strap members between the first and second clamp members. The tensioned rail strap members 130, 132 and 134 are inserted into respective clearance spaces 150 by positioning the elevation support element 120 as shown at an angle to the vertical. Once the strap members are manipulated into a respect clearance space 150 the elevation support element 120 is rotated to the vertical position shown in FIG. 19. The adjustable locking element is then manipulated to clamp the strap members between respective clamp members. If desired or necessary an above mentioned padlock mechanism may then be added; see shown in FIG. 20. For removal of the elevation support element the reverse process is followed.

Alternatively, as mentioned above, a releasable strap engagement member may comprise grip means which generally comprises a loop element.

Figure 21:
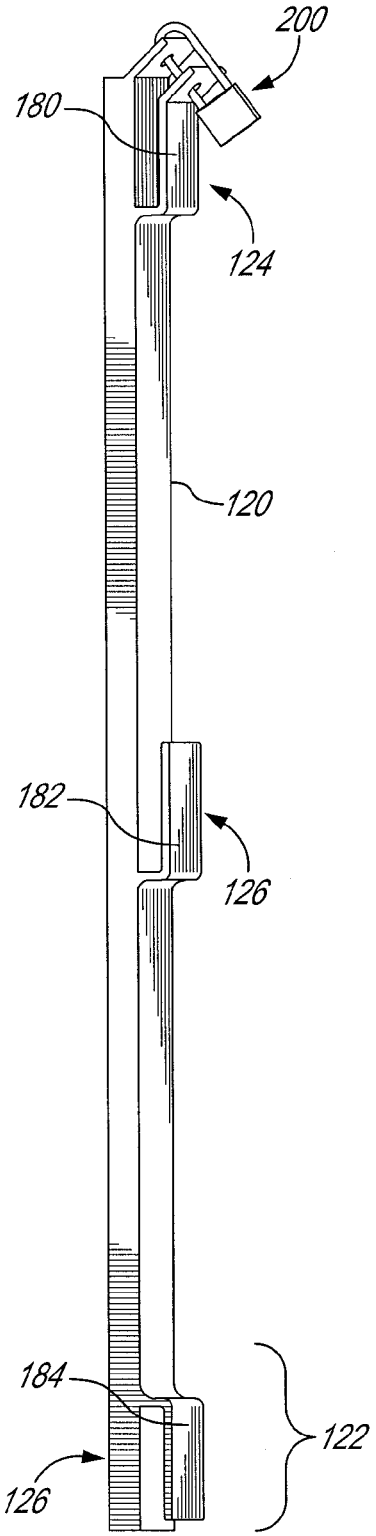
FIG. 21 is a side perspective view of another example elevation support element exploiting loop elements split by strap openings.
Figure 22:
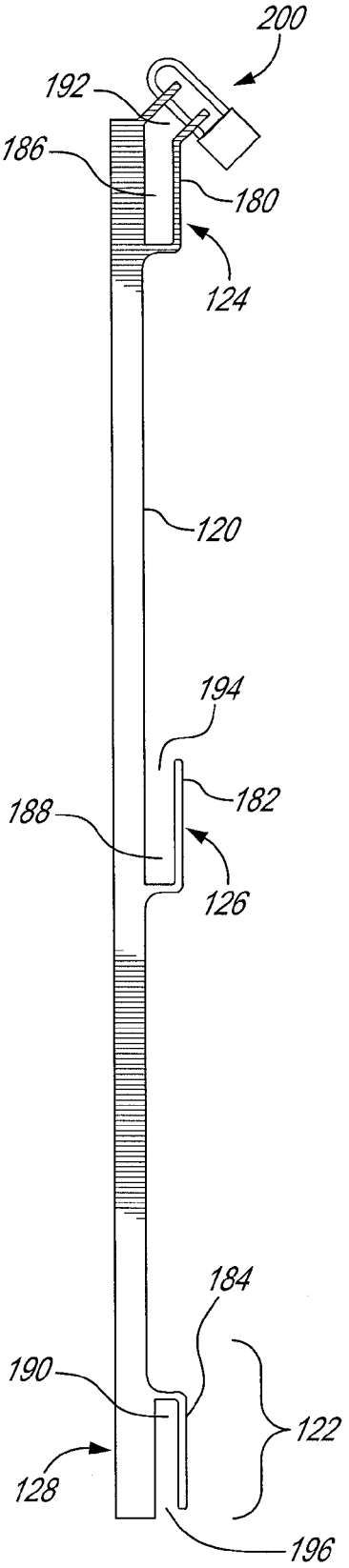
FIG. 22 is a side view of the example elevation support element of FIG. 21.
Figure 23:
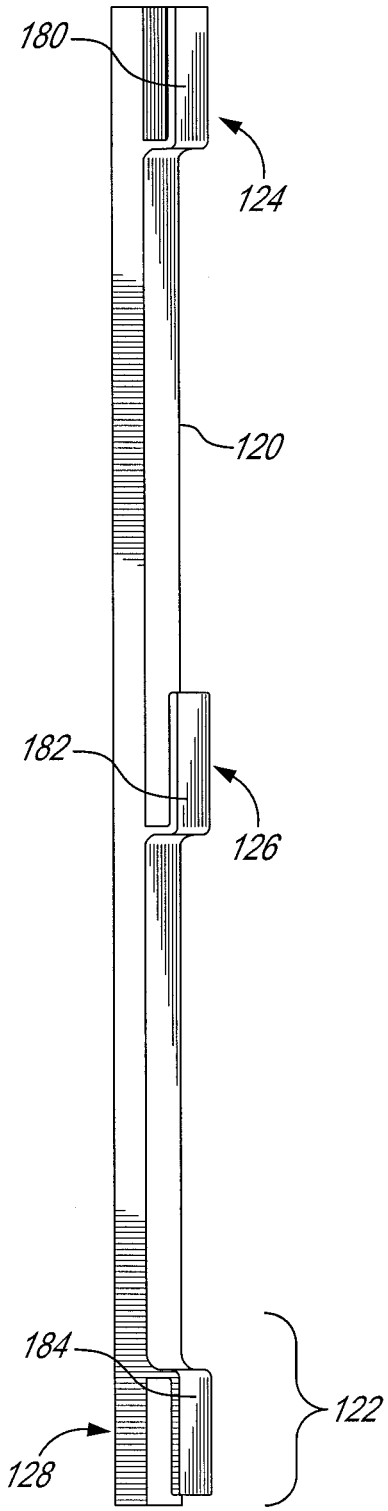
FIG. 23 is a side perspective view of a modified version of the example elevation support element of FIG. 21 (i.e. without a padlock)

FIGS. 21 to 27 show example embodiments of elevation support elements exploiting grip means comprising loop elements for the top, mid and toe releasable strap engagement members. FIGS. 21 to 25 show the same type of elevation support elements except that the elevation support element of FIGS. 21 and 22 differs from that in FIGS. 24 and 25 in that the elevation support element of FIGS. 21 and 22 is additionally associated with a padlock mechanism described below.

Figure 24:
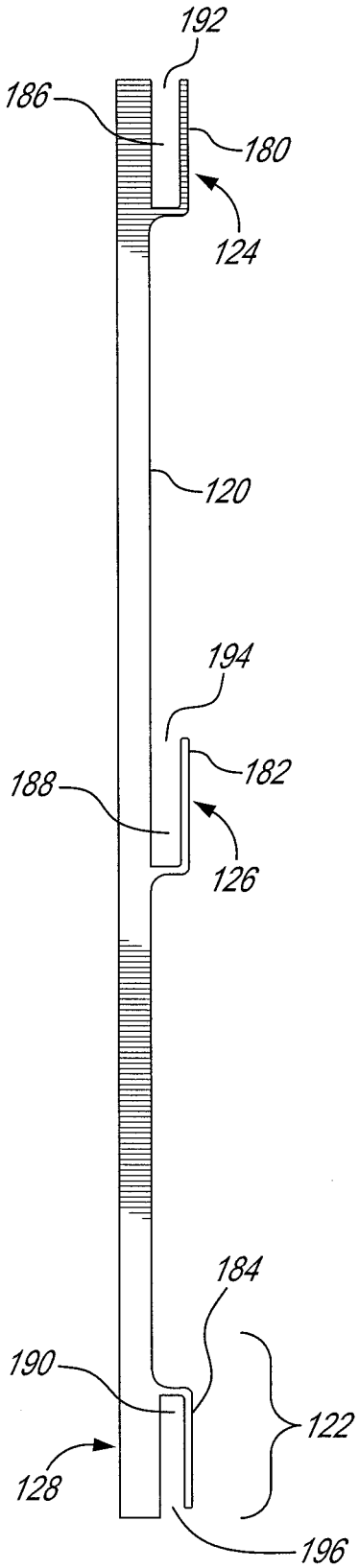
FIG. 24 is a side view of the example elevation support element of FIG. 23.
Figure 25:
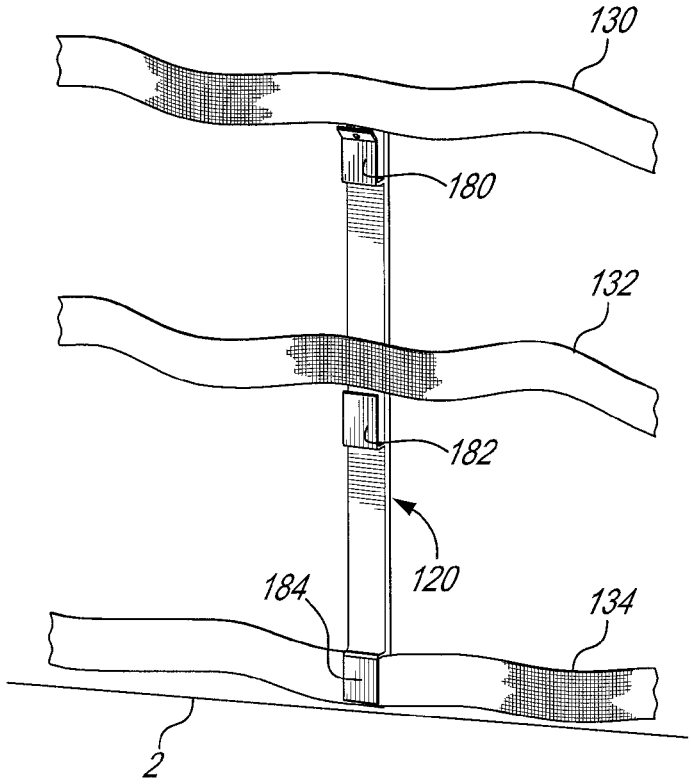
FIG. 25 is a schematic illustration of the example elevation support element of FIG. 21 being attached to un-tensioned strap members which are attached to anchor elements (not shown)
Figure 26:
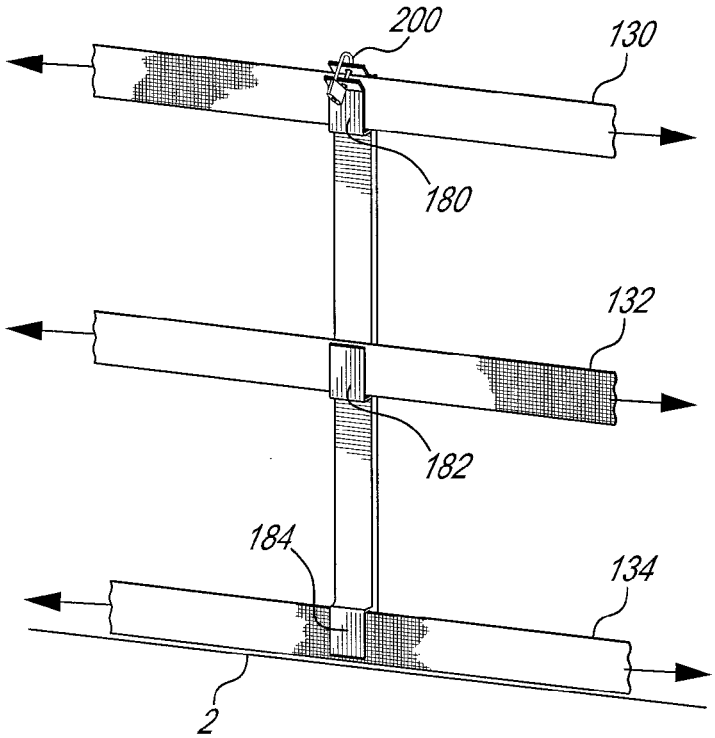
FIG. 26 is a schematic illustration of the example elevation support element of FIG. 21 attached in vertically upstanding fashion to tensioned strap members which are attached to anchor elements (not shown)
Figure 27:
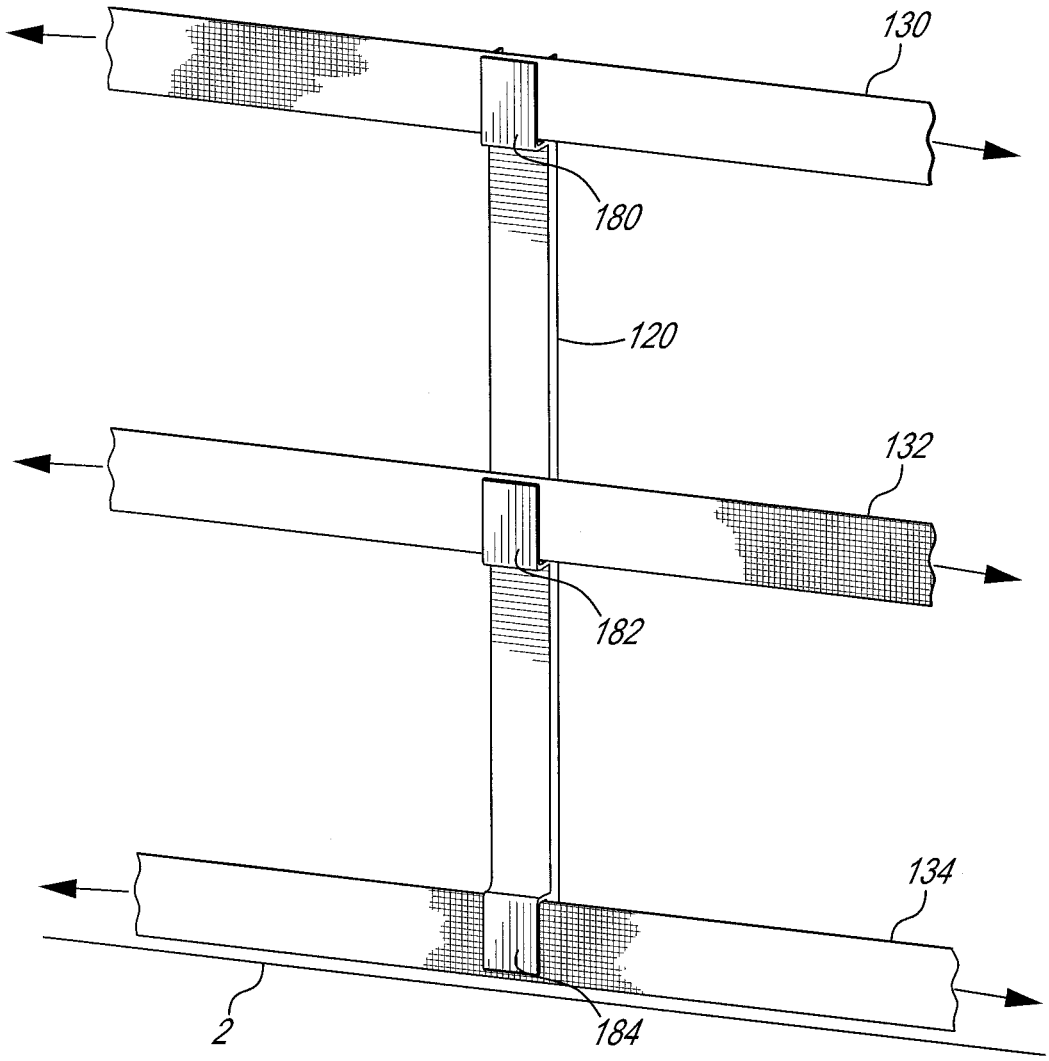
FIG. 27 is a schematic illustration of the example elevation support element of FIG. 23 attached in vertically upstanding fashion to tensioned strap members which are attached to anchor elements (not shown)
Figure 28:
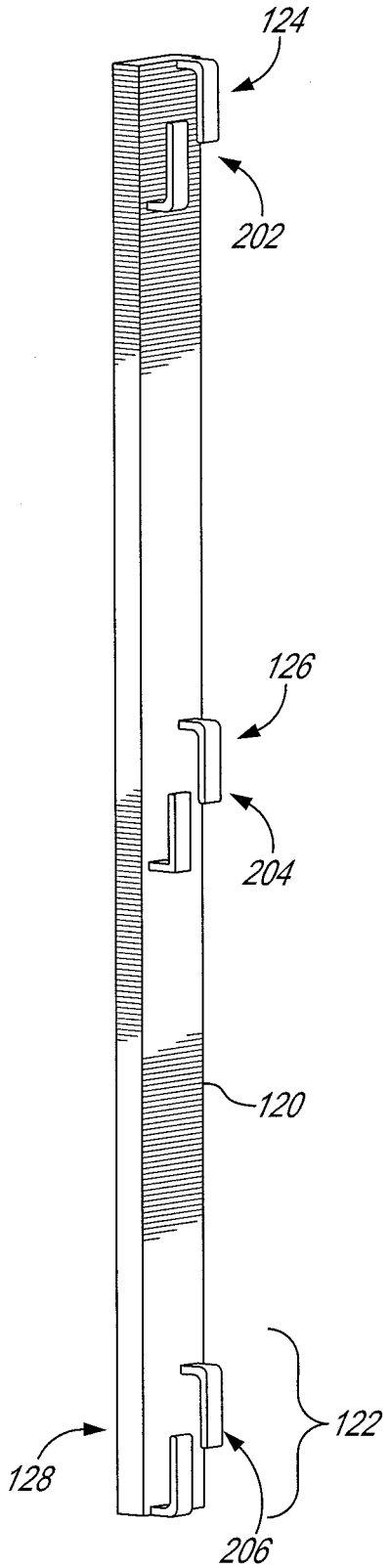
FIG. 28 is a side perspective view of further example elevation support element exploiting loop elements split by convoluted strap openings.
Figure 29:
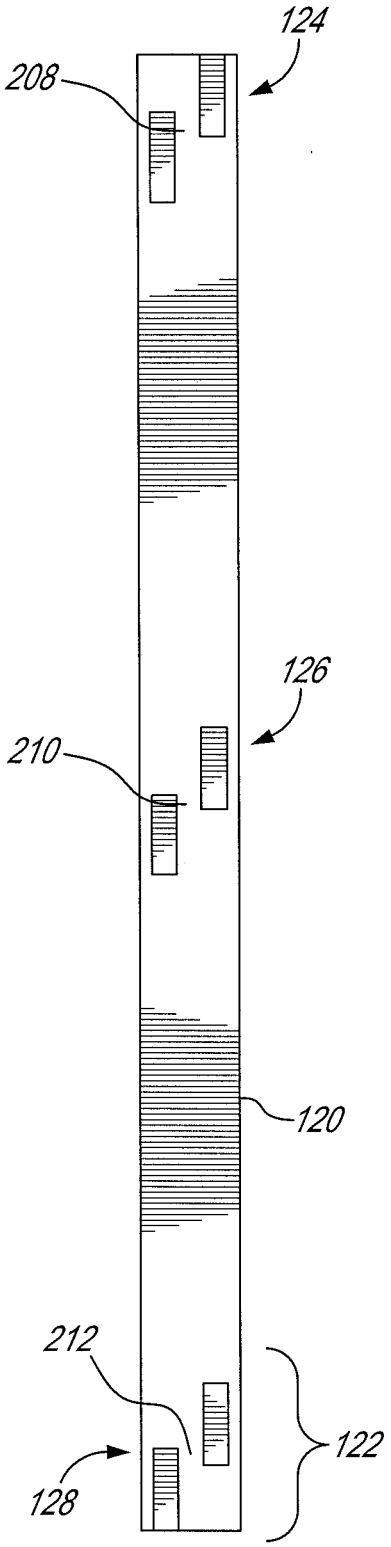
FIG. 29 is a front view of the example elevation support element of FIG. 28.

Referring to FIGS. 24 and 25 as may be seen each of the exemplified grip means for the releasable strap engagement members 124, 126 and 128 comprises a respective loop element 180, 182 or 184 in the form a U-shaped member. The loop elements 180, 182 and 184 each have a respective aperture 186, 188 or 190 for (longitudinally) receiving a respective rail strap member 130, 132 or 134. Each (U-shaped) loop element is also split by a respective straight lateral strap opening 192, 194 or 196 (i.e. open mouth) for lateral displacement of a (e.g. un-tensioned) strap member into and out of the aperture 186, 188 or 190 defined by the loop element. Referring to FIGS. 26 and 27 the (tensioned) rail strap members 130, 132 or 134 are shown longitudinally disposed and longitudinally seated in a respective aperture of a respective loop element.

Referring back to FIG. 25, this figure is illustrative of the steps to longitudinally seat the rail strap members 130, 132 and 134 in respective apertures 186, 188 and 190. For example the un-tensioned toe-rail strap member 134 may be seated first, followed by seating of the un-tensioned op-rail strap member 130 and the un-tensioned mid-rail strap member 132, In particular, for seating of the toe-rail strap member 134, the height support member 120 is vertically disposed as shown in FIG. 25 so that the open mouth 196 of the respective (U-shaped) loop element is disposed so as to face downwardly. The (un-tensioned) toe-rail strap member 134 is then manipulated thru the respective open mouth 196 so as to be disposed in the respective aperture 190 and thereafter the open mouth 196 is disposed adjacent the underlying support structure, i.e. the open mouth 196 is thus (essentially) closed or blocked off by the floor 2.

On the other hand, with the height support member 120 being vertically disposed as shown in FIG. 25, the respective open mouths 192 and 194 of the (U-shaped) loop elements are disposed so as to face upwardly for receiving respectively the (un-tensioned) top-rail strap member 130 and the (un-tensioned) mid-rail strap member 132. At this point, the respective (un-tensioned) strap members 130 and 132 are manipulated thru the respective open mouths 192 and 195 so as to be disposed in the respective apertures 186 and 188.

Once each strap member 130, 132 and 134 is seated in a respective aperture 186, 188 and 190 the strap members are each tensioned in place (see FIG. 26). For removal of the elevation support element the reverse process is followed.

As may be appreciated once the rail strap members 130, 132 and 134 are tensioned in a respective aperture 186, 188 or 190, each respective grip means may rely on the (horizontal) tension of the strap members to maintain the strap members in the respective aperture of the respective loop element. However, if desired, the elevated support element may (as shown in FIG. 26) be associated with a padlock type mechanism for closing off the mouth 192 of the uppermost (U-shaped) loop element during use, i.e. in a manner analogous to that as discussed above with respect to FIGS. 14 and 20). FIG. 27 illustrates the elevation support element in place with no padlock mechanism.

As an alternative approach, a grip means may generally comprise a loop element which is split by a convoluted lateral strap opening (i.e. convoluted passageway) which provides for lateral access to the aperture of the loop element. For this type of example grip means, the loop element and associated convoluted strap opening are configured such that lateral displacement of a tensioned rail strap member out of the aperture thru the convoluted lateral strap opening is further inhibited by the disposition and configuration of the convoluted strap opening. The loop element and the convoluted strap opening are, however, configured for sideways (manual) threading of an un-tensioned rail strap member through the convoluted strap opening into and out of aperture of the loop element. Example embodiments of this type of grip means are shown in FIGS. 28 to 31.

Figure 30:
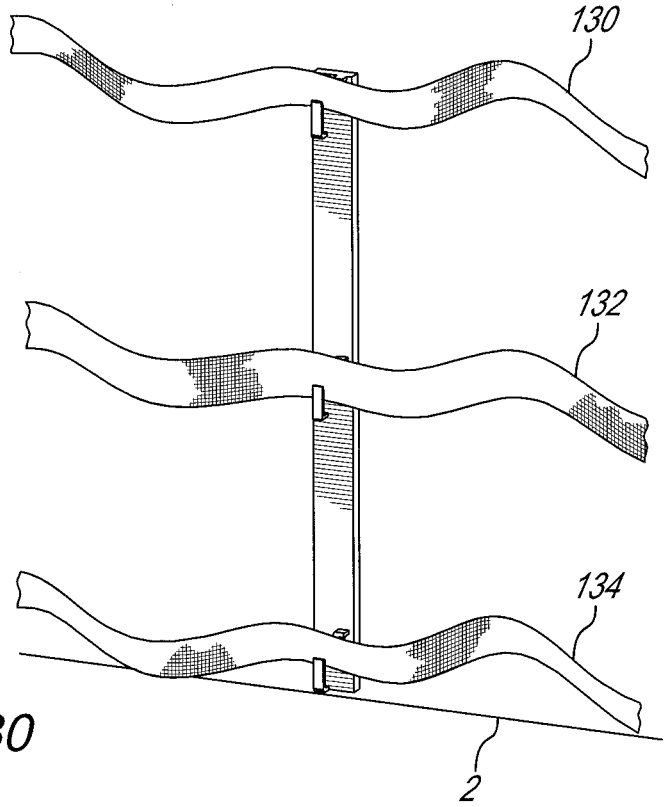
FIG. 30 is a schematic illustration of the example elevation support element of FIG. 28 being attached to un-tensioned strap members which are attached to anchor elements (not shown)
Figure 31:
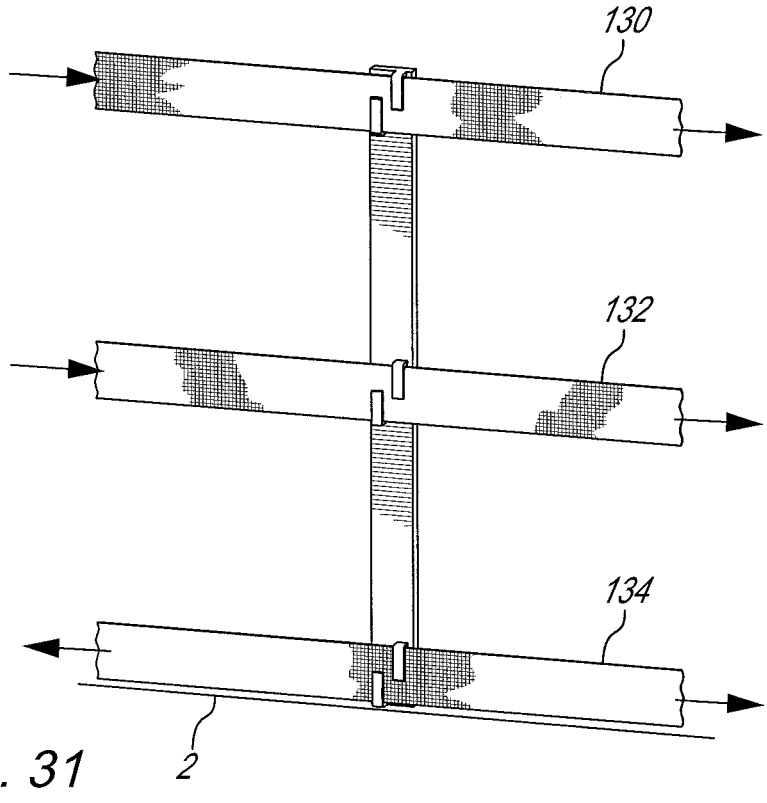
FIG. 31 is a schematic illustration of the example elevation support element of FIG. 28 attached in vertically upstanding fashion to tensioned strap members which are attached to anchor elements (not shown)

Turning to FIGS. 28 to 31, these figures show an elevation support element exploiting the above mentioned type of constricted strap opening structure in relation to the top, mid and toe releasable strap engagement members 124, 126 and 128. Thus for the illustrated example elevation support element, the loop elements 202, 204 and 206 are each defined by respective pairs of spaced apart (i.e. offset) mirrored L-shaped brackets. A space separating each of the L-shaped brackets (of such pairs of brackets) defines a respective convoluted strap opening 208, 210 and 212 (see FIG. 29). The convoluted strap openings 208, 210 and 212 are each configured for sideways threading of a respective (un-tensioned) rail strap member through such convoluted strap opening into and out of the aperture of the respective loop elements 202, 204 and 206. In other words, for this type of grip means, a strap member in un-tensioned state is deformed relative to the tensioned state thereof and in the deformed state may be passed into or out of the aperture defined by the loop element. The convoluted opening strap openings 208, 210 and 212 are however, configured such that when a strap member is in a tensioned state, the convoluted nature of the convoluted strap opening contributes to the inhibition of lateral or sideways displacement of a rail strap member out of the aperture of a respective loop element. FIG. 30 shows un-tensioned rail strap members 130, 132 and 134 being threaded sideways (i.e. laterally) through the convoluted opening into the aperture of the loop elements. FIG. 31 shows the rail strap members 130, 132 and 134 in a tensioned state longitudinally seated in the aperture defined by respective L-shaped brackets. For removal of the elevation support element the reverse process is followed.

In accordance with the present invention, an aperture defined by a loop element of a grip means may, for example, take a more slot like form. The loop element may be split by a strap opening for providing access to and from the slot like aperture which may also be slot like. Such slot like strap opening may be straight or it may be convoluted as desired or necessary. The height support member for these types of elevation support elements may have a T-like cross-section.

FIGS. 32 to 36 illustrate an alternate structure for an elevation support element which exploits a straight slot like lateral strap opening technique in relation to the top and mid releasable strap engagement members 124 and 126. As may be seen the loop element for each of the releasable strap engagement members 124, 126 and 128 defines a respective elongated slot aperture 220, 222 or 224. The top and mid elongated slot apertures 220 and 222 are each split by a respective straight inclined slot opening 226 or 228 for communication with the (interior of a) respective elongated slot aperture. On the other hand, in the case of the toe releasable strap engagement member 242, the grip means comprises a (U-shaped) loop element defining the elongated slot aperture 224 but wherein the mouth 229 thereof is disposed so as to face downwardly such that the mouth 229 is adjacent the underlying support structure, i.e. when the toe-rail strap member 134, is under (horizontal) tension, the underlying support structure essentially blocks or closes off the mouth 229 (see FIG. 35).

If desired or necessary a padlock mechanism 230 (having a structure as described above) may be exploited; see FIG. 32.

The height support member 120 of FIGS. 32 to 35 may be provided with web openings 232 and 234 for receiving the web of a pillar attachment mechanism such as shall be described below.

Figure 33:
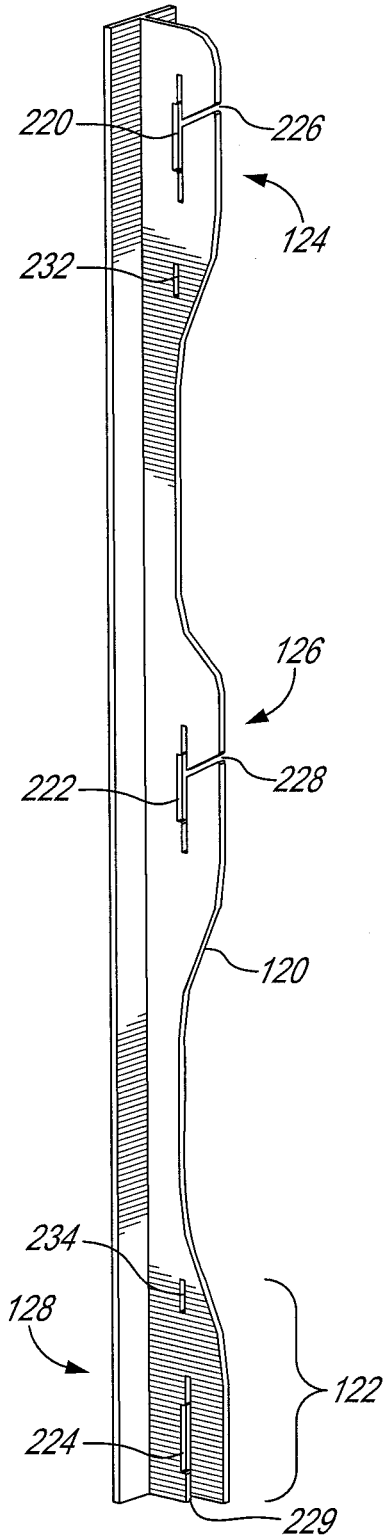
FIG. 33 is a side perspective view of a modified version of the example elevation support element of FIG. 32 (i.e. without a padlock)
Figure 34:
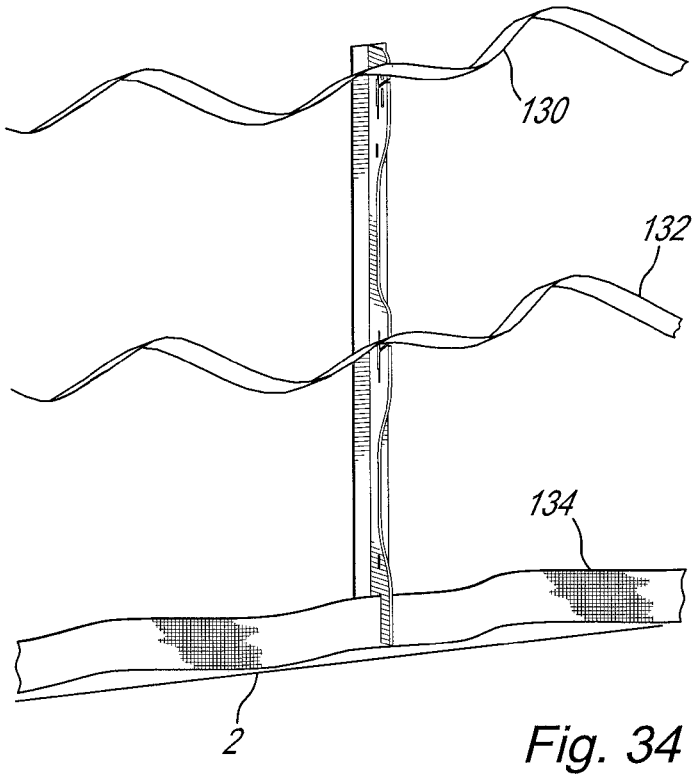
FIG. 34 is a schematic illustration of the example elevation support element of FIG. 33 being attached to un-tensioned strap members which are attached to anchor elements (not shown)
Figure 35:
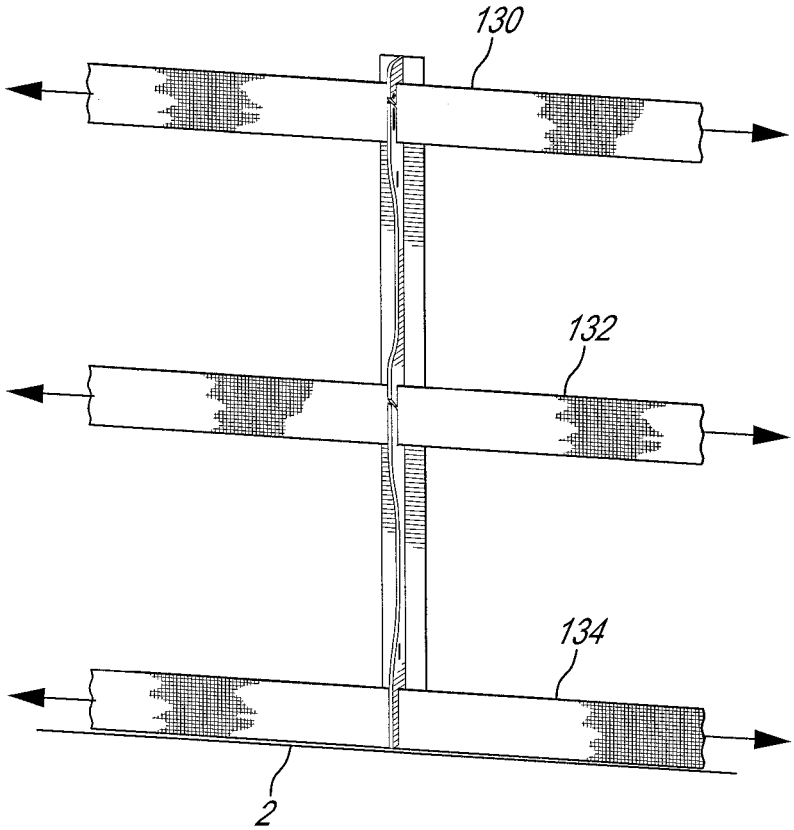
FIG. 35 is a schematic illustration of the example elevation support element of FIG. 33 attached in vertically upstanding fashion to tensioned strap members which are attached to anchor elements (not shown)
Figure 36:
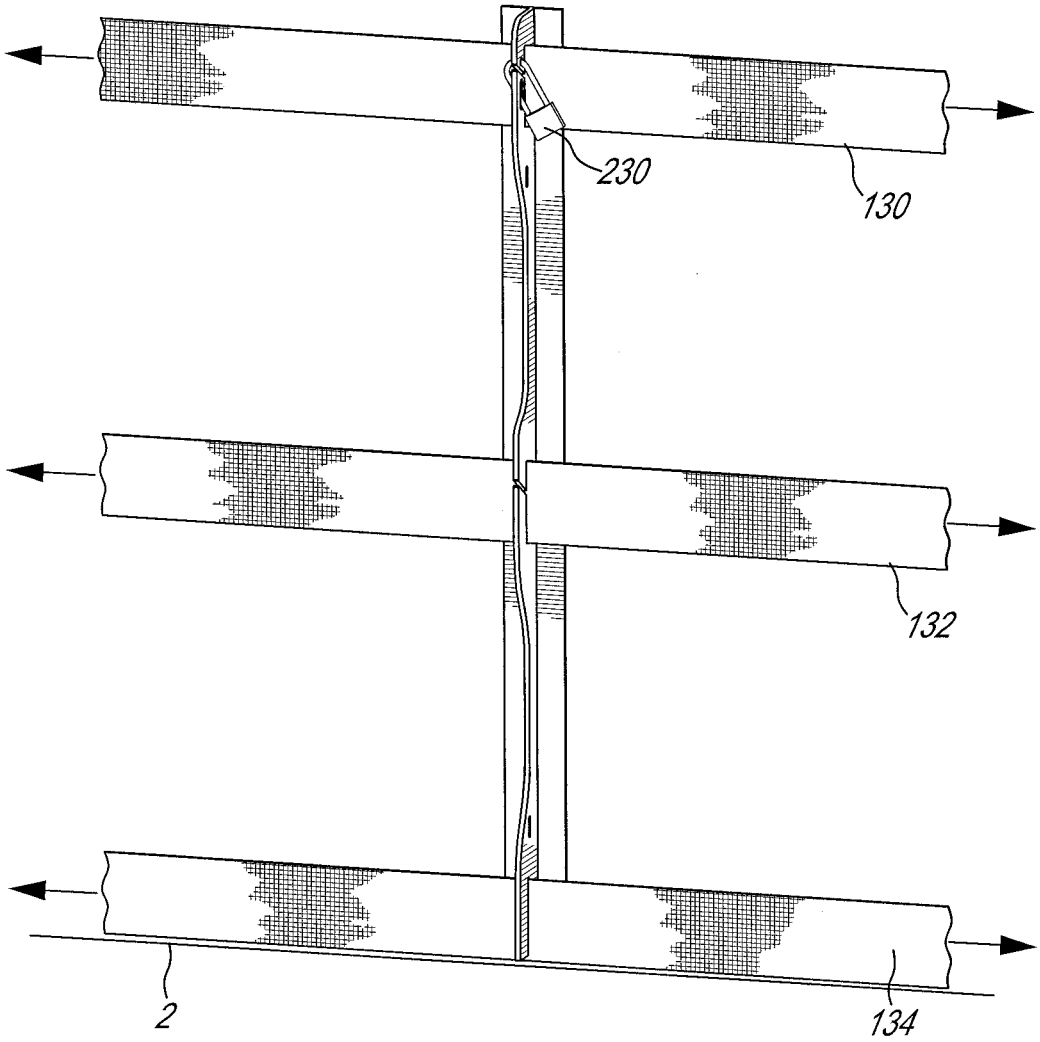
FIG. 36 is a schematic illustration of the example elevation support element of FIG. 32 attached in vertically upstanding fashion to tensioned strap members which are attached to anchor elements (not shown)
Figure 37:
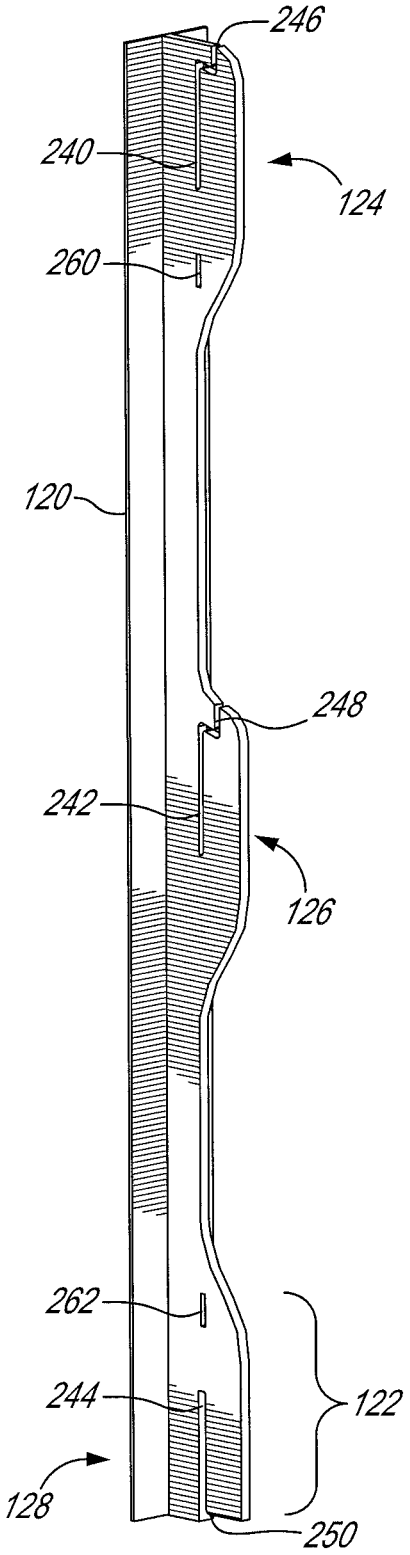
FIG. 37 is a side perspective view of a further embodiment of an example elevation support element exploiting contoured slot strap openings.

Turning to FIG. 34, this figure illustrates the engagement of an elevation support element of FIG. 33 (or 32) with an un-tensioned top-rail strap member 130, an un-tensioned mid-rail strap member 132 and an un-tensioned toe-rail strap member 134. In particular FIG. 34 shows in general the sideways threading process for engagement of the elevation support element of FIG. 33 into engagement with the three un-tensioned rail strap members 130, 132 and 134. For such engagement it is of course understood that the un-tensioned strap members 130, 132 and 134 are manipulated (i.e. inserted) into respective elongated slot apertures 220, 222 or 224 either via an inclined slot opening 226 or 228 or via the mouth 229. Once the rail strap members are manipulated into respective elongated slot apertures and the elevation support element is vertically disposed the rail strap members 130, 132 and 134 are tensioned as seen in FIG. 35. As shown in FIG. 36, an above mentioned padlock mechanism 230 may as desired also be exploited. For removal of the elevation support element the reverse process is followed.

FIGS. 37 to 40 illustrate an alternate structure for an elevation support element which exploits a convoluted slot like lateral strap opening technique in relation to top and mid releasable strap engagement members.

Apart from the convoluted slot openings, the elevation support element of FIGS. 37 to 40 has a structure analogous to the structure as shown in above FIGS. 32 to 36. Thus as may be seen the loop element for each of the releasable strap engagement members 124, 126 and 128 defines a respective elongated slot aperture 240, 242 or 244. The top and mid elongated slot apertures 240 and 242 are each split by a respective contorted slot opening 246 or 248 for communication with the (interior of a) respective elongated slot aperture. On the other hand, in the case of the toe releasable strap engagement member 128, the grip means comprises a (U-shaped) loop element defining the elongated slot aperture 244 but wherein the mouth 250 thereof is disposed so as to face downwardly such that the mouth 250 is adjacent the underlying support structure, i.e. when the toe-rail strap member 134, is under (horizontal) tension, the underlying support structure (i.e. floor 2) essentially closes or blocks off the mouth 250 (see FIG. 35).

The height support member may be provided with web openings 260 and 262 for receiving the web of a pillar attachment mechanism such as shall be described below.

Figure 38:
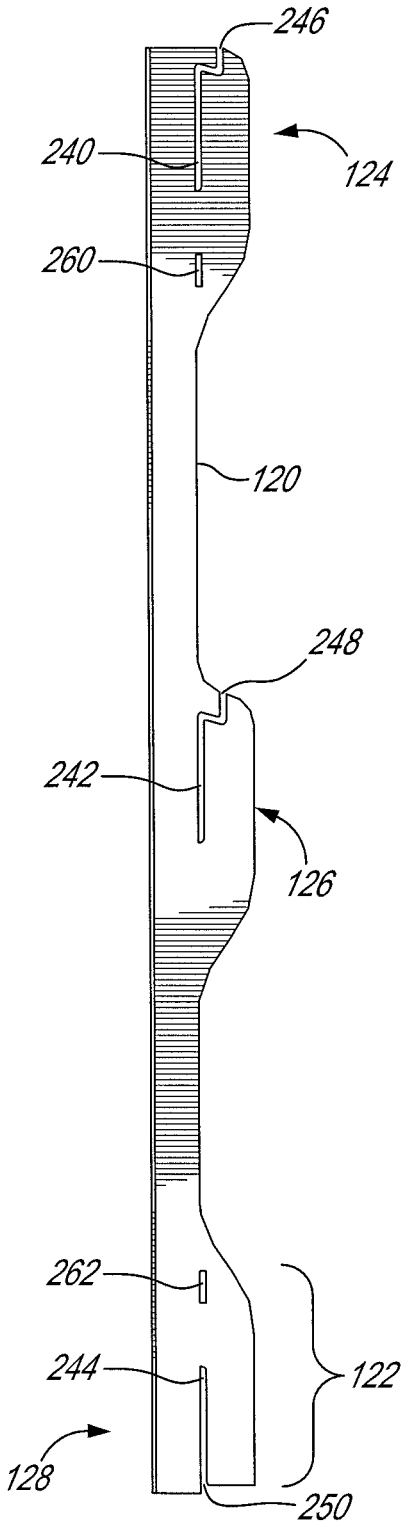
FIG. 38 is a side view of the example elevation support element of FIG. 37.
Figure 39:
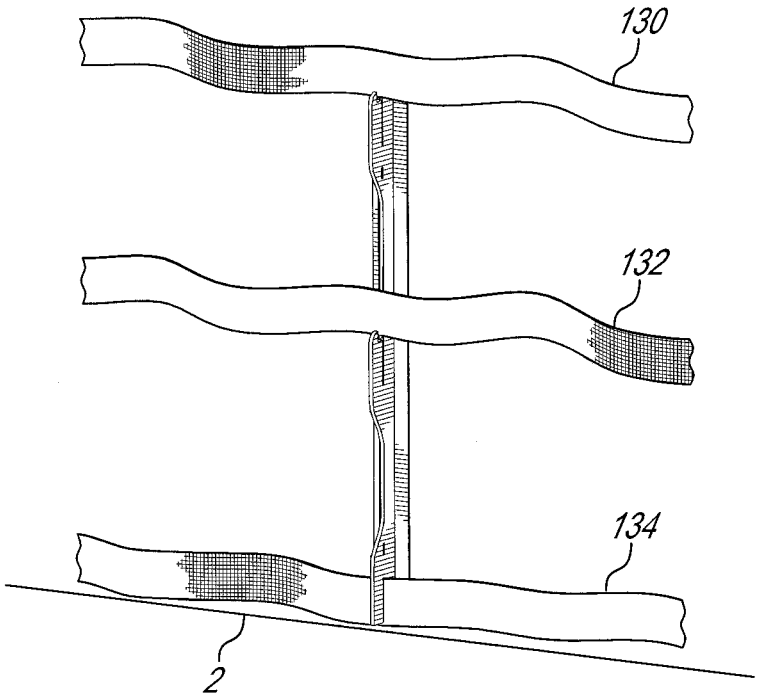
FIG. 39 is a schematic illustration of the example elevation support element of FIG. 37 being attached to un-tensioned strap members which are attached to anchor elements (not shown)
Figure 40:
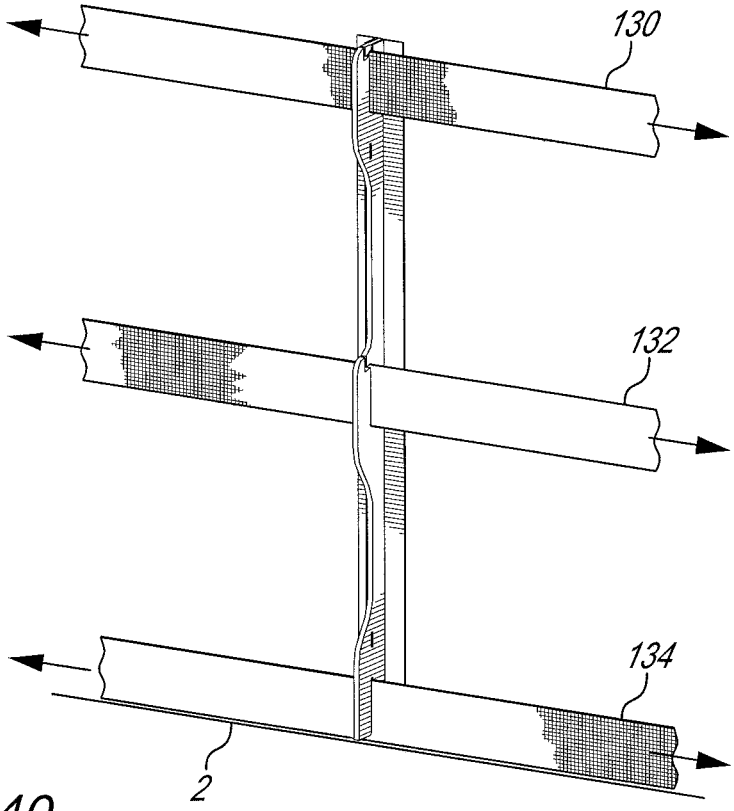
FIG. 40 is a schematic illustration of the example elevation support element of FIG. 37 attached in vertically upstanding fashion to tensioned strap members which are attached to anchor elements (not shown)

Turning to FIG. 39, this figure illustrates the engagement of an elevation support element illustrated in FIGS. 38 and 39 with an un-tensioned top-rail strap member 130, an un-tensioned mid-rail strap member 132 and an un-tensioned toe-rail strap member 134. In particular FIG. 39 shows in general the sideways threading process for engagement of the elevation support element of FIGS. 38 and 39 into engagement with the three un-tensioned rail strap members 130, 132 and 134. For such engagement it is of course understood that the un-tensioned strap members 130, 132 and 134 are manipulated (i.e. inserted) into respective elongated slot apertures 240, 242 or 244 either via a convoluted slot opening 246 or 248 or via the mouth 250. Once the rail strap members are manipulated into respective elongated slot apertures and the elevation support element is vertically disposed the rail strap members 130, 132 and 134 are tensioned as seen in FIG. 40. For removal of the elevation support element the reverse process is followed.

In accordance with the present invention a further alternative mechanism for a releasable strap engagement member may comprise grip means which has a loop element which defines a rail aperture for receiving a strap member and wherein the rail aperture may be accessed by a closeable lateral strap opening. Thus for this type of grip means, a loop element may be provide which may be (actively) split by a strap opening structure dimensioned/configured for passage of a rail strap member through the (closable) strap opening into and out of said aperture. In accordance with such further alternative structure, the grip means may comprise a closure means displaceable between an open position and a closed position. The loop element and the closure means may thus be configured for inhibiting displacement of the strap member out of the aid aperture thru the strap opening when the closure means is in said closed position, and be configured such that when said closure means is in said open position, the strap opening may be unobstructed by the closure means with respect to passage of the strap member thru the strap opening. In accordance with such further alternative structure, the grip means may be a slider type grip means. Such slider type grip means may comprise such closure means which is displaceable between an open position and a closed position.

Figure 41:
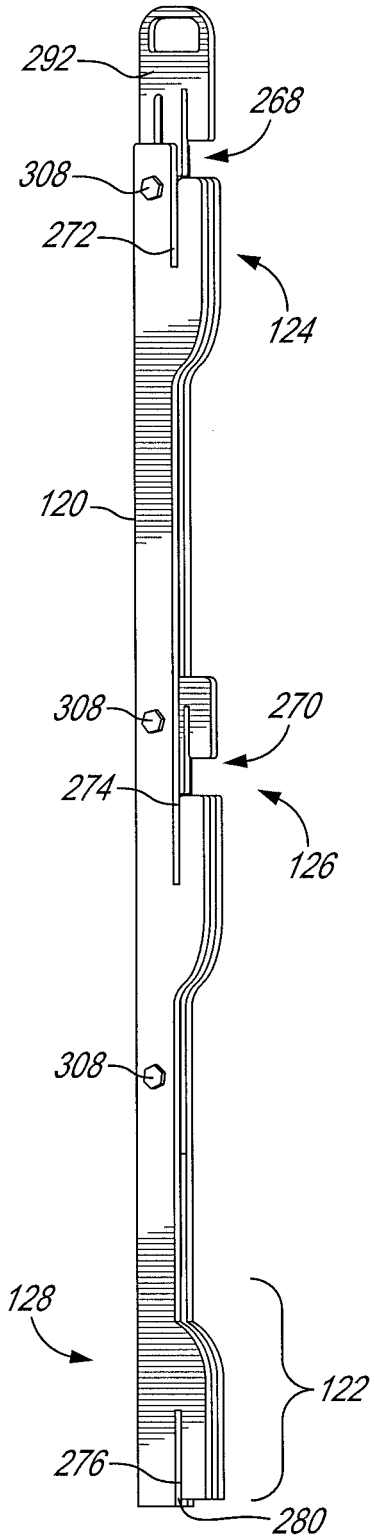
FIG. 41 is a side perspective view of a slider type example elevation support element in open configuration.
Figure 42:
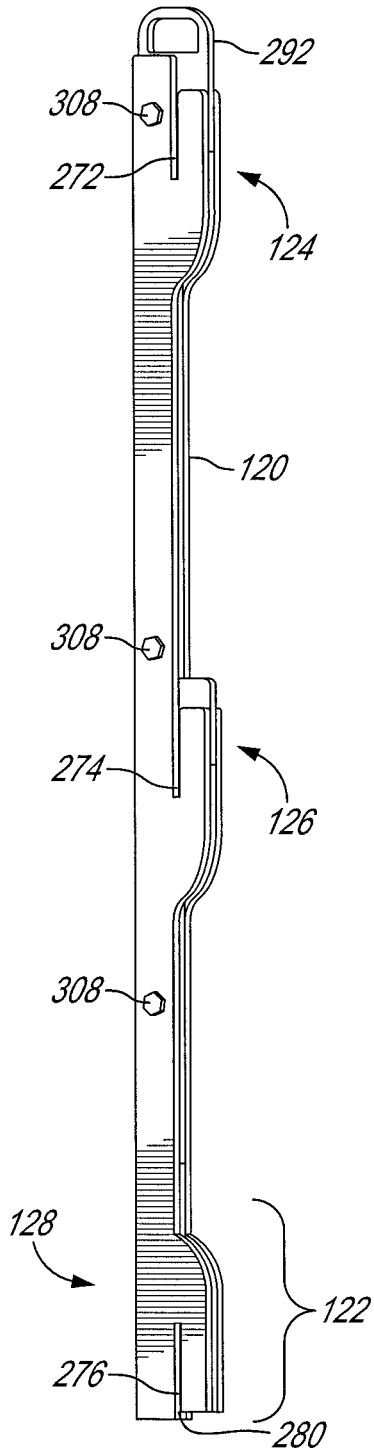
FIG. 42 is a side perspective view of the slider type example elevation support element of FIG. 41 in closed configuration.

FIGS. 41 to 49 illustrate the slider type structure for an elevation support element which exploits grip means having a closure means displaceable between an open position and a closed position in relation to the top and mid releasable strap engagement members 124 and 126. FIGS. 41 and 42 show respectively the open and closed configuration of this alternative embodiment. As may be seen from FIG. 41, which shows an open configuration, the upper loop elements for the top and mid strap engagement members 124 and 126, are split by a respective strap opening 268 or 270. The strap openings 268 and 270 provide for rail strap member communication with the thus opened elongated slot aperture 272 or 274 as the case may be. However, referring to FIG. 42, which shows a closed configuration, the loop elements for the top and mid releasable strap engagement members 124 and 126 are in a closed elongated slot aperture configuration. On the other hand, in the case of the toe releasable strap engagement member 128 the grip means comprises a (U-shaped) loop element also defining an elongated aperture 276 but wherein the mouth 280 is disposed so as to face downwardly such that the mouth 280 is adjacent the underlying support structure, i.e. when a toe rail strap member, is under (horizontal) tension, the underlying support structure (i.e. floor 2) essentially blocks or closes off the mouth 280.

Figure 45:
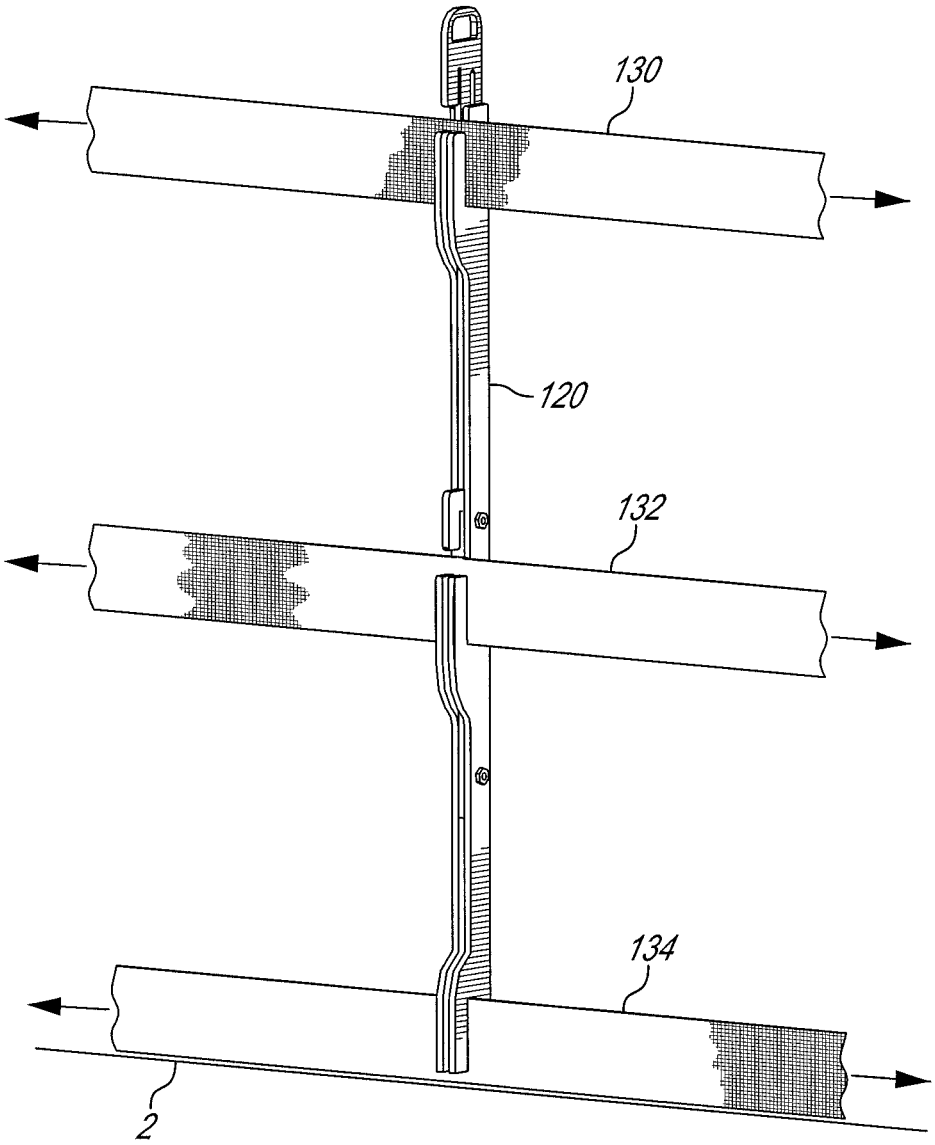
FIG. 45 is a schematic illustration of the unclosed example elevation support element of FIG. 41 attached in vertically upstanding fashion to tensioned strap members which are attached to anchor elements (not shown)
Figure 46:
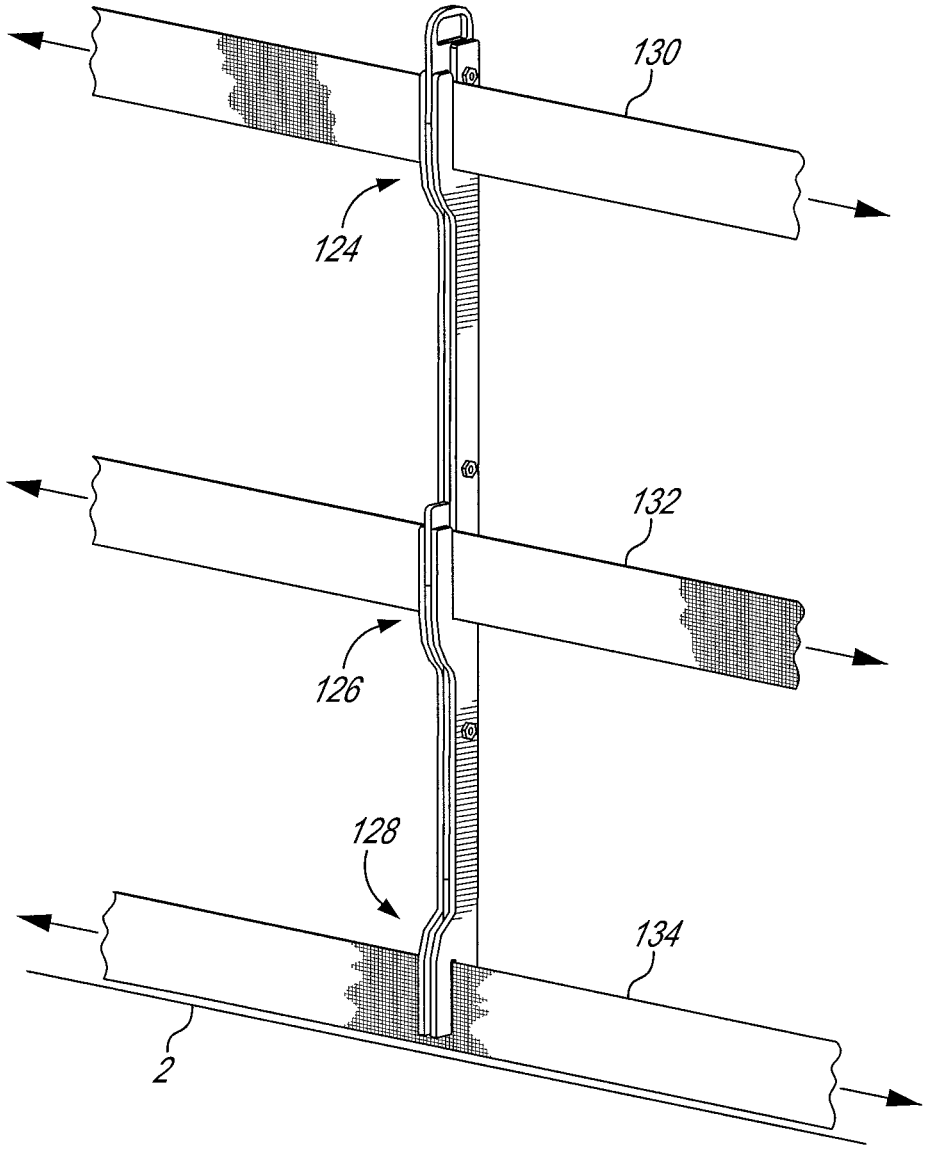
FIG. 46 is a schematic illustration of the closed example elevation support element of FIG. 42 attached in vertically upstanding fashion to tensioned strap members which are attached to anchor elements (not shown)
Figure 47:
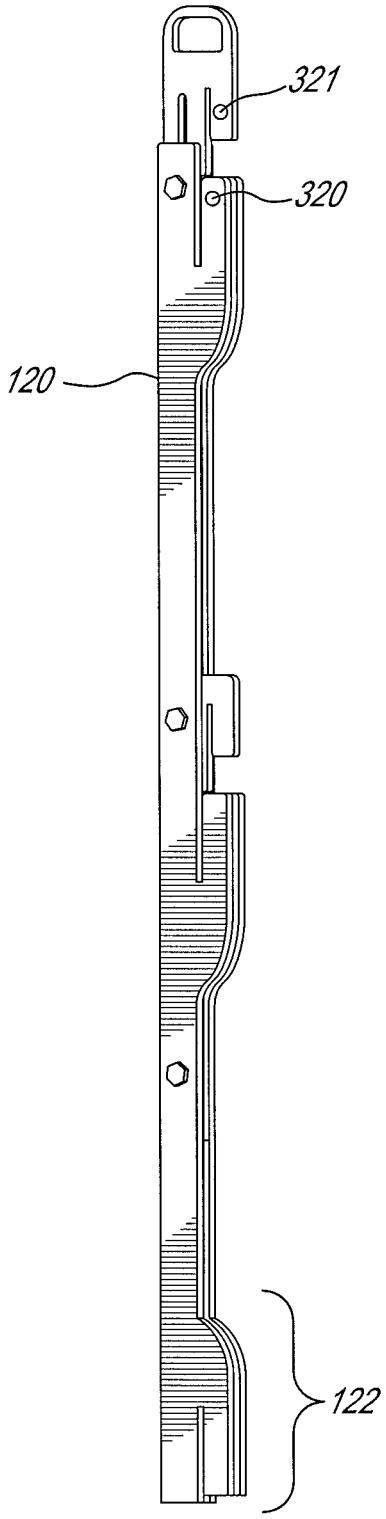
FIG. 47 is a side perspective view of another slider type example elevation support element in open configuration which has a padlock.
Figure 48:
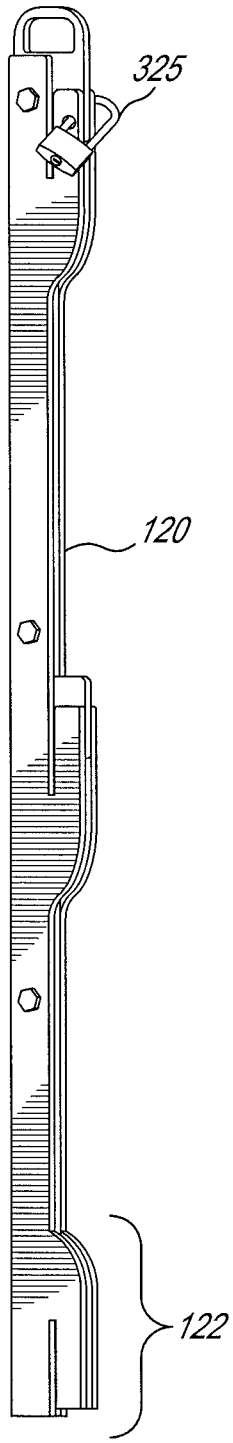
FIG. 48 is a side perspective view of the slider type example elevation support element of FIG. 47 in closed configuration.
Figure 49:
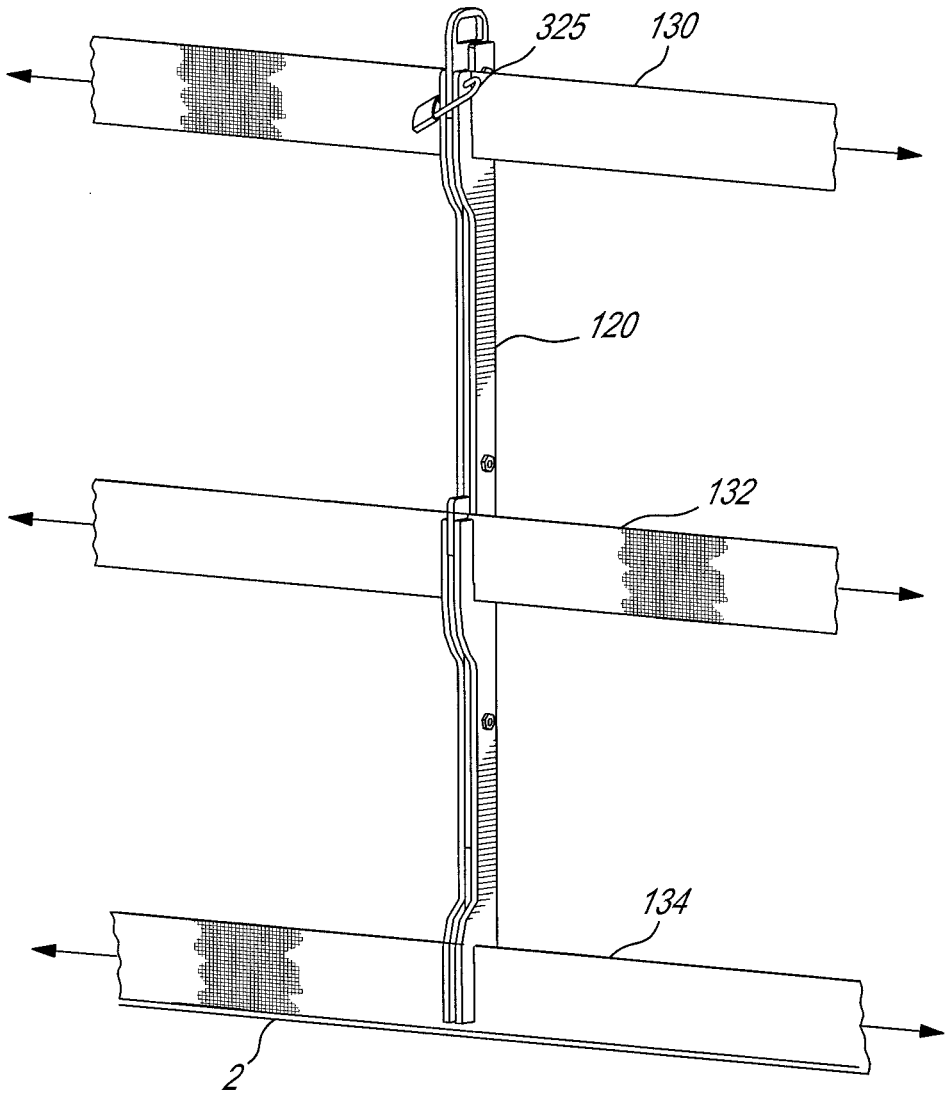
FIG. 49 is a schematic illustration of the closed example elevation support element of FIG. 48 attached in vertically upstanding fashion to tensioned strap members which are attached to anchor elements (not shown)
Figure 50:
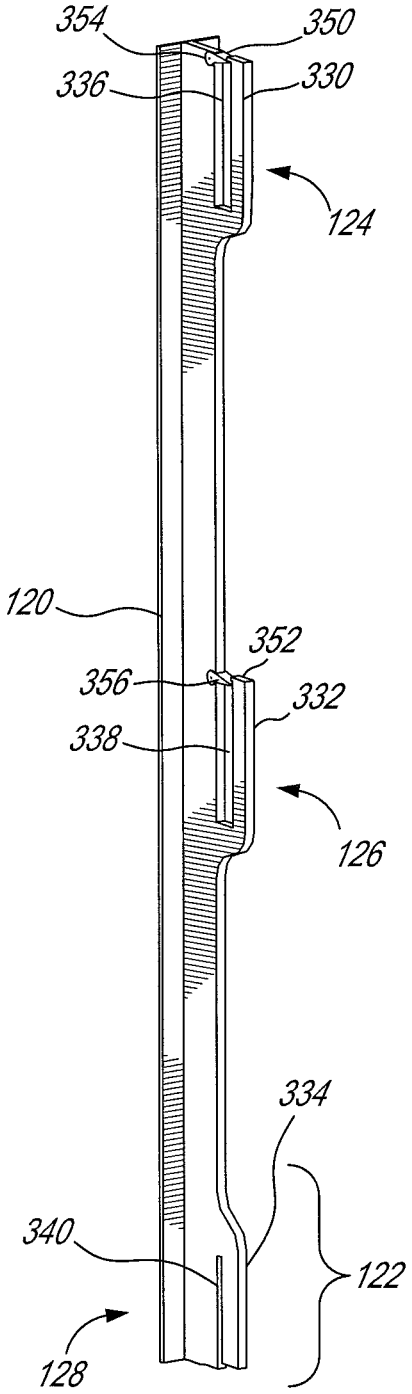
FIG. 50 is a side perspective view of another type example elevation support element with a carabiner type gate.
Figure 51:
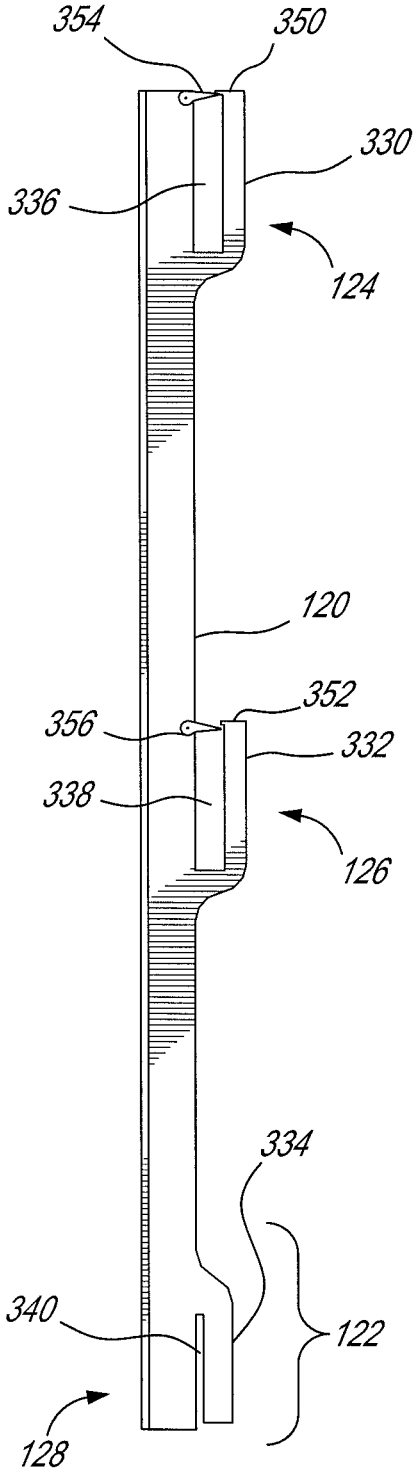
FIG. 51 is a side perspective view of the example elevation support element of FIG. 50.

If desired or necessary an above mentioned padlock mechanism (e.g. see FIG. 22) may be exploited; see FIGS. 47 to 49 which apart from the padlock mechanism illustrate the same elevation support element as shown in FIGS. 41 to 46 The elevation support element of FIGS. 47 and 48 have openings for receiving a padlock shackle.

Figure 43:
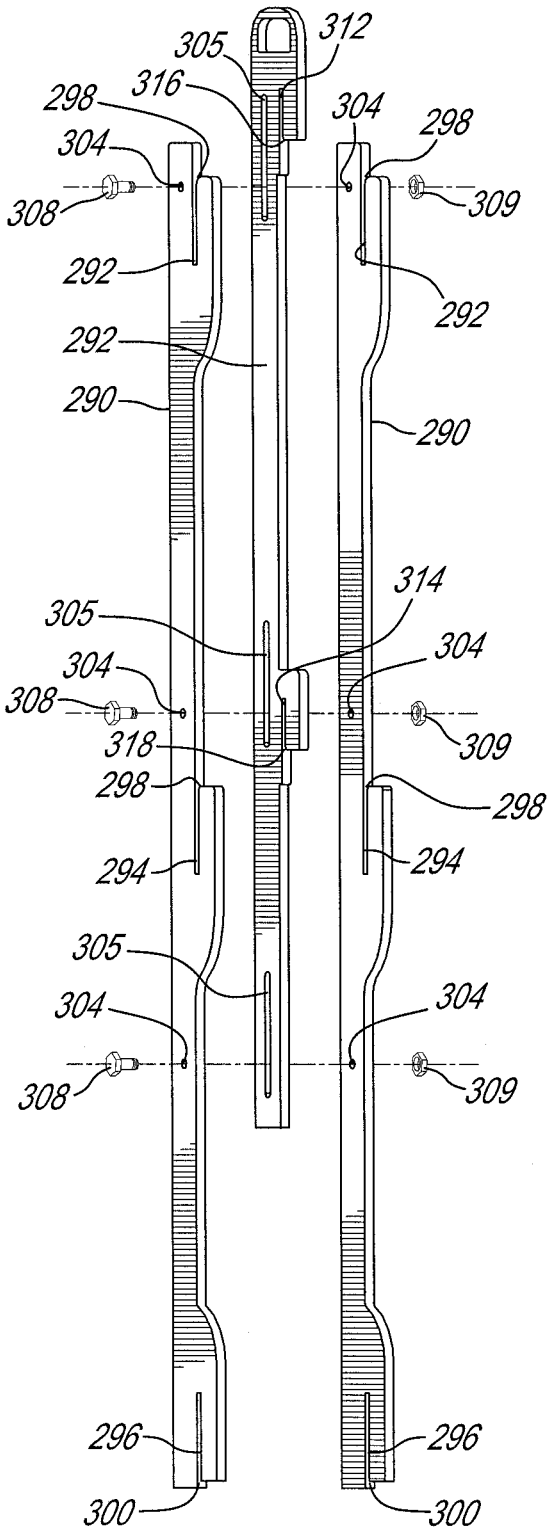
FIG. 43 is an exploded view of the example elevation support element of FIG. 41.

Turning to FIG. 43, this figure shows, in exploded view, the general structure of the exemplified elevation support element of FIGS. 41 and 42. As may be seen the elevation support element is composed of three main members, namely two outer post members 290 and an inner slider member 292.

The two outer post members 290 each have the same structure which is similar to that of the elevation support element which is shown in side view if FIG. 24. Thus, as may be seen from FIG. 43, each outer member 290, defines, for each of the top, mid and toe releasable strap engagement members 124, 126 and 128, an outer loop component which comprises a U-shaped member. The U-shaped members define respective elongated slots 292, 294 and 296.

The U-shaped members 290 of the outer post members for the top-rail strap member 130 and the mid-rail strap member 132 each have an open mouth 298 which is disposed so as to face upwardly. On the other hand, in the case of the toe-rail strap member 134, the mouth 300 of the lowest U-shaped member of each of the outer post members 290 is disposed so as to face downwardly. In other words, the mouth 300 of the lowest U-shaped member is to be disposed adjacent the underlying support structure, i.e. when a strap member, is under (horizontal) tension, the underlying support structure (i.e. floor 2) essentially close or blocks off the mouth 300 of this lowest U-shaped member. The lowest U-shaped member thus has a structure similar to that for the elevation support element of FIG. 24.

The inner slider member 292 is configured and attached to slide up and down between the two outer post members 290. For this purpose, each of the outer post members 290 is provided with three attachment openings 304. These openings 304 are able to be aligned with an opposed corresponding attachment opening 304 of the other post member 290. On the other hand, the inner slider member 292 is provided with three equal length longitudinally extending (linear) motion travel slots 305 which may each be aligned with a respective pair of opposed attachment openings 304 of the outer post members 290. The (threaded) stem of each bolt member 308 is able to pass through a pair of aligned attachment openings 304 as well as an intermediate respective aligned linear motion slot 305 such that the threaded end portion of the bolt stem may engage with a respective nut 309 for holding the outer post members 290 and the slider member 292 together as an assembly when the assembly is in either a closed or an open configuration (see FIGS. 41 and 42). Furthermore, the engagement between the threaded stem of at least one such bolt 308 and its respective (locking) nut 309 is such that such nut 309 may be tightened onto the bolt stem so as to induce the nut 309 and bolt 308 to clamp (i.e. lock) the outer post members 290 to the slider member 292 for maintaining the slider member 292 in a predetermined position; additionally such nut 309 may be loosened to release such clamping action so as to allow the slider member 292 to be displaced (i.e. slide) between an open position and a closed position (see FIGS. 41 and 42).

More generally, the assembled stems of bolts 308 and the motion slots 305 are so disposed such that the slider member 292 may be displaced longitudinally up and down within the limits of motion dictated by the length of at least one such motion slot 305, i.e. when a locking nut 305 is in a loosened state. In conjunction with the motion slots 305, the inner slider member 292 is sized such that the lower end thereof will not impinge upon a toe rail strap member when the assembly is in a closed configuration.

Still referring to FIG. 43 with respect to the open configuration of the assembly, the inner slider member 290 is also provided with an upper and a mid U-shaped member having respective elongated slots 312 and 314 provided with respective mouths 316 and 318 which are each disposed so as to face downwardly.

Referring back to FIGS. 41 and 42, it is thus to be appreciated that in accordance with the illustrated embodiment the outer post members 290 and the inner slider member 292 are configured and interconnected such that the inner slider member 292 is linearly displaceable relative to the outer post members 290 between a strap lock-in position (i.e. closed configuration) and a strap release position (i.e. open configuration). FIG. 42 shows a strap lock-in position while FIG. 41 shows a strap release position.

Figure 44:
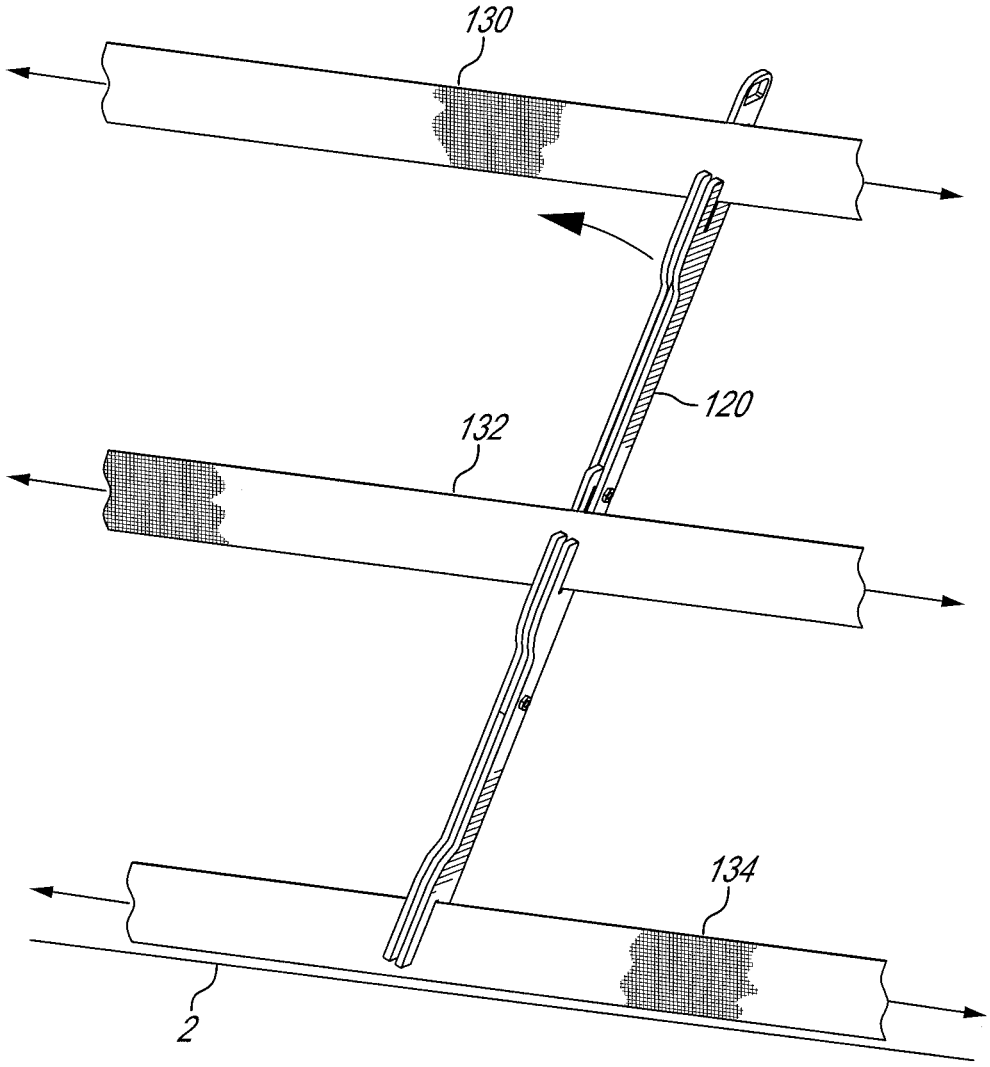
FIG. 44 is a schematic illustration of the example elevation support element of FIG. 41 being attached to tensioned strap members which are attached to anchor elements (not shown)

Referring to FIG. 41 when the slider member 292 is in the illustrated strap release position, the outer post members 290 and the inner slider member 292 define two upper opened loop elements, the opened loop elements each defining a respective strap aperture 272 and 274 which is split by a respective strap opening 268 and 272. The strap openings 268 and 272 are dimensioned/configured for passage of a rail strap member through such strap opening into and out of the respective strap aperture. FIGS. 44 and 45 show the process of engagement of the (open configuration) elevation support element to tensioned rail strap members 130, 132 and 134; the engagement process is similar to the process for the clamp structure as seen above (i.e. see FIG. 18). The toe rail strap engagement member of the embodiment shown engages the toe rail member the same as for the elevation support element of FIG. 40.

Referring to FIG. 42, when the slider member 292 is in the strap lock-in position, the outer post members 290 and the inner slider member 292 define closed loop elements, the closed loop elements defining the (closed) slot apertures 272 and 274 for engaging the respective rail strap members, the closed loop elements being configured for inhibiting sideways (radial) (i.e. lateral and vertical) displacement of a respective rail strap member out of a (closed) slot aperture 272 or 274. FIG. 46 shows the engagement of the elevation support element to tensioned strap members, the top and mid rail strap engagement members 124 and 126 being in the strap lock-in configuration therefore. The toe rail strap engagement member 128 of the embodiment shown still engages the toe rail member the same as for the elevation support element of FIG. 40.

FIGS. 47 to 49 show the same height elevation support element as illustrated in previous FIGS. 41 to 46 but which are also provided with shackle openings 320 and 321 to receive the shackle 325 of a padlock mechanism.

Referring to FIGS. 50 to 53 these figs illustrate another example elevation support element wherein the releasable strap engagement members comprises grip means which take the same general form as the grip means of the elevation support elements as illustrated in FIG. 24. Thus, the grip various means comprise loop elements 330, 332 and 334 in the form of U-shaped members. The loop elements 330, 332 and 334 each have an elongated aperture 336, 338 or 340 for (longitudinally) receiving a respective rail strap member. Each (U-shaped) loop element is also split by a respective straight lateral strap opening (i.e. open mouth) for lateral displacement of a (e.g. un-tensioned) rail strap member into and out of the elongated aperture 336, 338 or 340 defined by the loop element. The open mouth of such U-shaped member for the top-rail strap member and the mid-rail strap member is disposed so as to face upwardly when a rail strap member is disposed in the aperture thereof.

However, the illustrated grip means for the top-rail strap member and the mid-rail strap member further comprises a respective stopper member 350 or 352 and a respective spring biased lock swing arm 354 or 356. Each stopper member is mounted on one side of a respective open mouth while a respective spring biased lock swing arm is pivotally mounted to the other side of the respective open mouth.

Figure 52:
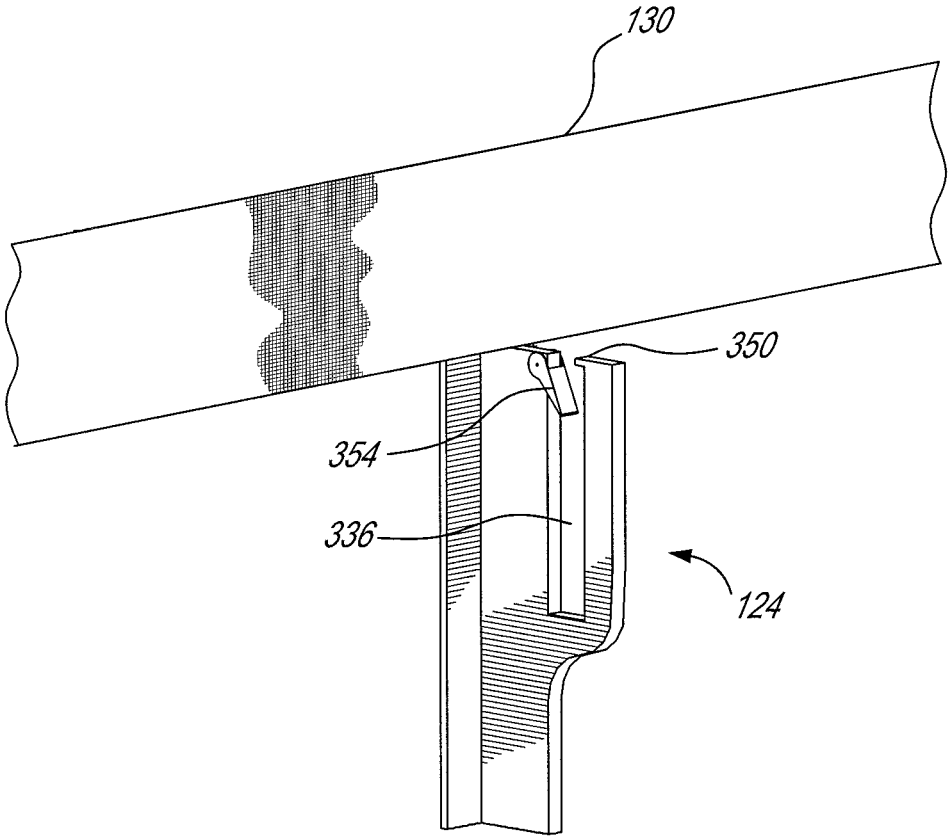
FIG. 52 is an enlarged schematic side perspective illustration of the top releasable strap engagement member in the process of engaging the (tensioned) top-rail strap member.
Figure 53:
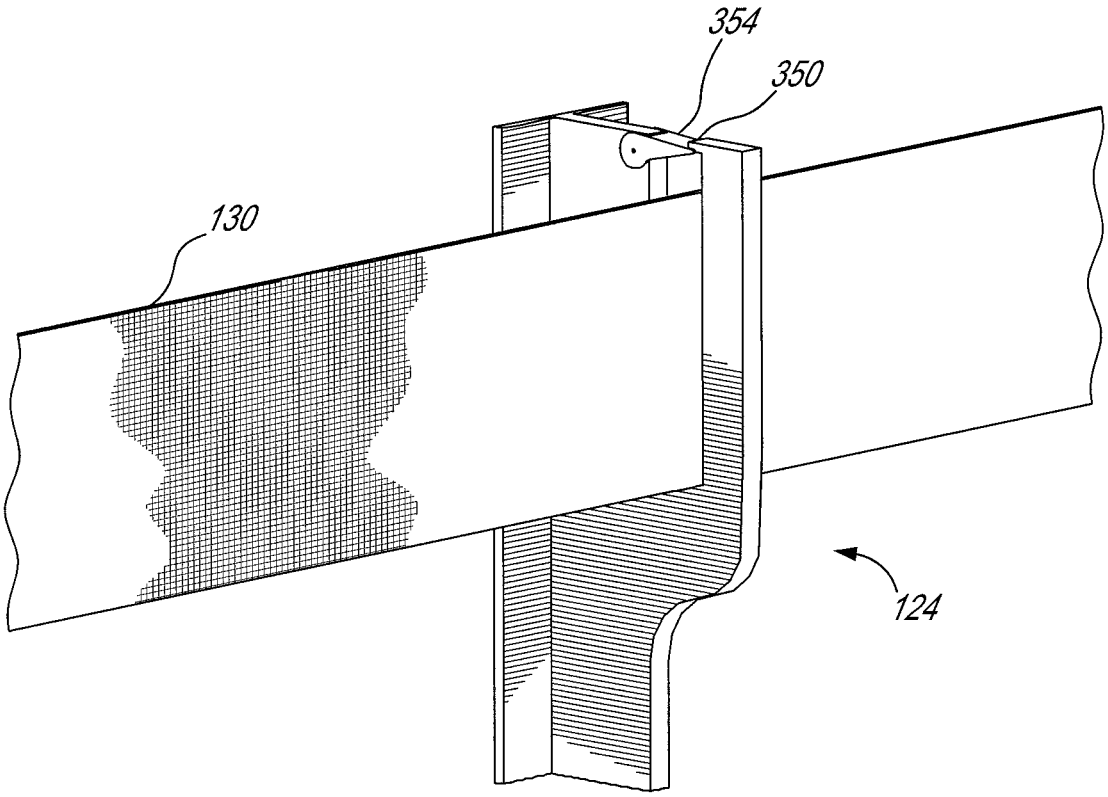
FIG. 53 is an enlarged schematic side perspective illustration of the top releasable strap engagement member vertically engaging the top-rail strap member.

Referring to FIGS. 52 and 53, the lock swing arms 354 and 356 are each able to pivot into a respective aperture 336 or 338 but are prevented from pivoting out of such apertures by the stopper member 350 or 352. For this example embodiment the lock swing arms 354 and 356 are spring biased (in any suitable way) in a respective position wherein they each respectively abut a respective stopper member 350 or 352

The lock swing arms 354 and 356 are each biased in a position wherein it closes off a respective open mouth (see FIG. 53). The lock swing arms may however be urged (see FIG. 52) to pivot to a position within a respective aperture wherein it no longer blocks off the respective open mouth. In other words, a lock swing arm is disposed for pivotal displacement between an open position within the respective aperture wherein the open mouth is unobstructed and a closed position wherein the lock swing arm abuts the stopper member and obstructs the respective open mouth. Thus a loop element, respective stopper member and respective lock swing arm are configured for inhibiting displacement of a rail strap member out of the respective aperture thru the strap opening (i.e. open mouth) when the lock swing arm is in the closed position, and are also configured such that when the lock swing arm is in the open position, the strap opening (i.e. open mouth) is unobstructed by the swing arm with respect to passage of the strap member thru the strap opening.

Referring to FIG. 52, this figure shows the basic step for seating a rail strap member in the grip means aperture, namely by the pressing downward of the lock swing arm to slip the strap member into the aperture. Once the strap member is seated in the aperture, the lock swing arm is biased back to the closed position (see FIG. 53) wherein the lock swing arm will impede lateral displacement of the strap member out of the aperture. For the removal of the strap member the lock swing arm is first biased downwardly to free up the open mouth and the strap member is thereafter removed.

As mentioned above, each of the anchor attachment members may comprise a respective strap anchor segment for defining a girdle element for disposition about a (terminal) pillar member. Each of the anchor attachment members may further comprise a strap attachment element for attaching the girdle element to a strap member.

Turning to FIGS. 54 to 73, these figures illustrate various example embodiments of anchor attachment members for attachment of illustrated example strap members to (in situ) pillar type anchor elements. FIGS. 77 to 86, illustrate additional example embodiments of anchor attachment members for attachment of illustrated example strap members to (in situ) pillar type anchor elements. The embodiments have common features which are designated by common reference numerals.

Figure 54:
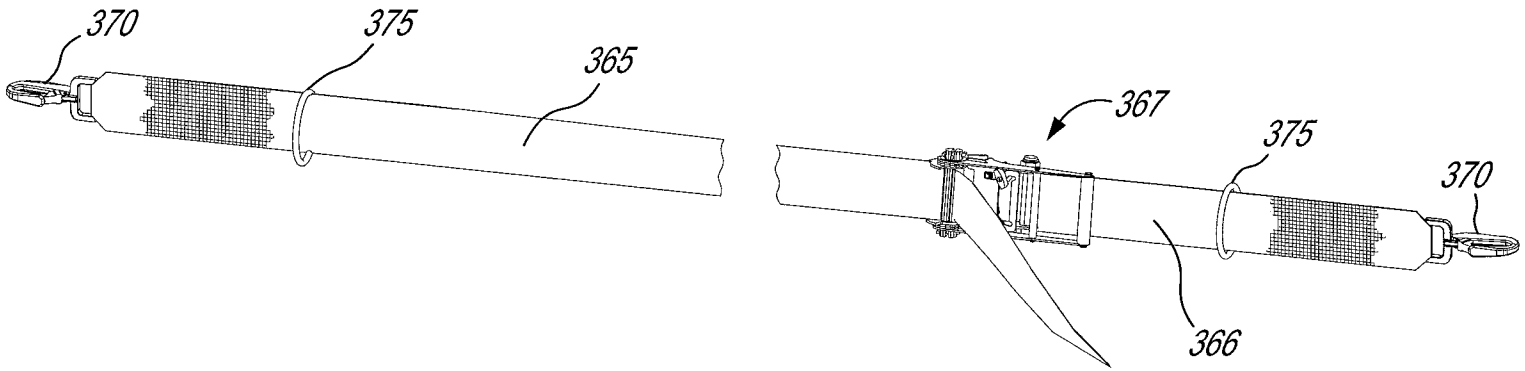
FIG. 54 illustrates in perspective side view an example strap member and associated anchor attachment components.
Figure 59:
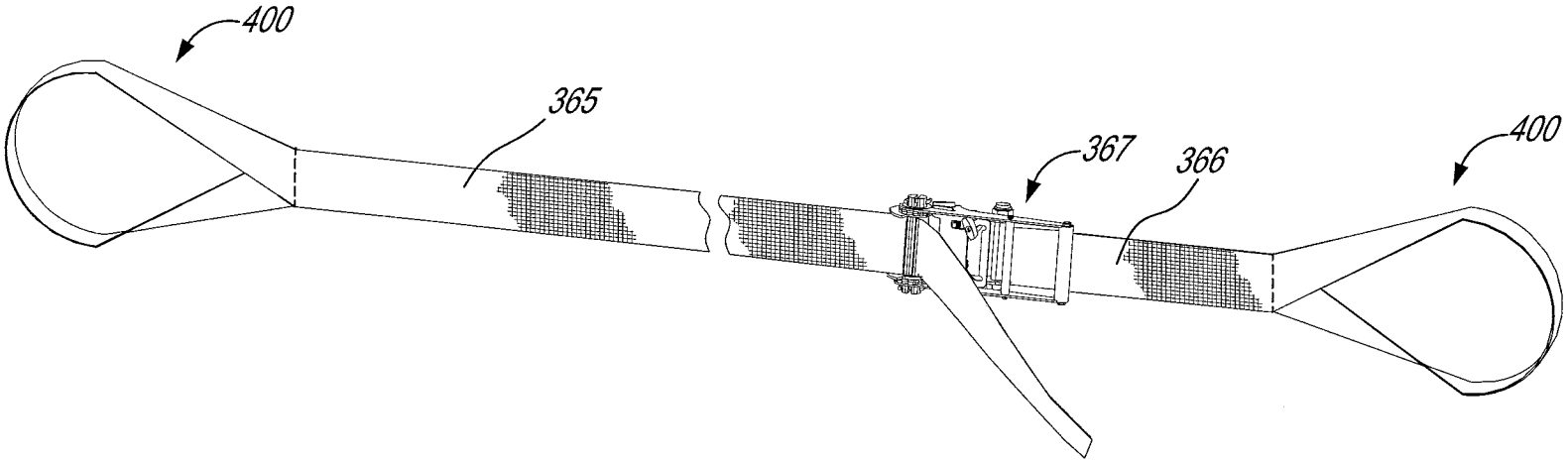
FIG. 59 illustrates in perspective side view another example strap member and associated anchor attachment components.

FIGS. 54 and 59 illustrate example strap member embodiments. The strap member embodiments shown in FIGS. 54 and 59 each have two separate band parts, namely, band parts 365 and 366. As seen, the strap members also include a tensioning or ratchet device 367 able to interconnect the band parts 365 and 366. As may be understood the band part 366 is fixed at one end to the tensioning device 367 in any (known) suitable way (e.g. a loop to pin attachment, a clamp, bolts, etc.) whereas the other band part 365 has an end which is able to be releasably fed into the ratchet mechanism of the tensioning device 367 so at to allow thereby the tensioning and un-tensioning of the strap member. The tensioning device 367, if desired or if necessary, may (for safety reasons) be associated with a pad-lock mechanism for locking the tensioning device in a tensioned state once the strap member is suitably tensioned by the tensioning device 367, e.g. see FIG. 13 for an example padlock type mechanism which may be adapted for the tensioning device 367. Thus, for example, the ratchet tensioning lever arm which is pivotally connected to the main body of the tensioning device 367 may define a locking opening which is alignable with a corresponding locking opening defined by the main body of the tensioning device; once so aligned the aligned locking openings may receive the shackle of a padlock so as to lock the tensioning device in the strap member tensioned state.

For the strap member embodiments shown in FIGS. 54 and 59, opposite ends of each of the illustrated example strap members include a strap anchor segment which is exploitable as part of the anchor attachment members which define the girdle elements for disposition about terminal (anchor) pillar members.

Referring to FIG. 54 opposite ends of the illustrated strap member are provided with a respective carabiner type connector (i.e. a hook connector having spring gate member and which has a releasable connectivity structure analogous to that of the gated structure of the elevated support element shown in FIG. 52). The carabiner type connectors are herein generally designated with the common reference numeral 370. The carabiner type connectors 370 may be releasably connected (in known fashion) to ring connector elements 375 which are also provided to act as strap attachment elements.

Figure 55:
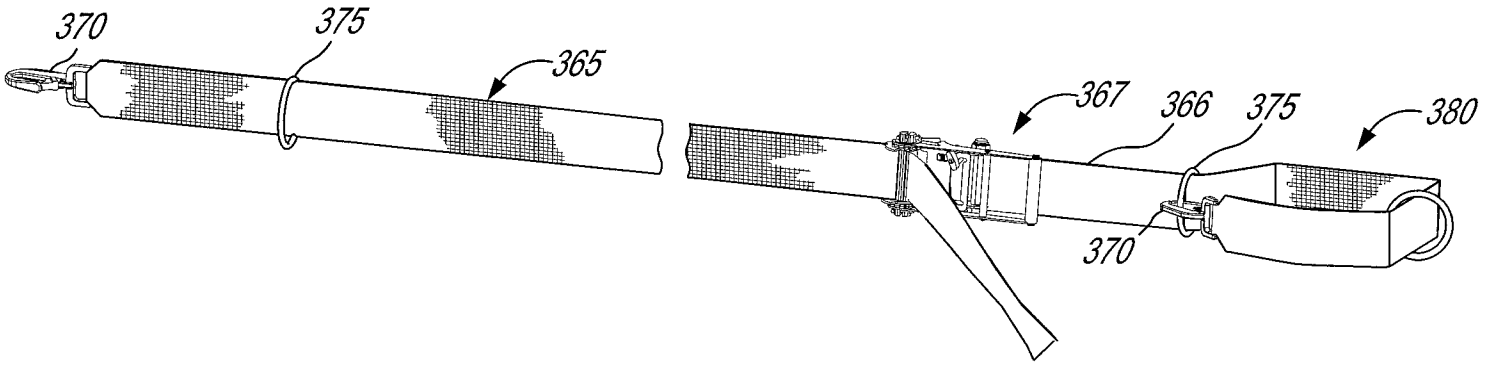
FIG. 55 illustrates the example strap member of FIG. 54 with associated anchor attachment components defining a girdle element.

As seen in FIG. 55 a respective carabiner type connector 370 may be connected to a respective ring connector element 375 to form a girdle element 380 for disposition about a respective (terminal) pillar member. As may also be surmised, the illustrated strap member is connected to a terminal pillar member by pulling the carabiner type connector 370 around a terminal pillar member until it is able to quick connect (i.e. hook) to the respective ring connector element 375. With both ends of the strap member so connected to respective terminal pillar members the strap member may then be (releasably) tensioned in place by the tensioning device 367. A barrier system comprising the illustrated strap member may be dismantled by, inter alia, releasing the tension on the strap member and then decoupling the carabiner type connectors 370.

Figure 56:
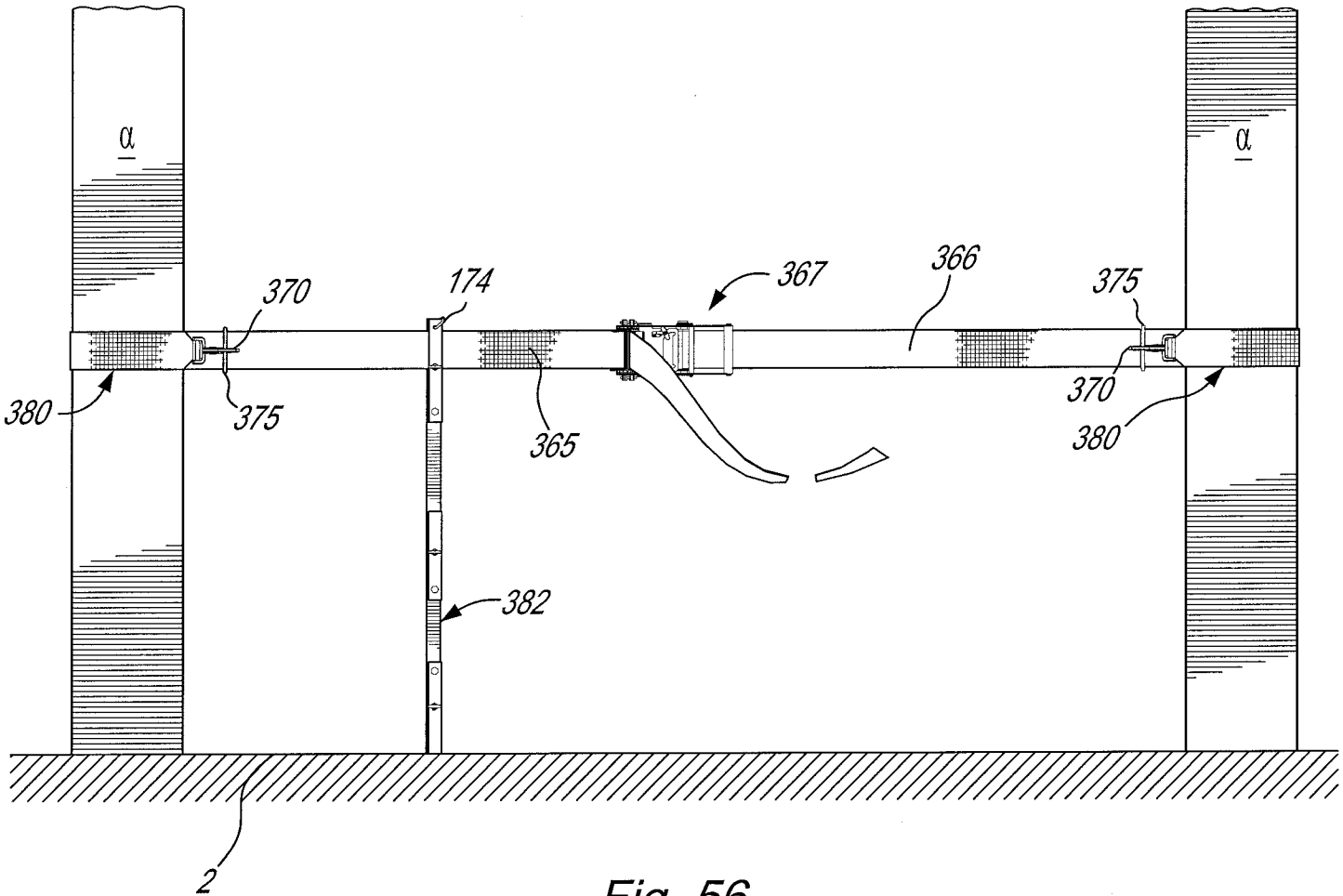
FIG. 56 illustrates a side view of an example barrier system of the present invention exploiting the example strap member and associated anchor attachment components of FIG. 54.
Figure 57:
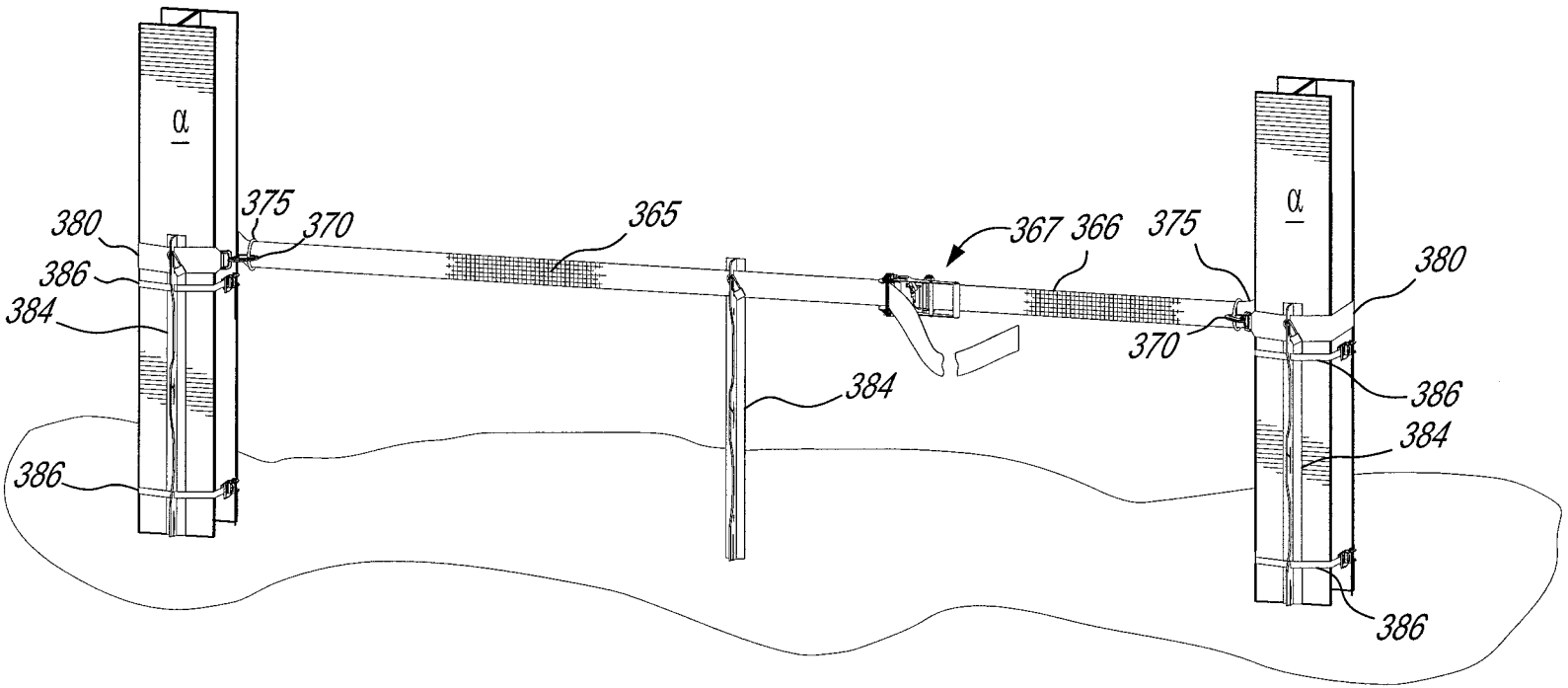
FIG. 57 illustrates in perspective side view a modified example barrier system of the present invention exploiting the example strap member and associated anchor attachment components of FIG. 54 as well as terminal support elements.

Example barrier systems exploiting the strap member illustrated in FIGS. 54 and 55 are illustrated in FIGS. 56 and 57.

FIG. 56 shows an example barrier system which exploits an elevation support element commonly designated hereinafter by the reference numeral 382; elevation support element 382 has the structure of the elevation support element as illustrated in FIG. 13. FIG. 56 also shows the girdle attachment of the strap member illustrated in FIGS. 54 and 55 to terminal pillar members using girdle elements 380 as seen in FIG. 55.

Figure 32:
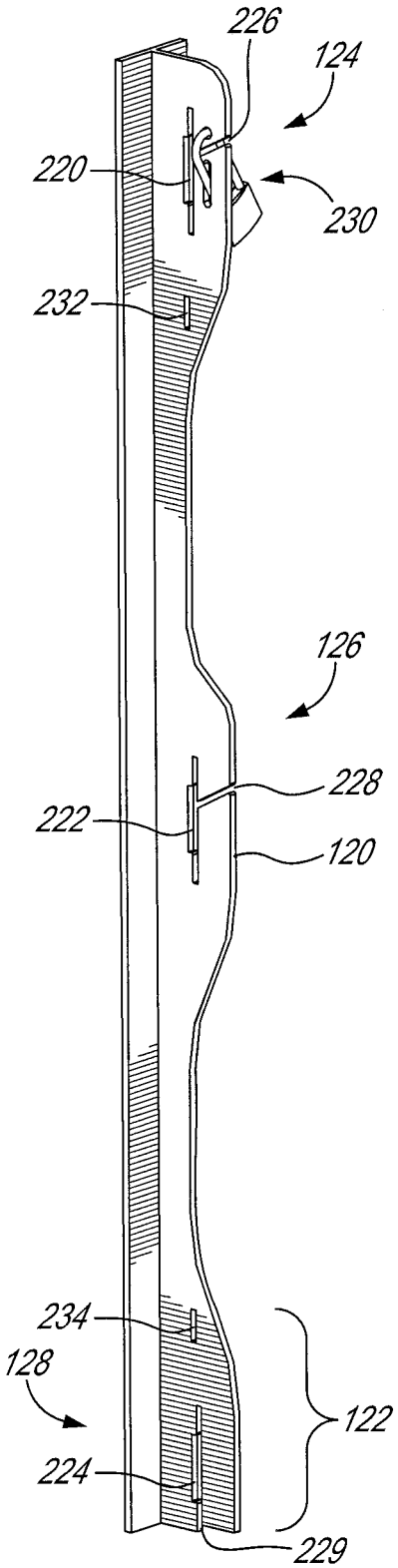
FIG. 32 is a side perspective view of an additional example elevation support element exploiting loop elements split by slot strap openings.

FIG. 57 shows a modified barrier system similar to that shown in FIG. 56 except that the barrier system exploits three elevation support elements commonly designated by the reference numeral 384; an elevation support element 384 has the structure of the elevation support element as illustrated in FIG. 32. Two of the elevation support elements 382 shown in FIG. 57 are immobilized to a respective terminal pillar member by a pair of respective tensionable belt (or ring) connectors; these tensionable belt (or ring) connectors are herein generally designated with the common reference numeral 386.

Figure 58:
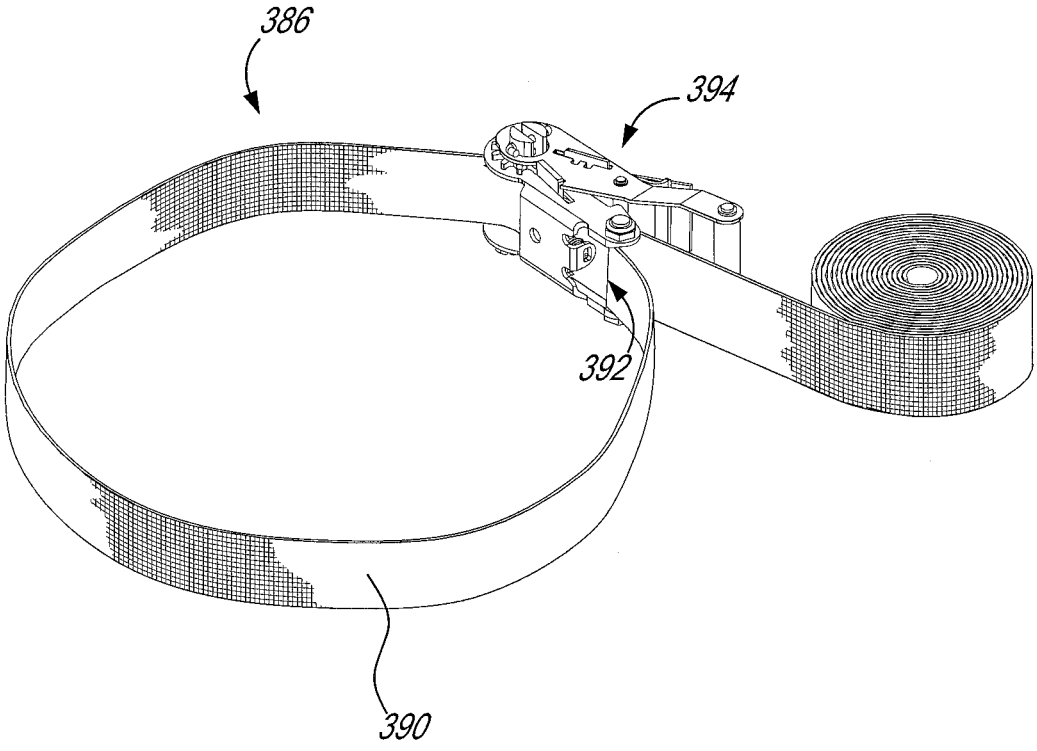
FIG. 58 illustrates in perspective side view an example embodiment of a tensionable connector ring for attachment of an elevation support element to a pillar member.

FIG. 58 is an enlarged view of a tensionable belt (or ring) connector 386. As may be seen in FIG. 58 a tensionable connector belt (or ring) 386 comprises a web element 390 (i.e. a belt member) one end 392 of which is fixed to a tensioning or ratchet device 394 and the other end of which may be (removeably) fed to or removed from the tensioning device 394 (in known manner). For the immobilization of an elevation support elements 384 to the terminal pillar members the free end of respective web elements (i.e. belt members) 390 is first fed through respective web opening 232 and 234 of the respective elevation support element 384 before being fed to the respective tensioning device 394. Thereafter each web element (i.e. belt member) 390 is tensioned to immobilize a respective elevation support element 384 to a respective terminal pillar member. The tensioning device 394 may have a configuration the same as or similar to the ratchet device used to tension a strap member as seen in FIGS. 54 and 55.

Figure 60:
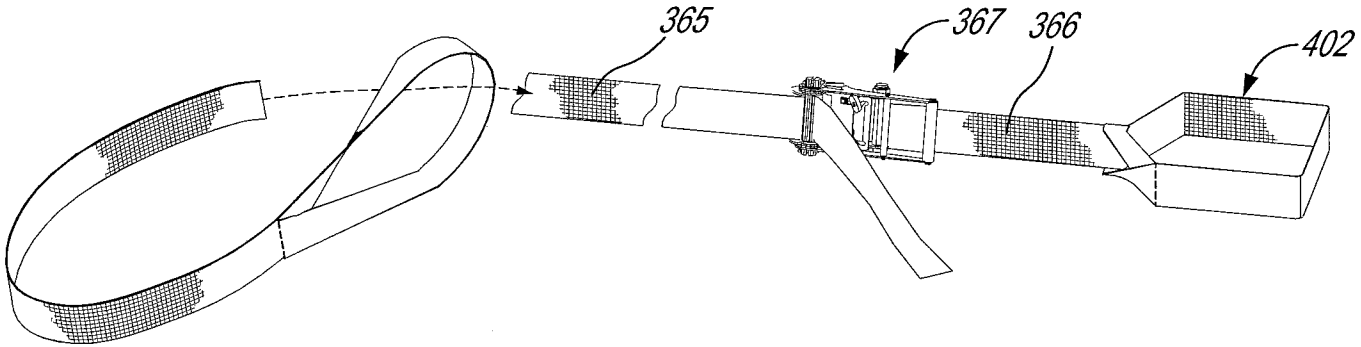
FIG. 60 illustrates the example strap member of FIG. 59 with an associated anchor attachment component in the process of defining a girdle element.
Figure 61:
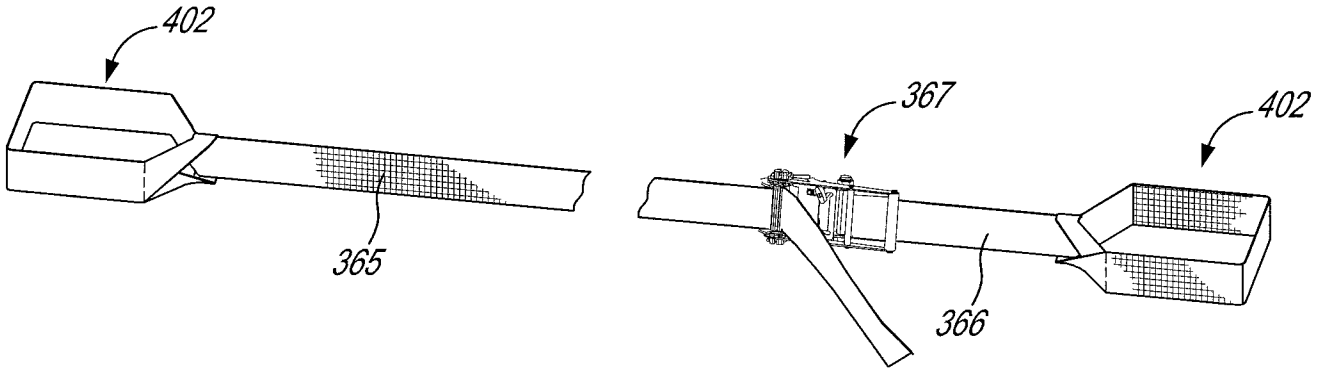
FIG. 61 illustrates the example strap member of FIG. 59 with associated anchor attachment components defining girdle elements.

Turning to FIG. 59 this figure illustrates an alternate strap member and anchor attachment mechanism. As seen, the opposite ends of the illustrated trap member are be provided with respective loops ends 400. As seen in FIGS. 60 and 61 the looped ends 400 may be looped within themselves in order to form a noose (i.e. a girdle element 402) for disposition about respective terminal pillar members. The illustrated strap member is as mentioned above connected to the tensioning device 367 in two parts, one of which is fixed to the tensioning device (in known manner) and the other releasable part is able to be releaseably fed to or removed from the tensioning device. As may be surmised, each part of the strap member may be looped about itself so as to form the above mentioned girdle element 402 girdle around a respective terminal pillar member. The releasable strap part 365 is then fed (i.e. connected) to the tensioning device 367 in suitable (i.e. known) manner. With both ends of the strap member so connected to respective terminal pillar members the strap member may then be tensioned in place. The barrier system may subsequently be dismantled by, inter alia, releasing the tension on the strap member and then decoupling the releasable strap part from the tensioning device followed by removal of the strap member parts from the terminal pillar members.

Figure 62:
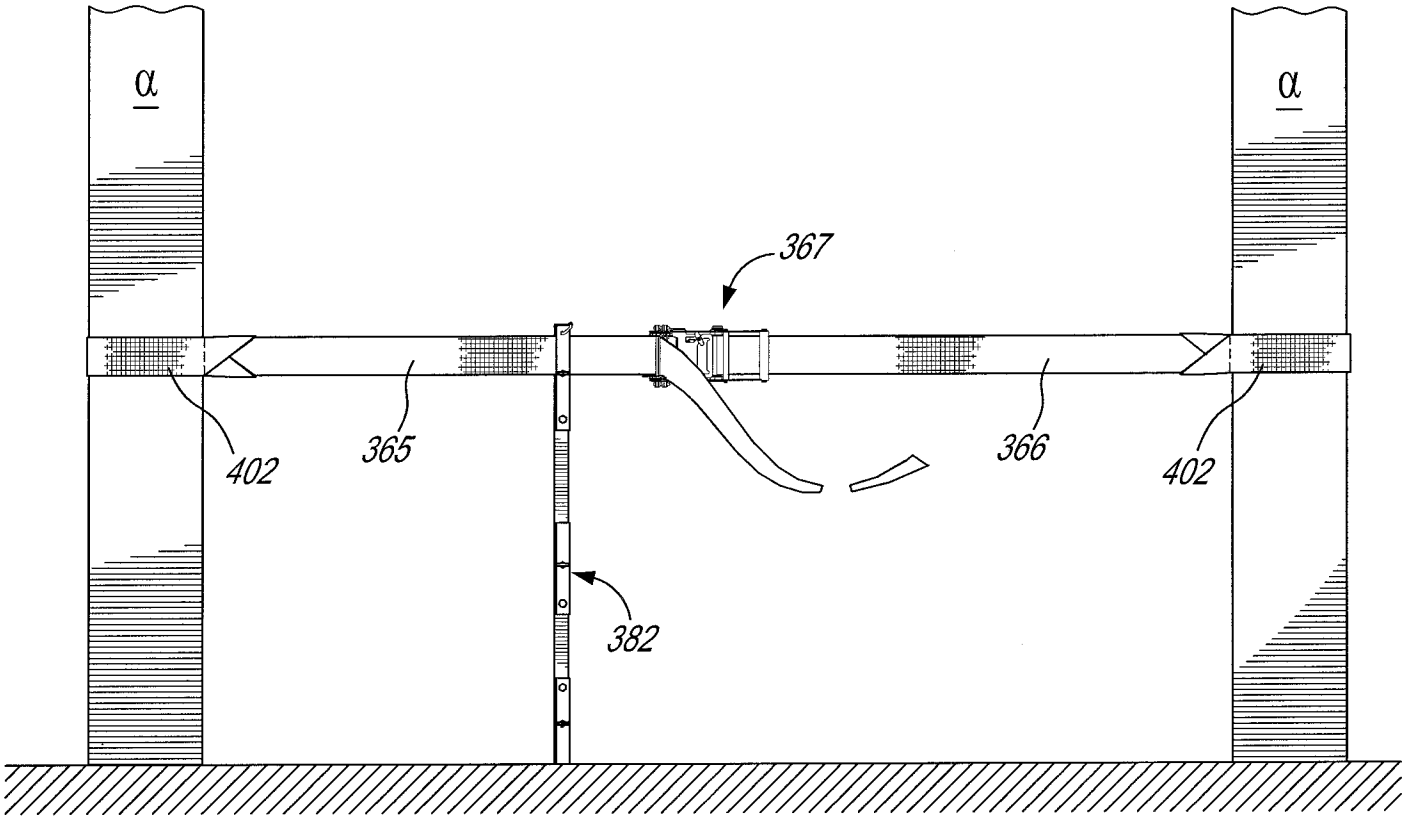
FIG. 62 illustrates in side view an example barrier system of the present invention exploiting the example strap member and associated anchor attachment components of FIG. 61.

FIG. 62 shows an example barrier system which exploits the previously mentioned elevation support element 382. FIG. 62 also shows the attachment of the strap member to terminal pillar members using the girdle elements 402 seen in FIGS. 60 and 61 to The types of anchor attachment members shown in FIGS. 54 to 62 are suitable for a single length of strap member to be attached to respective terminal pillar members. However, if the single strap member is not long enough and it is desired to cascade or daisy chain two or more strap members using common terminal pillar members(s) a problem arises with respect to maintaining strap height level consistency. The nature of the anchor attachment mechanisms of FIGS. 54 to 62 is such that strap members on opposite sides of a common terminal pillar member would be set at different heights. This may be seen from FIGS. 63 and 64 where strap members on opposite sides of the terminal pillar members are set at different height levels. As may be seen, if the same type of elevation support elements 384 are to be used then the height support elements on one side of a common terminal pillar member would be too short (as indicated by the arrows 410) and would not be able to touch the ground or floor.

Figure 65:
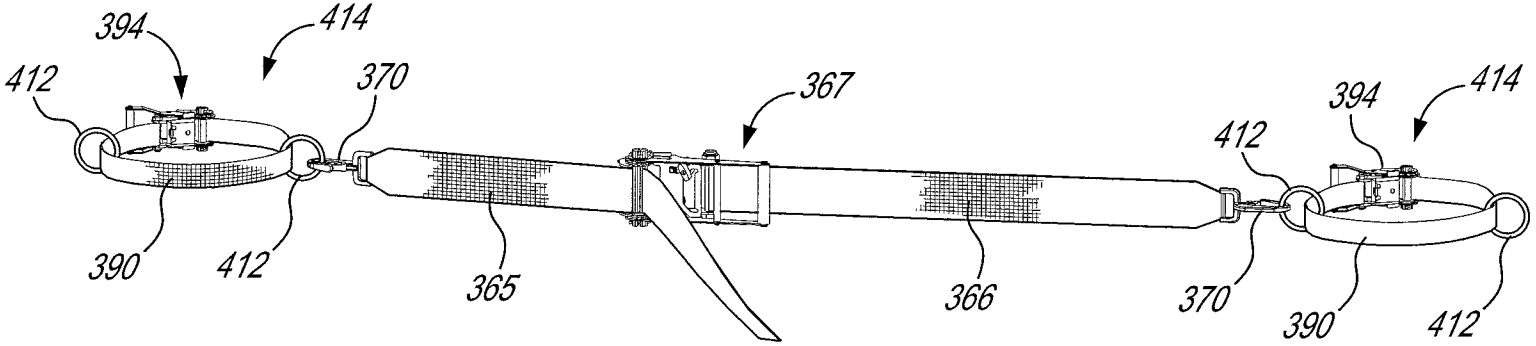
FIG. 65 illustrates in perspective side view another example strap member and associated anchor attachment components for daisy chaining barrier components.

Accordingly for (daisy) chaining strap members to common terminal pillar members, recourse may be had to an example strapping combination as shown in FIG. 65, namely a combination which comprises a strap member and at least one anchor attachment member (two being shown for purposes of illustration). This type of anchor attachment member has the advantage that the (daisy) chained strap members may be independently tensioned or un-tensioned.

Figure 66:
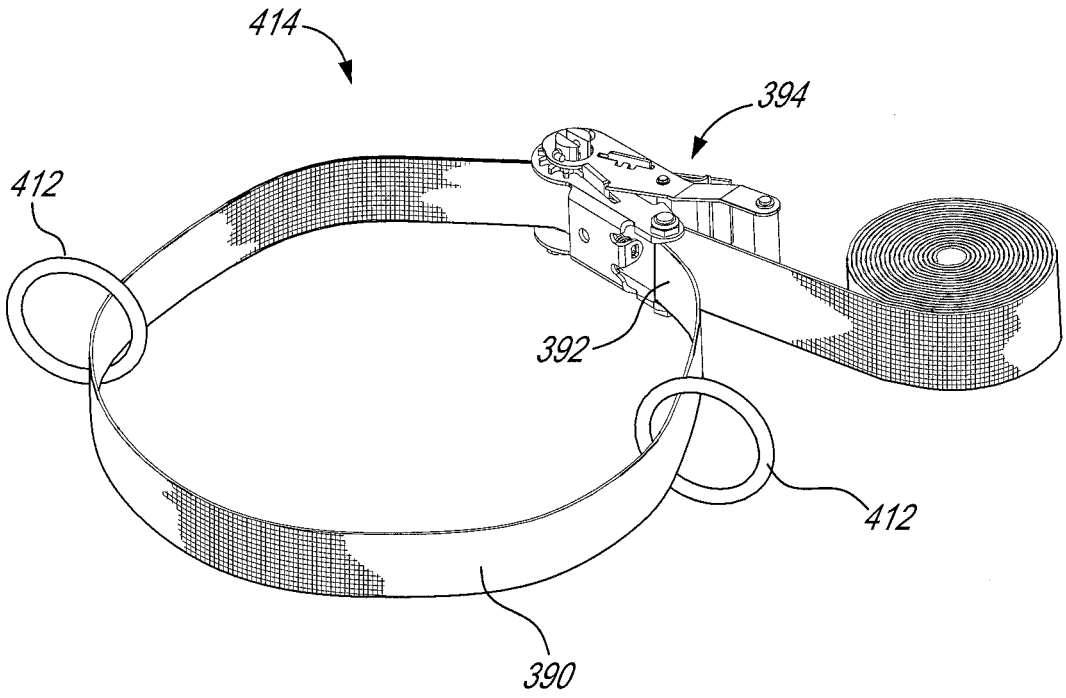
FIG. 66 illustrates in perspective side view an example embodiment of a tensionable anchor attachment member of FIG. 65 for attachment of an elevation support element to a terminal pillar member

Referring to FIG. 65, as may be seen the strap member has the form as shown in FIG. 54 (but without ring connector elements 375). The anchor attachment members each have the form of the tensionable belt (or ring) connector as shown in FIG. 58 (but are also provided with two connector rings commonly designated with the reference numeral 412). An anchor attachment member which is illustrated in FIG. 66 is essentially the same as the tensionable connector ring as seen in FIG. 58, i.e. the anchor attachment members of FIG. 66 is releasably tensionable about a pillar member by passing the web element (i.e. belt member) 390 thru respective strap member apertures of the elevation support element. The ring connector elements 412 are provided to act as strap attachment elements for attaching respective strap members to the same or common terminal pillar member (i.e. by strap member carbiner type connectors 370).

Thus, as may be appreciated and referring to FIG. 65, each of the anchor attachment members comprises a separate strap attachment segment (i.e. web element (i.e. belt member) 390 of FIG. 66) associated with two attachment ring connectors 412 and a respective tensioning device 394. On the other hand, the example strap member illustrated in FIG. 65 is (as mentioned above) provided at both ends with a respective quick clip element (i.e. carabiner type fasteners 370) for connection to respective ring connectors.

Figure 67:
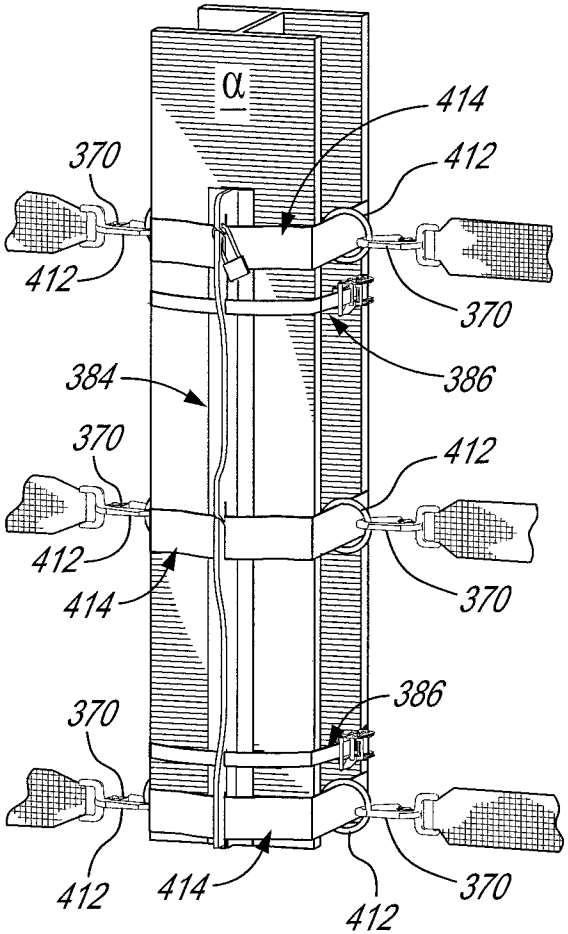
FIG. 67 illustrates in perspective side view example tensionable anchor attachment members of FIG. 66 defining girdle elements about a common terminal pillar member to daisy chain strap members of FIG. 65 to the common terminal pillar member.

The strap attachment segment (i.e. web 390 of FIG. 66) may be used to define a girdle element 414 about a respective terminal pillar member. Turning to FIG. 67 this fig. illustrates three such girdle elements 414 for connection to respective strap members to define top, mid and toe strap-rails, i.e. a girdle element 414 may be exploited to attach two strap members to a common terminal pillar member on opposites sides of the common terminal pillar member. In FIG. 67 the elevation support element is the above mentioned elevation support element 384. The girdle elements 414 are each (releasably) maintained at a predetermined height level by engagement of the web element (i.e. belt member) 390 thereof with a respective aperture 220, 222 and 224 of the elevation support element 384 (see FIG. 32).

Figure 68:
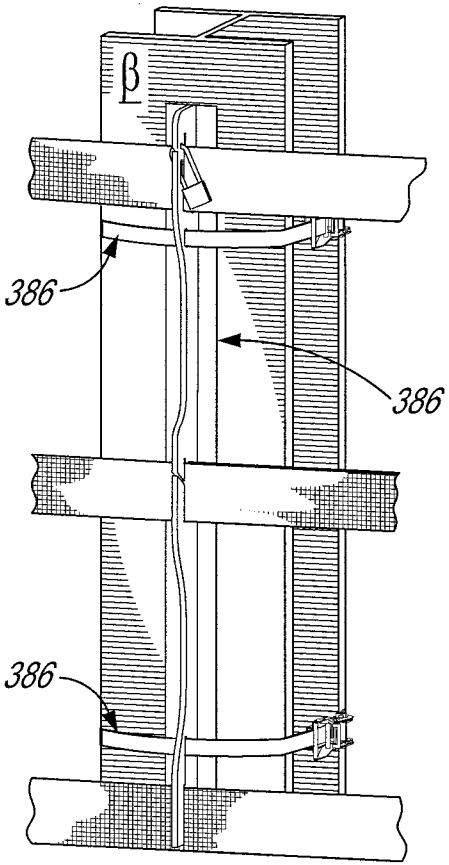
FIG. 68 illustrates in perspective side view example tensionable anchor attachment members of FIG. 58 immobilizing an elevation support element to an intermediate pillar member.

As an optional feature the elevation support element 384 is (also) immobilized to the terminal pillar by a pair of tensionable connector rings illustrated 386 (i.e see FIG. 58). For comparison, FIG. 68 shows the tensionable connector rings 386 being used to releasably immobilize an elevation support element 384 to an intermediate pillar member; the web element (i.e. belt member) 390 passing thru the web attachment openings 232 and 234 (see in particular FIG. 32 for the web attachment openings 232 and 234).

Thus, by exploiting anchor attachment members such as seen in FIG. 65 it is possible to (daisy) chain a two or more lengths of strap members using a common terminal pillar while conserving a common height level on either side thereof. The anchor attachment member(s) may as shown comprise a connector combination which may for example comprise at least one a ring connector 412. Alternatively, the anchor attachment member may have carabiner type connectors 370 while the ends of the strap member may have ring connectors 375. In any case, the connection of the anchor attachment member to the strap member may be modified in other (suitable) manner keeping in mind the desired result, namely a consistent height on both sides of a terminal pillar member.

Referring back to FIG. 57, this figure shows a barrier system in accordance with the present invention with one rail strap member (i.e. top-rail strap member) as shown in FIG. 55 and wherein above mentioned girdle elements 380 attach the strap member to terminal pillar members. The anchor attachment members comprise the previously mentioned quick clip connectors (i.e. carabiner type connectors 370) attached at both ends of the strap member and which are in turn hooked up to the previously mentioned ring connectors 375. The barrier system shown exploits the same type of elevation support member 384 as terminal elevation support elements and as a span elevation support element, namely, the elevation support element of FIG. 32. The terminal elevation support elements 384 are immobilized to both of the terminal pillar members by the strap attachment segment 386. The elevation supports elements 384 immobilized to the terminal pillars are also connected to the girdle elements 380 via apertures 220 (see FIG. 32). Although not shown in FIG. 57 the girdle elements 380 disposed about one or both of the terminal pillar members may as desired comprise an additional ring connector (for daisy) chaining of another similar strap member to the same terminal pillar. Such secondary ring connectors are shown in dotted lines in FIG. 55.

FIGS. 69 to 73 illustrate barrier systems in accordance with the present invention which each have a top strap-rail. The systems exploit three in-situ pillar members, two of which are terminal pillar members and one of which is an intermediate pillar member. The barrier systems exploit (terminal) elevation support elements 384 (as characterized above) which are immobilized to respective terminal pillar members by tensionable ring connectors 386; the systems also exploit an elevation support element 384 which is immobilized to a respective intermediate pillar member also by tensionable ring connectors 386. The terminal girdle elements 414, however, shown with a single (i.e. not two) connector rings 412. The barrier systems are shown as exploiting a span (elevation) support element 382 or 384 (both as characterized above). Although the same style of elevation support elements are shown for immobilization to the terminal pillar members, the elevation support elements as shown may take any other form as shown herein. In other words in accordance with the present invention the elevation support elements may take the same or different style as desired or necessary.

Figure 69:
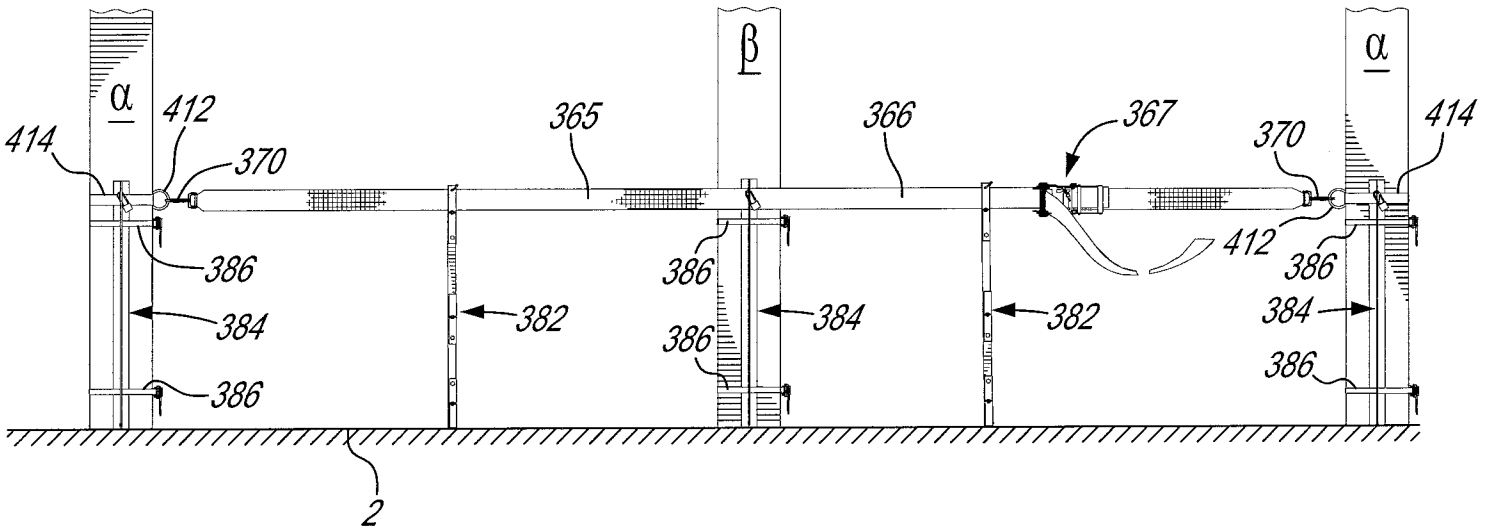
FIG. 69 shows in side view an example barrier system of the present invention with a top strap rail only.

FIG. 69 shows a barrier system with a top strap rail only. The system uses the elevation support element (designated previously with the reference numeral) 382 for the span elevation support elements and elevation support element (designated previously with the reference numeral 384) as terminal elevation support elements.

Figure 70:
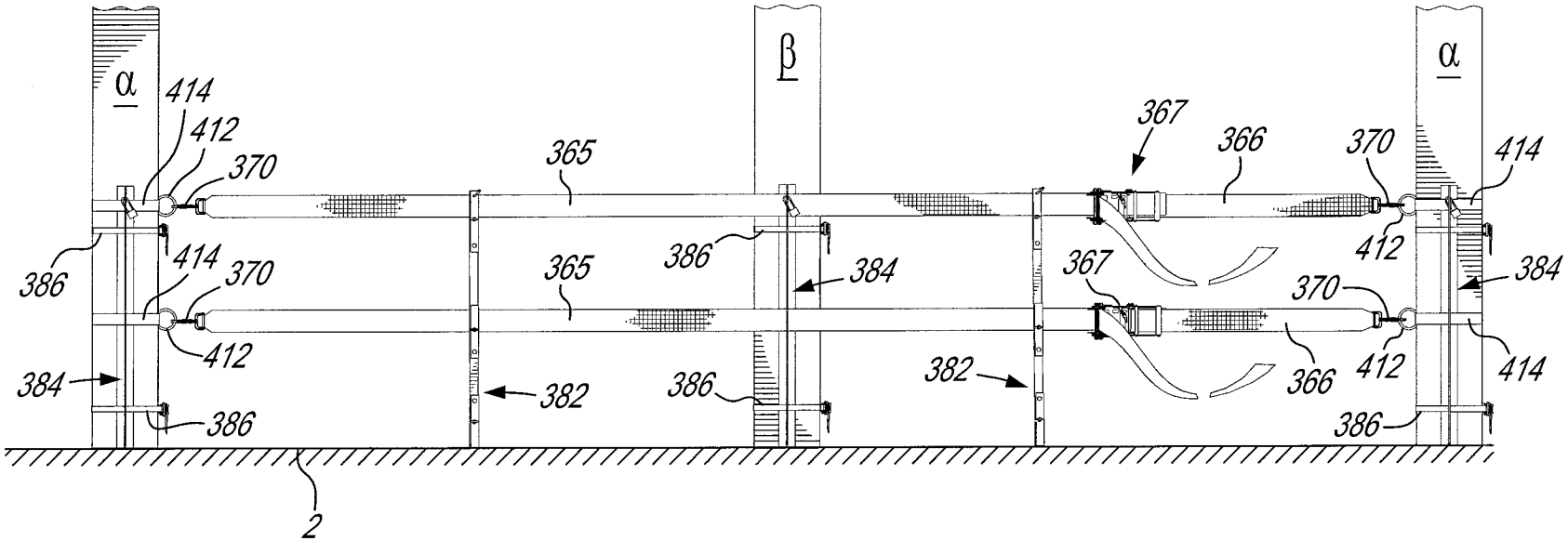
FIG. 70 shows in side view an example barrier system of the present invention with a top and mid strap rail.

FIG. 70 shows a barrier system with a top and mid strap rail. The system also uses the elevation support element (designated previously with the reference numeral) 382 for the span elevation support elements and elevation support element (designated previously with the reference numeral 384) as terminal elevation support elements.

Figure 71:
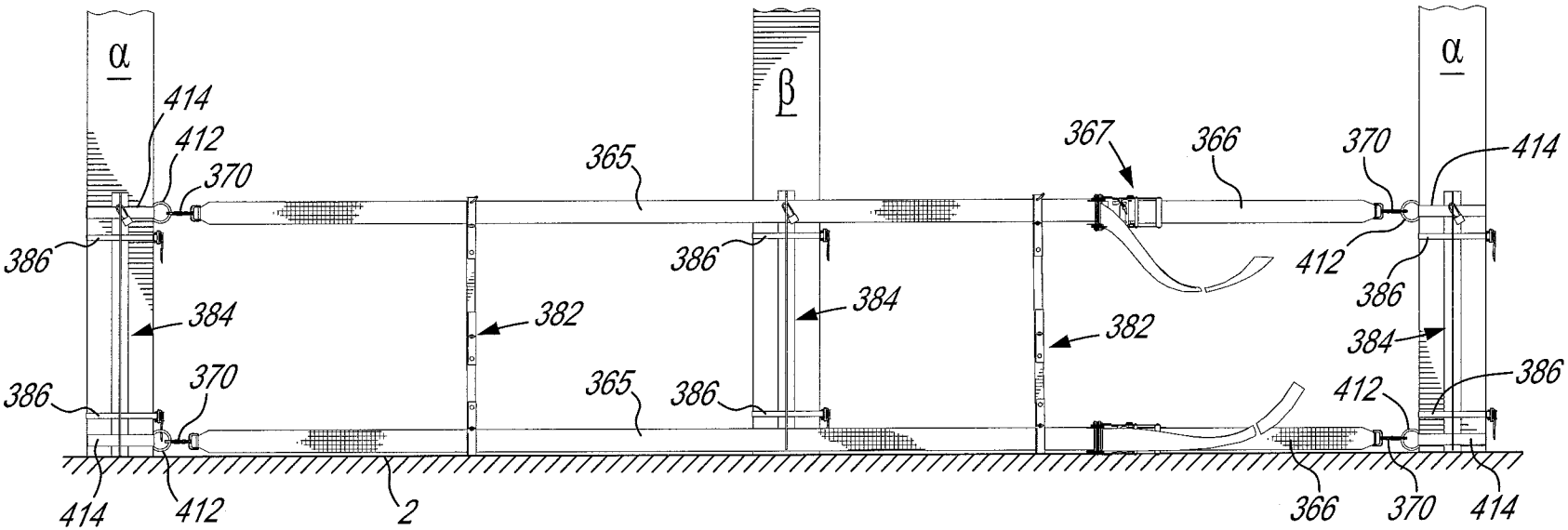
FIG. 71 shows in side view an example barrier system of the present invention with a top and toe strap rail.

FIG. 71 shows a barrier system with a top and toe strap rail. The system shown also uses the elevation support element (designated previously with the reference numeral) 382 for the span elevation support elements and elevation support element (designated previously with the reference numeral 384) as terminal elevation support elements.

Figure 72:
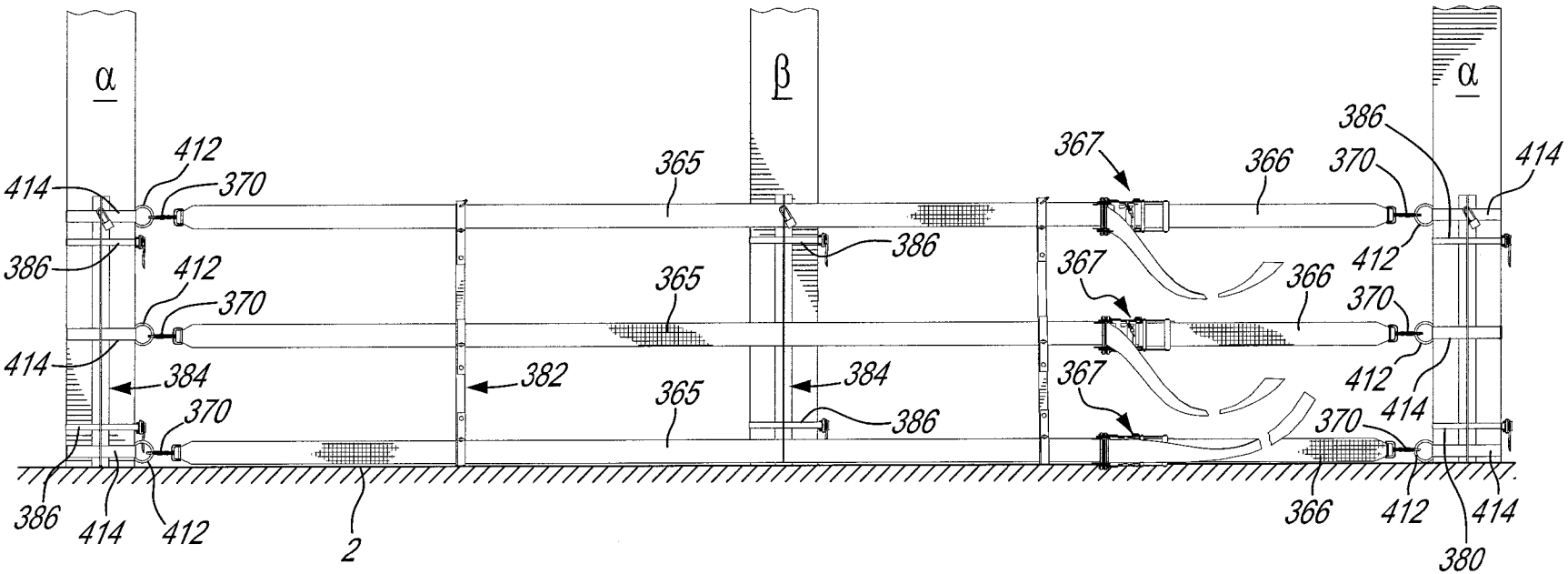
FIG. 72 shows in side view an example barrier system of the present invention with a top, mid and toe strap rail.

FIG. 72 shows a barrier system with a top, mid and toe strap rail. The system again uses the elevation support element (designated previously with the reference numeral) 382 for the span elevation support elements and elevation support element (designated previously with the reference numeral 384) as terminal elevation support elements.

Figure 73:
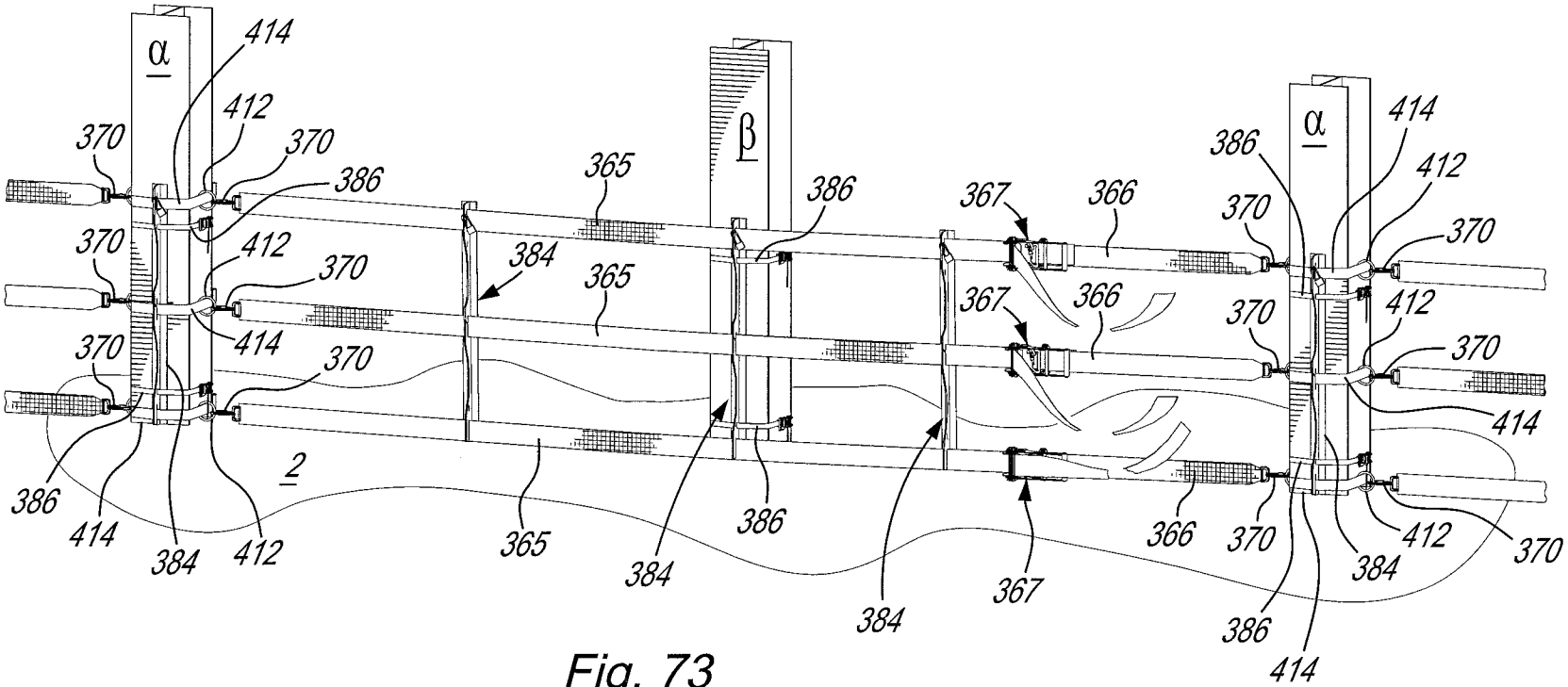
FIG. 73 shows in perspective side view an example barrier system of the present invention with a top, mid and toe strap rail which exploits a single type of elevation support element as both span and terminal support elements.

FIG. 73 shows a barrier system with a top, mid and toe strap rail such as illustrated in prior FIG. 72 but which exploits a single type of elevation support element as both span and terminal support elements (i.e. an elevation support element 384); the barrier system also includes (daisy) chained strap members i.e. the terminal girdles have two ring connectors.

As mentioned above, FIG. 65 illustrates an example strapping combination in accordance with the present invention which may be used for (daisy) chaining strap members to (common) terminal pillar members. This type of anchor attachment member has the above described advantage that the (daisy) chained strap members may be independently tensioned or un-tensioned.

Figure 77:
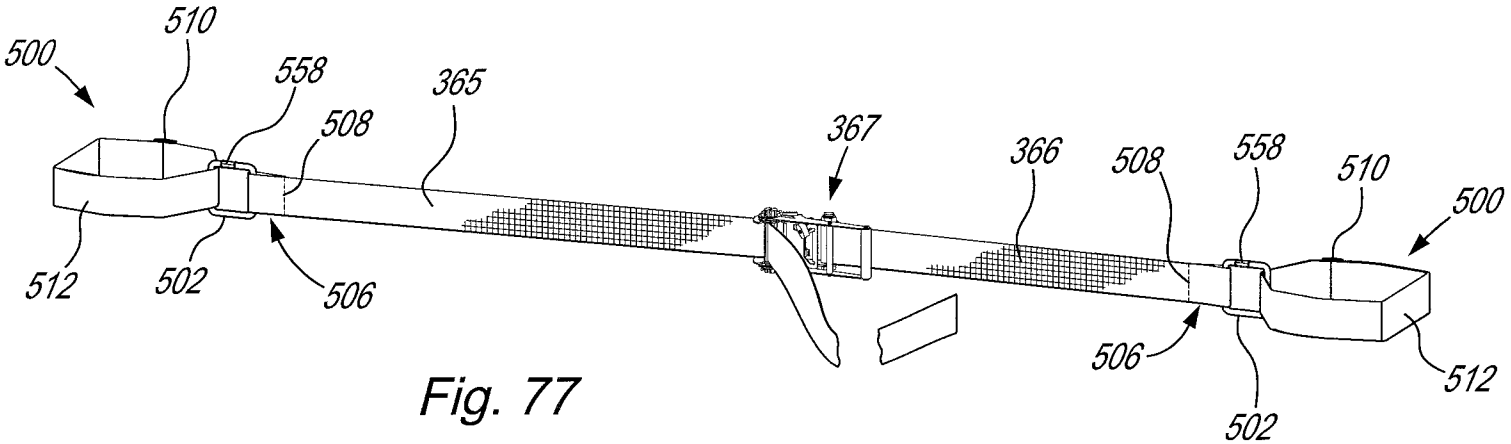
FIG. 77 illustrates in perspective side view an alternative strapping combination for attaching a barrier strap member to terminal pillar members.
Figure 78:
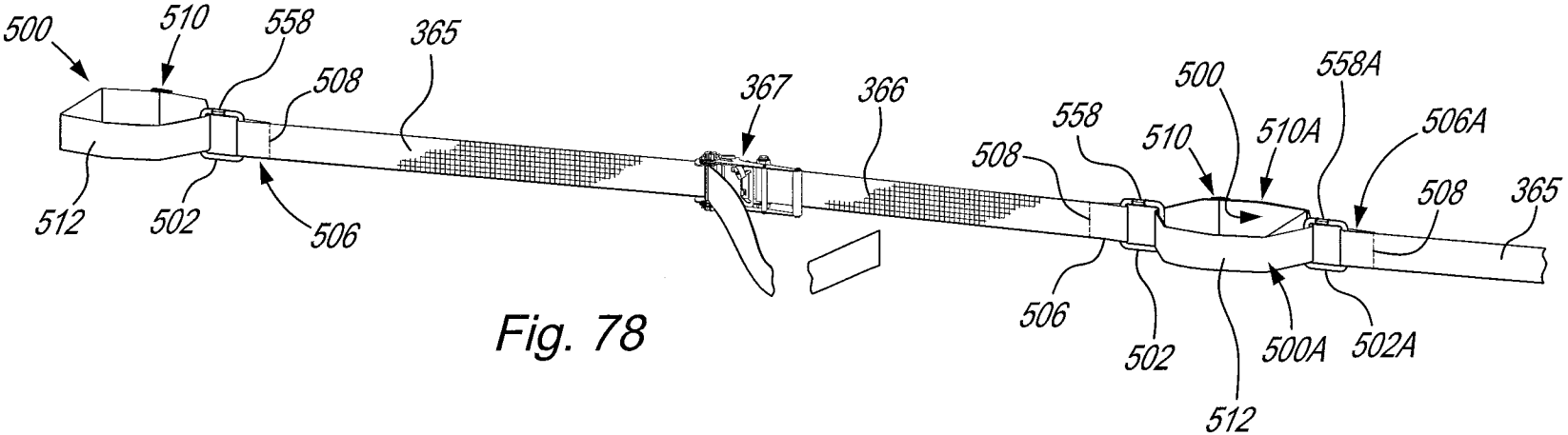
FIG. 78 illustrates the alternative strapping combination of FIG. 77 daisy chained to a common terminal pillar in association with another such alternative strapping combination.

FIG. 77 illustrates an example of an alternative type of strapping combination in accordance with the present invention which may be used for (daisy) chaining strap members to terminal pillar members. The alternative type of strapping combination is illustrated in FIG. 77 as being attached to terminal pillar members which are not shown. FIG. 78 shows two of the alternative strapping combinations of FIG. 77 attached to a common pillar member (i.e. also not shown). As in the case of the example strapping combination shown in FIG. 65, the type of alternative strapping combination shown in FIG. 77 comprises a strap member and at least one anchor attachment member; two anchor attachment members are however being shown for purposes of illustration in the example of FIG. 77. The anchor attachment members for the alternative strapping combination of FIGS. 77 (and 78) thus each define a girdle element 500 and each also comprises a strap attachment element which as shown is in the form of a ring quick connect connector element commonly designated with the reference numeral 502.

Figure 79:
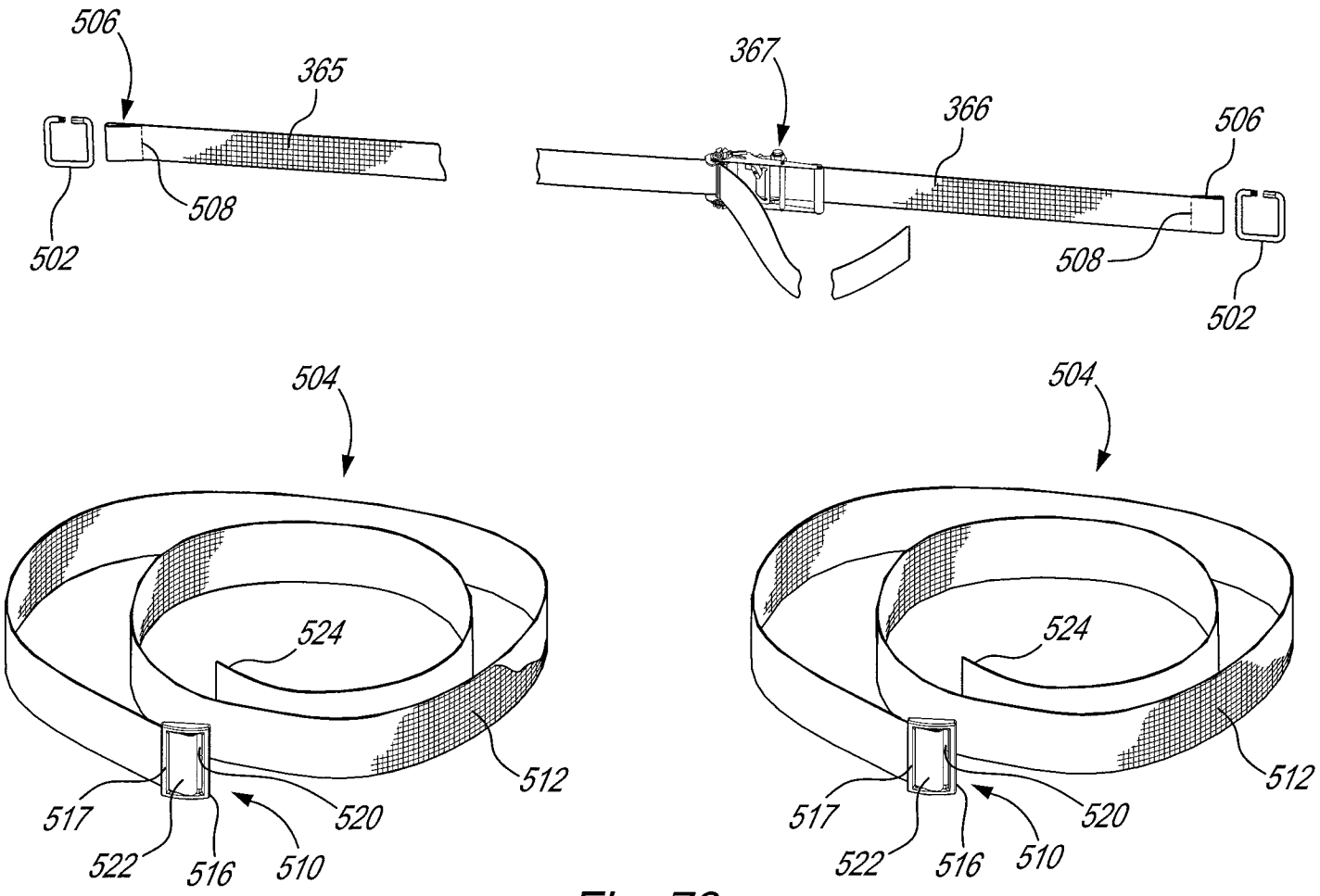
FIG. 79 illustrates a perspective view of an example strap-rail kit for the alternative strapping combination of FIG. 77.

Referring to FIG. 79, an example kit is illustrated which may be used to form the alternative type of strapping combination which is illustrated in FIGS. 77 (and FIG. 78). As shown the kit for the alternative strapping combination comprises a strap member which as in the case of the strap member shown in FIG. 54 has two separate band parts, namely, band parts 365 and 366. The strap member also includes a tensioning or ratchet device 367 able to interconnect the band parts 365 and 366. The kit for the alternative strapping combination also comprises two pillar engagement elements (commonly designated with the reference numeral 504) as well as the two split ring quick connect connector elements 502. As mentioned above and as shall be discussed below, the pillar engagement elements 504 and the split ring quick connect connector elements 502 each form part of respective anchor attachment members of the strapping combination which is illustrated in FIGS. 77 (and FIG. 78).

As may be seen from FIG. 79 the strap member has the form as shown in FIG. 54 except that instead of having carabiner type fasteners 370, the strap member is provided with looped ends (commonly designated with the reference numeral 506). The looped ends 506 may be obtained by folding a portion of a strap end over itself and then stitching the folded over end to the underlying strap member along stitch line 508 as shown.

Each of the pillar engagement elements 504 comprises a respective belt-buckle 510 and a respective belt member 512 (i.e. a respective strap anchor segment).

Figure 90:
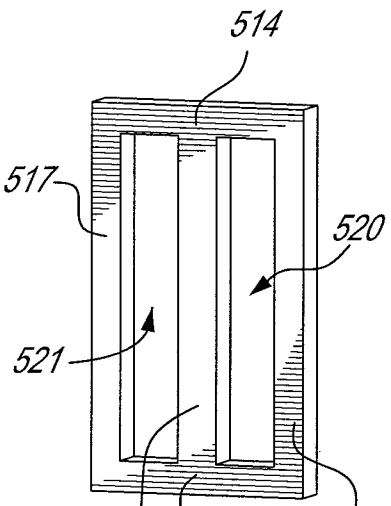
FIG. 90 is a perspective side view of another example embodiment of a belt-buckle in accordance with the present invention.

Each belt-buckle 510 comprises a buckle body (or frame) such as is shown by way of example in FIG. 90. Referring to FIG. 90 the illustrated buckle body has two parallel spaced apart side members (both designated by the common reference numeral 514) which are interconnected at their ends by transverse connecting members 516 and 517.

Figure 80A:
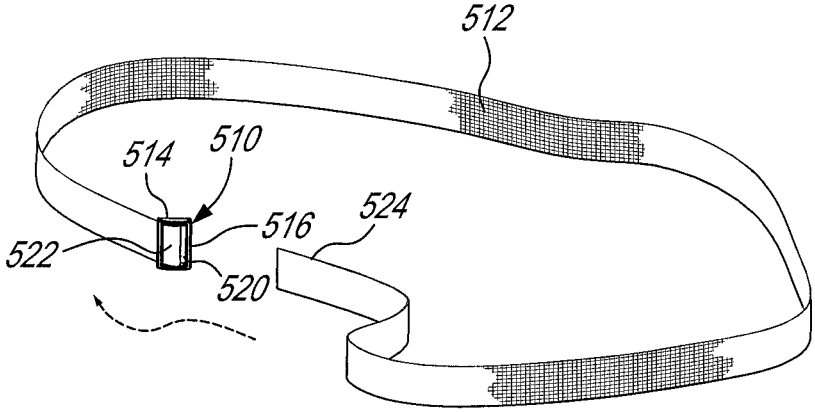
FIGS. 80A, 80B and 80C illustrate in perspective side view the process steps for the creation of a girdle element using a pillar engagement element as shown in FIG. 79.
Figure 80B:
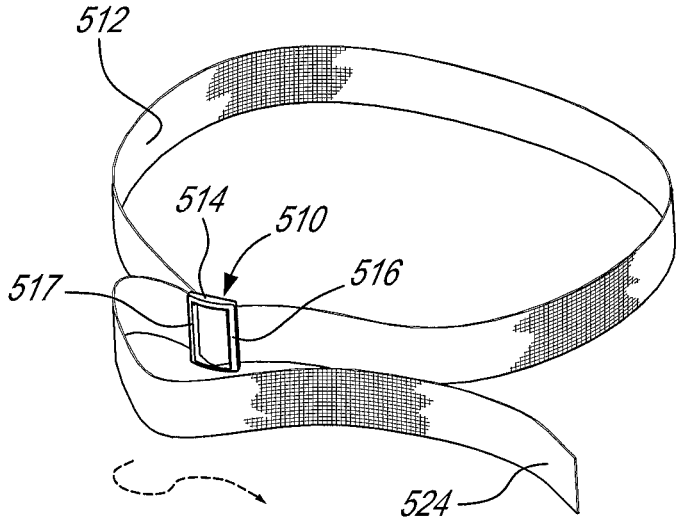
Figure 80C:
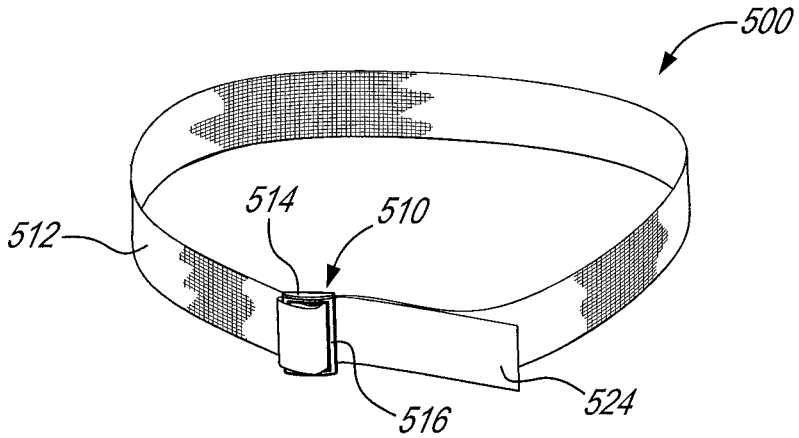

The side members 514 are also interconnected by a transverse intermediate member 518 such that the buckle body defines two belt thread apertures or slots 520 and 521 to allow a respective belt member to be threaded there through (e.g. in double pass (i.e. loop) fashion) in a manner such as shown in FIGS. 80A, 80B and 80C, i.e. for friction type engagement there between.

Each belt member 512 has a first proximal (portion or) end. The first proximal end defines a connector loop 522 by which the belt member 512 is directly mounted or attached to the transverse intermediate member 518 of the buckle frame. The connector loop 522 may be formed for example by folding a portion of the first proximal end over itself and around the transverse intermediate member 518 and then stitching the folded over edge to the underlying belt member 512 with the transverse intermediate member 518 surrounded by the connector loop 522.

Each belt member 512 also has a second distal free (portion or) end 524.

Each belt-buckle 510 and respective belt member 512 is configured for defining a respective removable girdle element 500 which may be (removably) disposed about a respective terminal pillar member. An example double pass (belting) process for the formation of the girdle element is illustrated in FIGS. 80A, 80B and 80C; see dotted arrows for indication of belt member movement. Turning to FIG. 80A the second distal free end 524 of the belt member 512 is first passed under the buckle body and threaded up through one of the belt thread apertures (e.g. thread aperture 520); the second distal free end 524 is then passed over the loop connector 522 and threaded down through the other belt thread aperture 521 as shown in FIG. 80B; finally the second distal free end 524 is doubled back over the connecting member 517, threaded down through the belt thread aperture 520, under the connecting member 516 and pulled tightly in place as shown in FIG. 80C. The belt member 512 is held in place by friction, i.e. by frictional locking. The process for forming the girdle element about a pillar member is of course carried out by first wrapping the belt member about a desired pillar member and then proceeding with the above described double pass (belting)

process. As may be understood the girdle element may be removed from a pillar member by proceeding with the belting process in the reverse order.

Figure 93A:
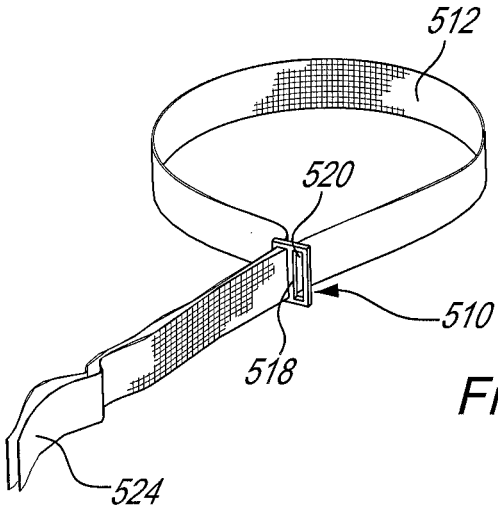
FIGS. 93A, 93B and 93C illustrate in perspective side view the process steps for the creation of a girdle element using another example pillar engagement element wherein the belt member (of FIG. 80A) and belt-buckle (of FIG. 90) are not directly attached to each other.
Figure 93B:
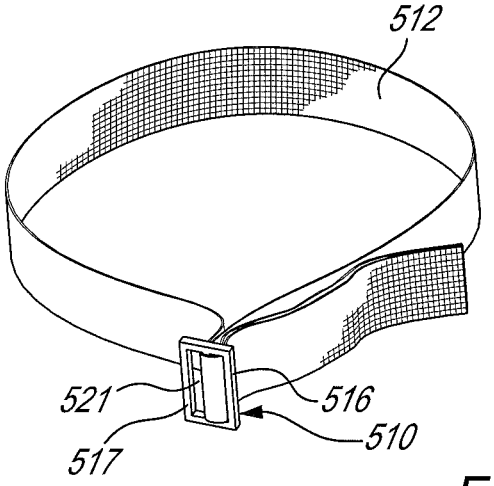
Figure 93C:
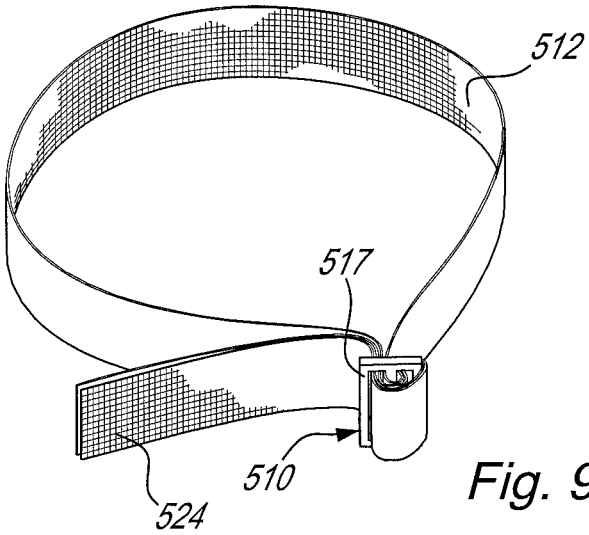

As an alternative, the belt member 512 need not be directly attached or mounted to the buckle body. In other words, in order to provide a friction type engagement between the belt-buckle of FIG. 90 and the belt member 512 neither end of the belt-member 512 need to be directly attached to the transverse intermediate member 518 of the buckle body (or frame). For this type of buckle system the double pass (belting) process for the formation of the girdle element is illustrated in FIGS. 93A, 93B and 93C. For this girdle embodiment, both the free first proximal end and the free second distal end 524 are simultaneously first passed under the buckle body (or frame) and threaded up through one of the belt thread apertures (e.g. thread aperture 521) as shown in FIG. 93A; the two free ends are then passed over the transverse intermediate member 518 of the buckle frame and threaded down through the other belt thread aperture 520 as shown in FIG. 93B; finally the two ends are doubled back over the connecting member 516, threaded down through the belt thread aperture 521 and pulled tightly in place as shown in FIG. 93C. Frictional contact between the buckle body and various parts of the strap member itself is exploited to maintain the girdle form in place, i.e. the system is in a sense self-locking due to the frictional contact. The process for forming a girdle element about a pillar member is as mentioned above also of course carried out by first wrapping the belt member about a desired pillar member and then proceeding with the above described double pass (belting) process. As may be understood the girdle element may be removed from a pillar member by proceeding with the belting process in the reverse order.

Figure 94A:
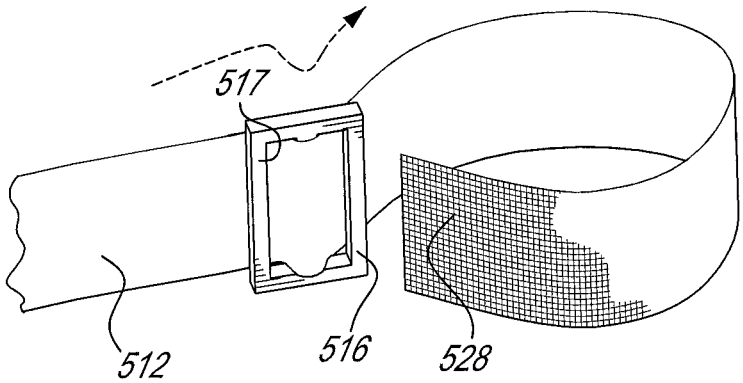
FIGS. 94A, 94B and 94C illustrate in perspective side view another example set of process steps for the creation of a girdle element using the example pillar engagement element of FIG. 93A wherein the belt member and belt-buckle are not directly attached to each other.
Figure 94B:
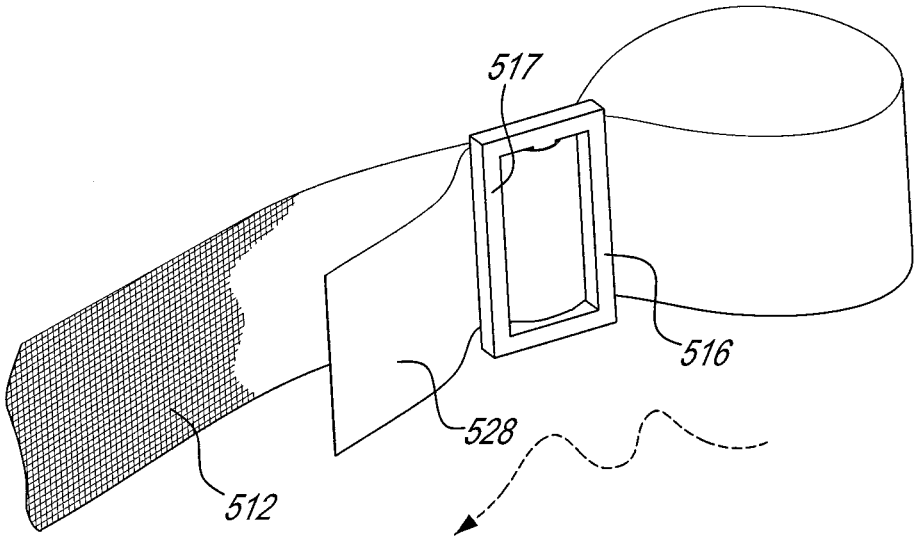
Figure 94C:
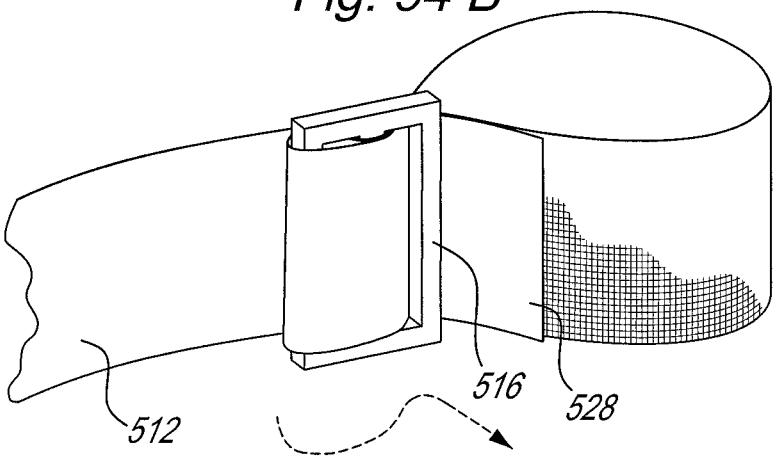
Figure 95A:
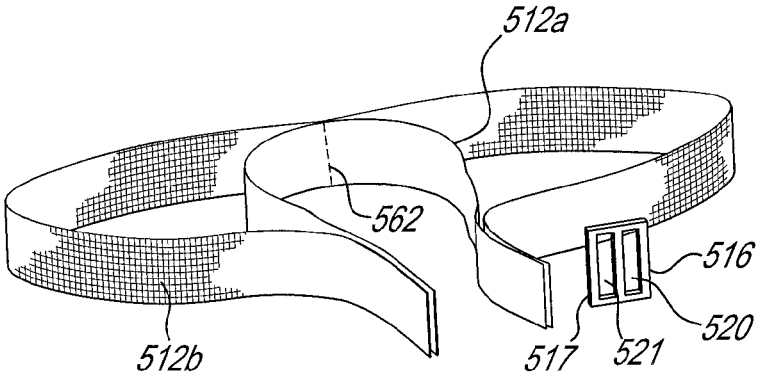
FIGS. 95A, 95B, 95C and 95D illustrate in perspective side view a further set of process steps for the creation of a girdle element using another example pillar engagement element wherein the belt member is a double belt member and the belt-buckle (of FIG. 90) is not directly attached to the double belt member.
Figure 95B:
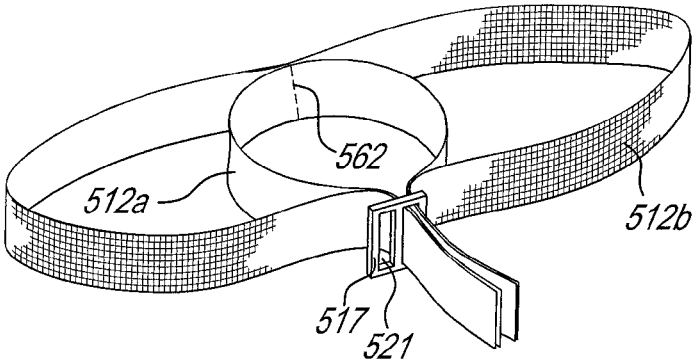
Figure 95C:
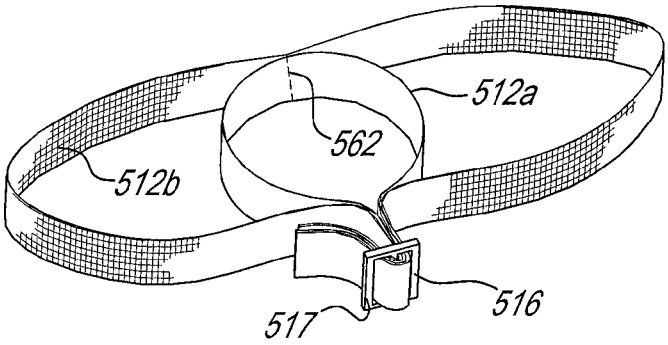
Figure 95D:
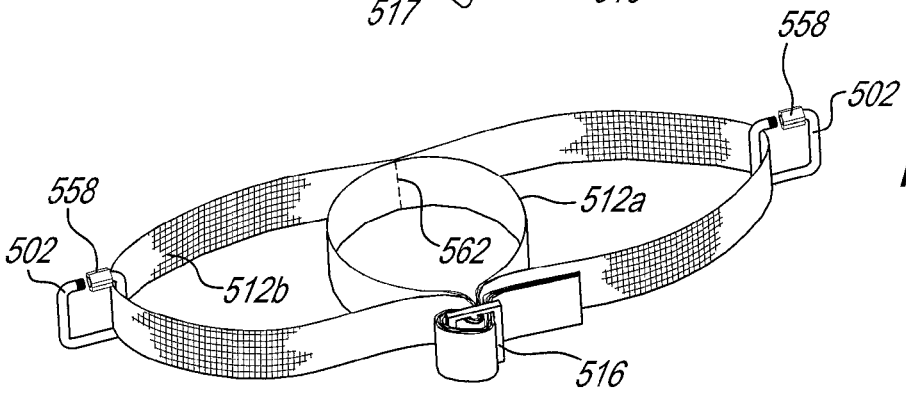

An alternate friction double pass threading system is shown in FIGS. 94A, 94B and 94C; the belt-member is again not directly attached to the belt-buckle (see dotted arrows for indication of belt member movement). For this embodiment a free end 528 of the belt member 512 may be threaded through the thread apertures in serpentine fashion as shown in FIG. 94A. Thereafter the free end 528 may be likewise threaded through the apertures in opposite direction as shown in FIG. 94B and then finally doubled back over the connecting member 517 through the initial thread aperture as shown in FIG. 94C and tightened in place. Frictional contact again maintains the girdle form in place.

Figure 63:
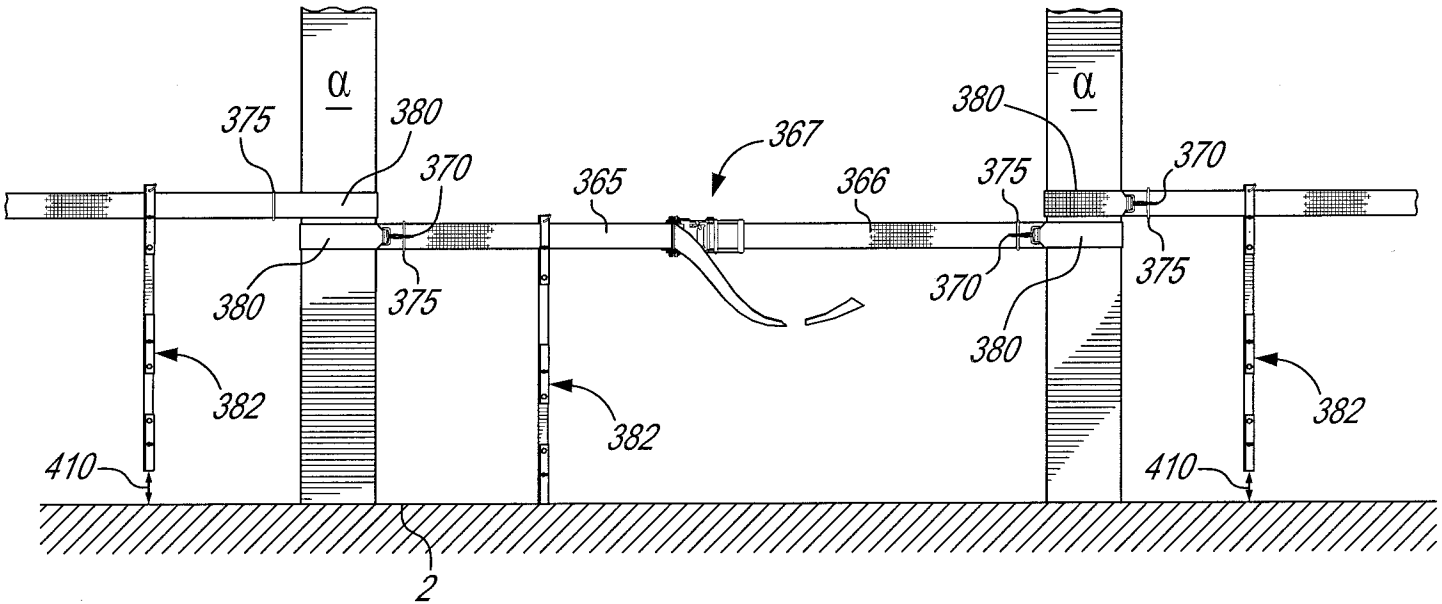
FIG. 63 illustrates in side view example barrier components of FIG. 56 connected to common terminal pillar members.
Figure 64:
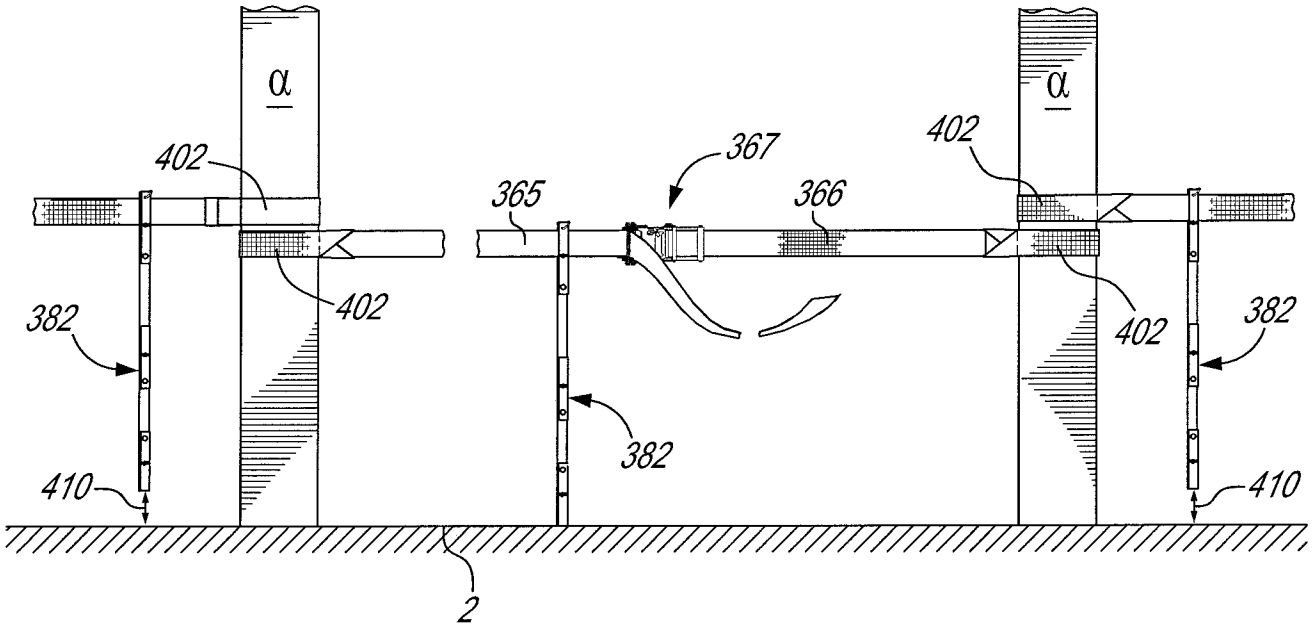
FIG. 64 illustrates example barrier components of FIG. 62 connected to common terminal pillar members.

The buckling mechanism shown in 94A, 94B and 94C may, for example, also be used as an alternative strap/girdle connection means, the buckling mechanism using the end of a strap member to directly define a girdle element about a pillar member without resorting to the connector loop 506 and a respective ring quick connector element 502 (i.e. a strap attachment element) to connect the girdle element to a separate belt member. In this case the end of the strap member will comprise (i.e. be integral with) the belt member of a pillar engagement element, i.e. the strap attachment element forms part of the strap member itself. This type of alternative may in particular be used if daisy chaining of strap members is not contemplated such as seen in FIGS. 63 and 64 (i.e. if there will be only two terminal pillar members).

Figure 89:
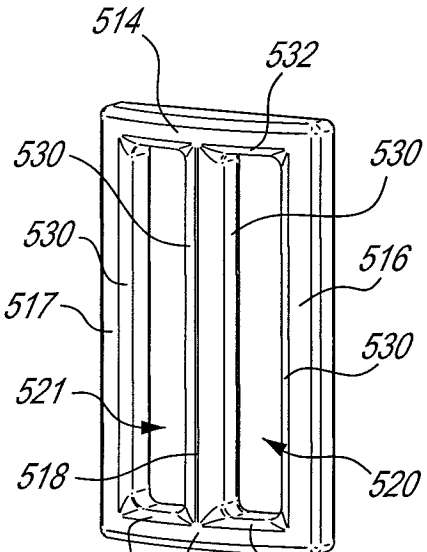
FIG. 89 is a perspective side view of an example embodiment of a belt-buckle in accordance with the present invention.

The buckle body of FIG. 89 is the same as that shown in FIG. 90 except that the buckle body of FIG. 89 has beveled type interior edges 530 and 532 whereas the comparable edges of the buckle body of FIG. 90 are more sharply defined (i.e. define sharp, 90° or square corner edges).

Figure 91:
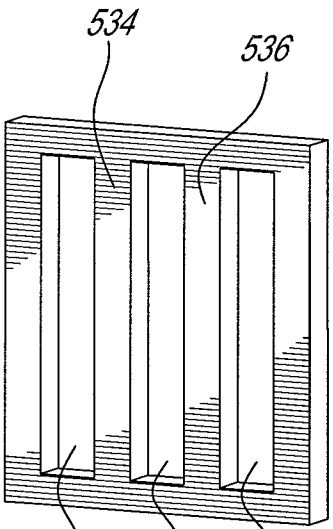
FIG. 91 is a perspective side view of a further example embodiment of a belt-buckle in accordance with the present invention.

The buckle body of FIG. 91 is structurally the same as that shown in FIG. 90 except that the buckle body of FIG. 91 is provided with two spaced apart transverse intermediate members 534 and 536 so that this buckle body defines three belt thread apertures or slots 538, 540 and 542 to allow a respective belt member to be threaded there through in serpentine fashion. The belt body of FIG. 91 may thus be used as part of a friction type belt-buckle as discussed above but wherein the double pass includes a serpentine threading of the belt member through the three apertures 538, 540 and 542 prior to being doubled back over a connecting member and through the initial aperture and tightened in place.

Figure 92:
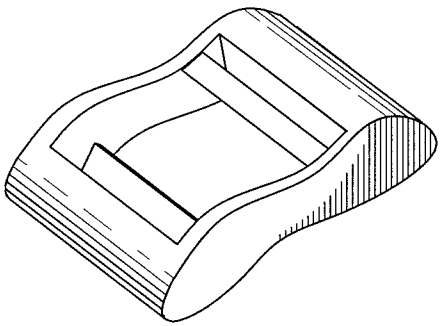
FIG. 92 is a perspective side view of an additional example embodiment of a belt-buckle in accordance with the present invention.

FIG. 92 shows another alternate form for the buckle body.

Figure 96:
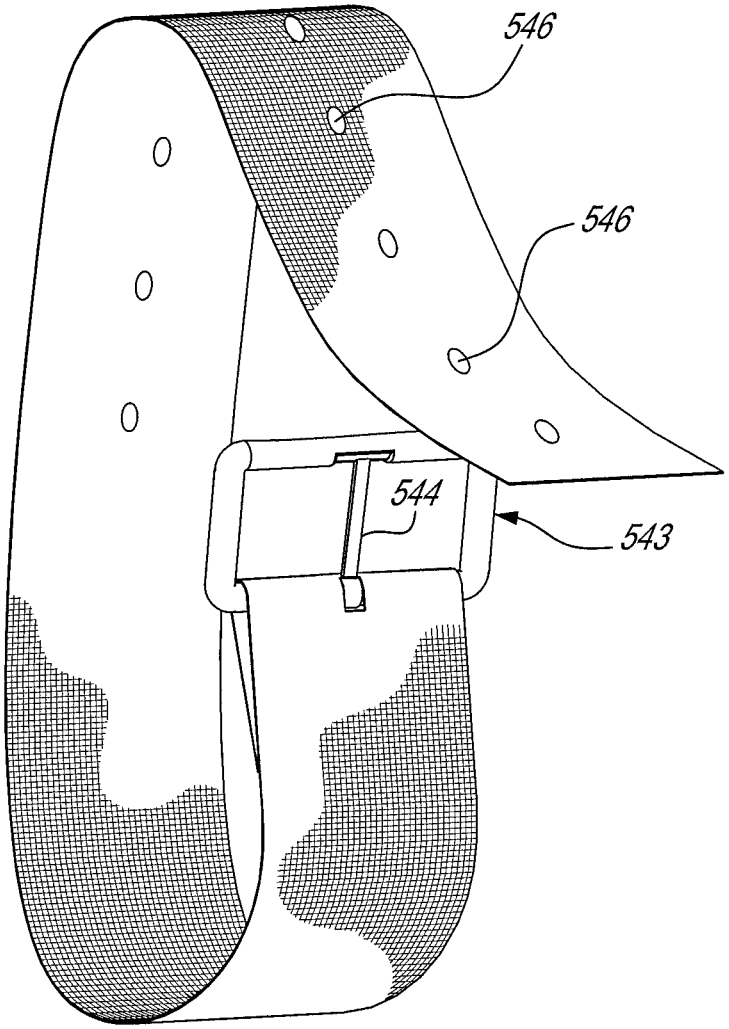
FIG. 96 illustrate in perspective side view a further alternative pillar engagement element having a belt member with positioning holes and a belt-buckle provided with a catch pin to engage such positioning holes.

As a further alternative the belt-buckle may if desired take the form of a belt buckle 543 which has a (locking or catch) pin engagement member 544. As may be seen in FIG. 96 the buckle body has four side members which define a single belt aperture and the pin engagement member is pivotally connected to one such side member of the buckle body (i.e. frame). In this case, as may be seen the belt member is provided with pin engagement holes 546 which may be defined by metal eyelets or ring members. The holes 546 are disposed for selective engagement with the pin engagement member 544. As may be appreciated the holes allow the size of the girdle element to be altered in increments depending on the positioning of the holes 546 along the length of the belt member.

As mentioned the anchor attachment members for the alternative strapping combination of FIGS. 77 (and 78) comprises two ring quick connect connector elements commonly designated with the reference numeral 502. The two ring quick connect connector elements 502 are provided to act as strap attachment elements for quick and releasable attachment of the strap member to respective girdle elements as shown for example in FIG. 77. These ring connector elements 502 may, however, if so desired, be replaced by connector rings which take the form of ordinary continuous (circular) ring connectors 412 (see FIG. 65) but in this case such ring connectors would be permanently attached to the loop ends 506 to the strap member.

Figure 81C:
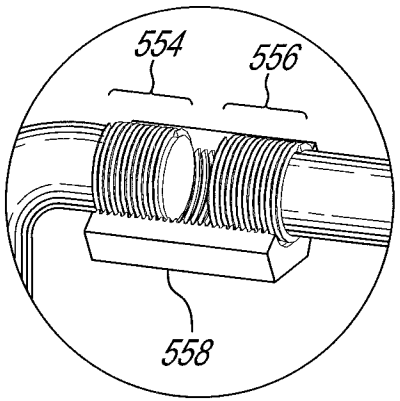
FIG. 81C illustrates a partial perspective view of the nut member shown in FIG. 81B with the nut member partially cut away to expose the obstructed gap.
Figure 81B:
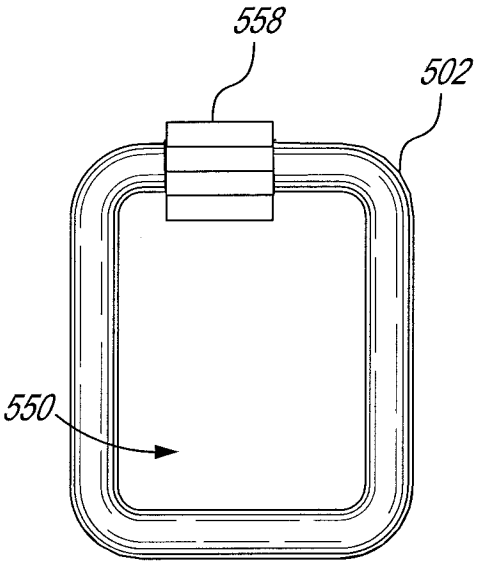
FIG. 81B illustrates a side view of the ring quick connect connector element shown in FIG. 81A with the nut member in the closed position closing off the gap.
Figure 81A:
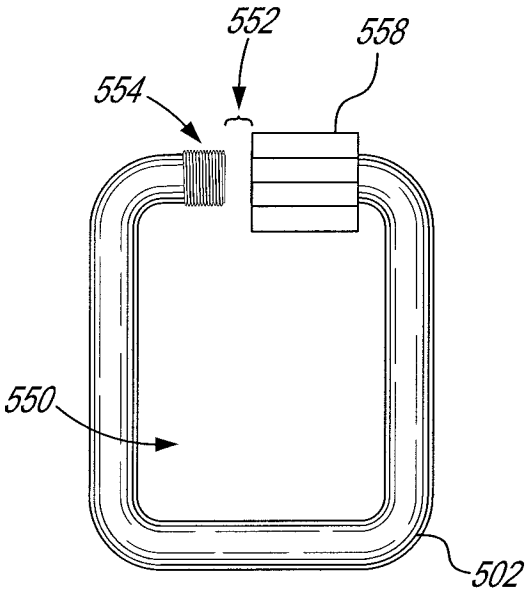
FIG. 81A illustrates an enlarged side view of the example embodiment of a strap attachment element shown in FIG. 77 and which is a ring quick connect connector element with the nut member in the open position with the gap unobstructed.

Referring to FIGS. 81A, 81B and 81C each of the ring quick connect connector elements 502 is a split ring connector element which has a rectangular loop element. The rectangular loop element defines a strap aperture 550 and is split by a gap 552. The rectangular loop element has a rectangular form which presents a pair of opposed short sides and a pair of opposed side which are longer than the short sides. The longer sides are sized to accommodate the width of the strap member (see for example FIG. 77). The split ring quick connector elements may alternatively, if so desired, have a square like form.

In any event, as shown, one of the short sides is interrupted by the gap 552 which is sized so at to allow the strap member to pass (i.e. laterally) into and out of the strap aperture 550 (i.e. into and out of the interior of the split ring connector). The rectangular loop element comprises screw threaded portions or members 554 and 556 which are disposed on opposite sides of the gap 552 (see FIG. 81C); i.e. opposed portions of the (so split) short side which are on either (i.e. opposite) side of the gap 552 (i.e. adjacent the gap) define such threaded members 554 and 556. The split ring quick connect connector elements are also provided with a nut member 558 which may be displaced by screwing action (i.e. clockwise or anticlockwise as the case may be) between an open position (as shown in FIG. 81A) wherein the gap 552 is unobstructed to a closed position wherein the gap 552 is obstructed (as shown in FIGS. 81B and 81C). As shown in FIG. 81A when the gap 552 is open or unobstructed, the nut member 558 engages only the threaded member 556 whereas when the gap is closed or obstructed, the nut member engages both of the threaded members 554 and 556.

The gap 552 is provided for the purpose of allowing such a ring connector element to be connected to a girdle element after the girdle element is disposed about a respective pillar member. As may be understood, the belt member defining the girdle element is thus able to laterally pass thru the gap 552 with the nut member 558 in a gap open position. Once the belt member has passed through the gap 552 the nut member 558 may be displaced to the closed position so as to inhibit lateral separation of the belt member and the ring connector element (i.e. inhibit lateral displacement of the strap member back out through the gap).

Figure 82:
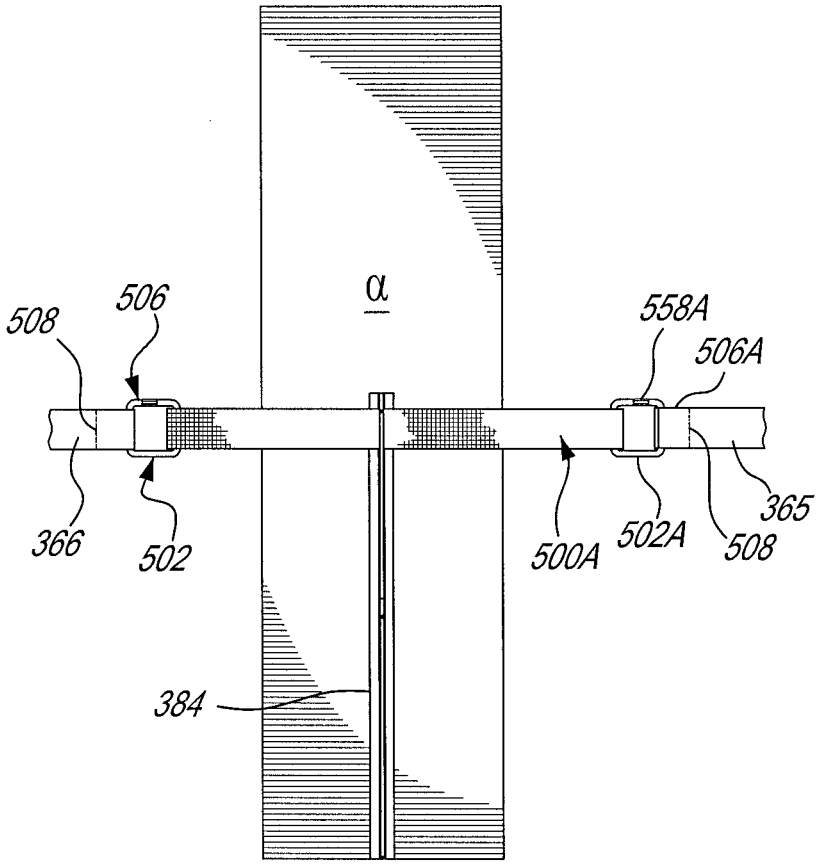
FIG. 82 is a side view of a common terminal pillar member to which strap members are shown daisy chained thereto.
Figure 83:
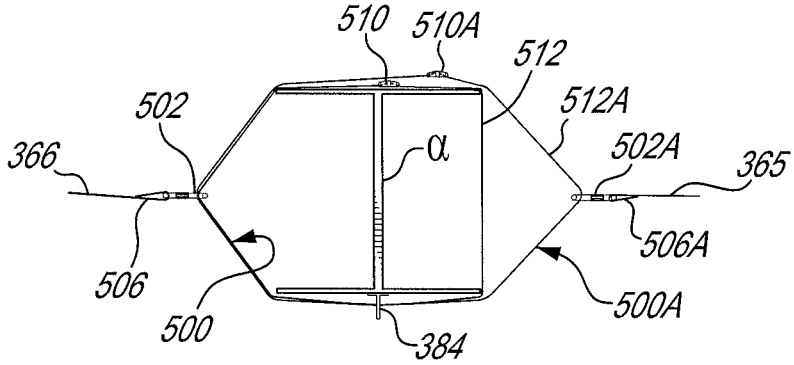
FIG. 83 is a top view of the common terminal pillar member of FIG. 82.

Referring to FIGS. 78, 82 and 83, these figures illustrate how two of the alternative strapping combinations of FIG. 77 may be attached, at a common height level, to a common terminal pillar member. For illustration purposes, only an end part of a second strap member and its respective split ring connector element are shown in FIGS. 78, 82 and 83. As may be understood, the process of daisy chaining the strap members of the alternative strapping combinations to (common) terminal pillar members may involve attaching one (i.e. a first) such alternative strapping combination (of FIG. 77) to respective terminal pillar members by respective girdle elements (i.e. respective belt buckles and respective belt members) and split ring connector elements. The first strapping combination may then be tensioned in place and followed by attachment of a second such alternative strapping combination to a common terminal member and a further respective terminal pillar member also by respective girdle elements (i.e. respective belt buckles and respective belt members) and respective split ring connector elements. The second strapping combination may then in turn be tensioned in place.

Referring to FIG. 77, the alternative strapping combination is shown as being attached to and being tensioned between two terminal pillar members (not shown) which are of rectangular cross section such as shown for example in FIG. 73. As may be seen, the girdle elements 500 each embrace a respective terminal pillar so as to have the form of a polygon (i.e. five sided body) wherein only two sides are parallel to each other and one side is essentially perpendicular to both of the parallel sides (i.e. a rectangular part); the form is reminiscent of a rectangle fused at one side thereof to a side of a triangle but with the fused (i.e. common) side removed. It is to be noted however that a pillar member of different cross section may be used in place of the pillar member shown in rectangular cross section; for example, in the case of a circular cross section for the pillar member the rectangular part would be replaced by a circular arc part.

Referring in particular to FIGS. 82 and 83, these figs. show the common terminal pillar member which is not shown in FIG. 78. In FIGS. 82 and 83, the belt member 512 of the first alternative strapping combination and the belt member 512A of the second alternative strapping combination are shown as being connected by respective ring quick connect connector elements 502 and 502A to respective strap members 366 and 365 and as being tensioned in place with the belt member 512 of the first alternative strapping combination underlying the belt member 512A of the second alternative strapping combination. The belt member 512 of the first alternative strapping combination is associated with belt-buckle 510 and the belt member 512A of the second alternative strapping combination is associated with belt-buckle 510A. As seen the girdle element 500A of the second alternative strapping combination has a six sided form rather than the five sided form of the underlying girdle element 500 of the first alternative strapping combination.

As may be understood, and still referring to FIGS. 82 and 83, with the first alternative strapping combination tensioned in place, the process for attaching the second alternative strapping combination to the common pillar member comprises threading the second distal free end 524 of the belt member 512A through the ring quick connector element 502 of the first alternative strapping combination. The girdle element 500A of the second alternative strapping combination is then formed in place with the respective belt-buckle 510A, i.e. keeping in mind that the final tensioned form of the girdle element 500A is to be a six sided form as shown. The ring quick connect connector element 502A is then attached to the girdle element 500A and the loop end 506A of the second strap member via the open gap of the ring quick connector element 502A which is then closed off by the respective nut member 558A. The strap member of the second alternative strapping combination is tensioned in place as shown in FIGS. 78 and 82 so that the girdle element 500A overlaps the (underlying) belt member 512 of the first or other alternative strapping combination and such that the second belt member 512A takes on a six sided form rather than the five sided form of the underlying belt member (i.e. the six sided form is present once the other alternative strapping combination is tensioned in place as shown in FIGS. 78 and 82).

The alternative strapping combinations may as desired or necessary also be associated with support elements such as are described herein. An alternative strapping combination may, for example, be associated with an elevation support element 384 which is illustrated in FIG. 32. Thus as shown in FIG. 82 both of the belt members 512 and 521A are in turn passed through the elongated slot aperture 220 (see FIG. 32) of the elevation support element 384.

Thus, an alternative strapping combination as described above may, as desired, be associated with a height stabilizations means such as described herein, i.e. for the construction of a removable barrier system in accordance with the present invention. Thus the kit of FIG. 77 may for example comprise one or more elevation support elements such as described herein.

Figure 84:
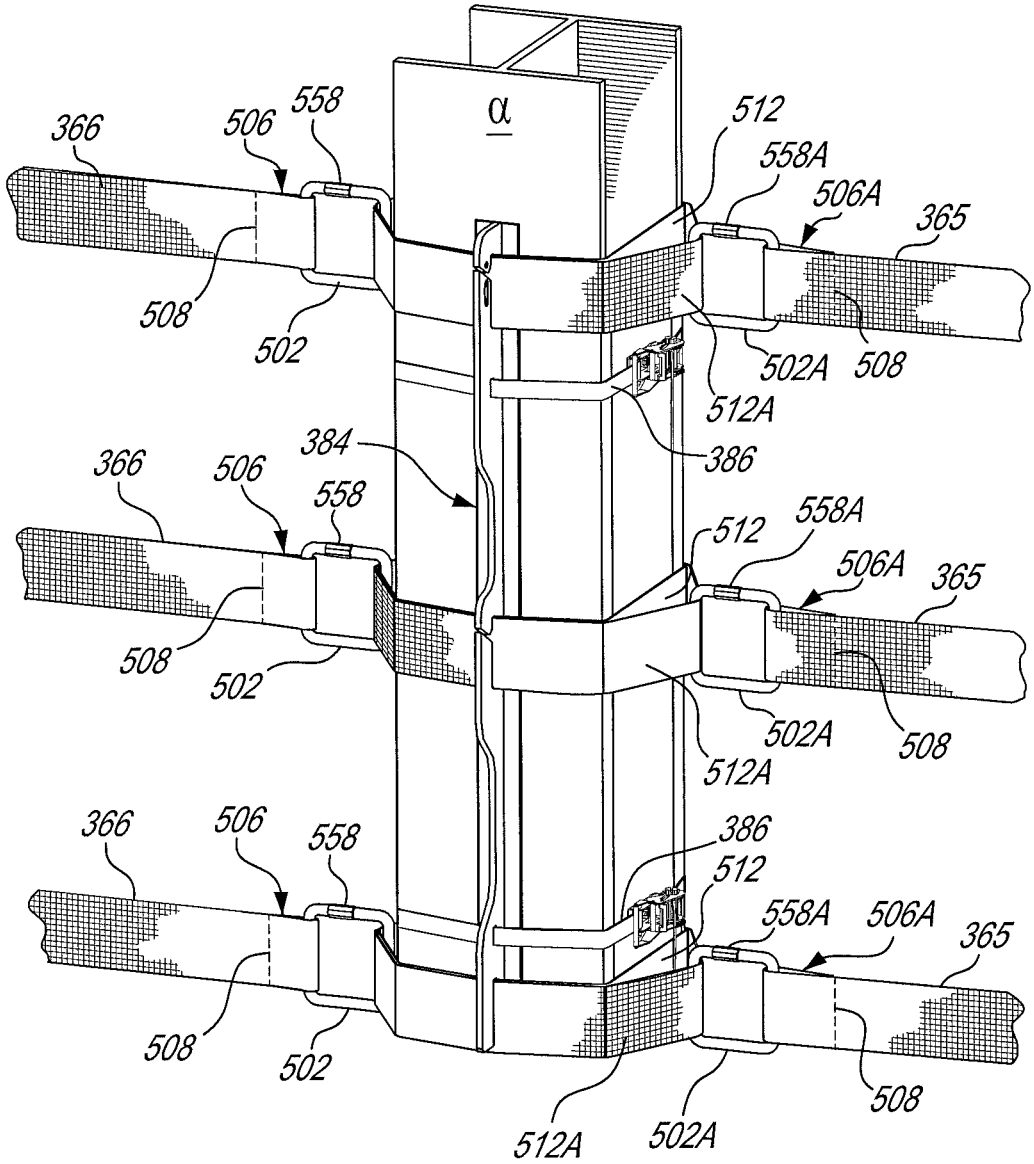
FIG. 84 illustrates in side perspective view of pillar engagement elements defining girdle elements about a common terminal pillar member to daisy chain strap members of FIG. 77 to the common terminal pillar member.

Turning to FIG. 84 this fig. illustrates (in a fashion analogous to the structure of FIG. 67) how girdle elements and ring connector elements of the alternative strapping combination of FIG. 77 may be exploited for attachment of respective pairs of strap members to a common terminal pillar member at a common height level on opposites sides of the common terminal pillar member so as to respectively define top, mid and toe strap-rails. In FIG. 84 the elevation support element is the above mentioned elevation support element 384. The girdle elements are each (releasably) maintained at a predetermined height level by engagement of respective belt members with a respective aperture 220, 222 and 224 of the elevation support element 384 (see FIG. 32). Furthermore as in the case of the structure of FIG. 67, as an optional feature the elevation support element 384 is (also) immobilized to the terminal pillar member by a pair of tensionable connector rings illustrated 386 (i.e. see FIG. 58).

Figure 85:
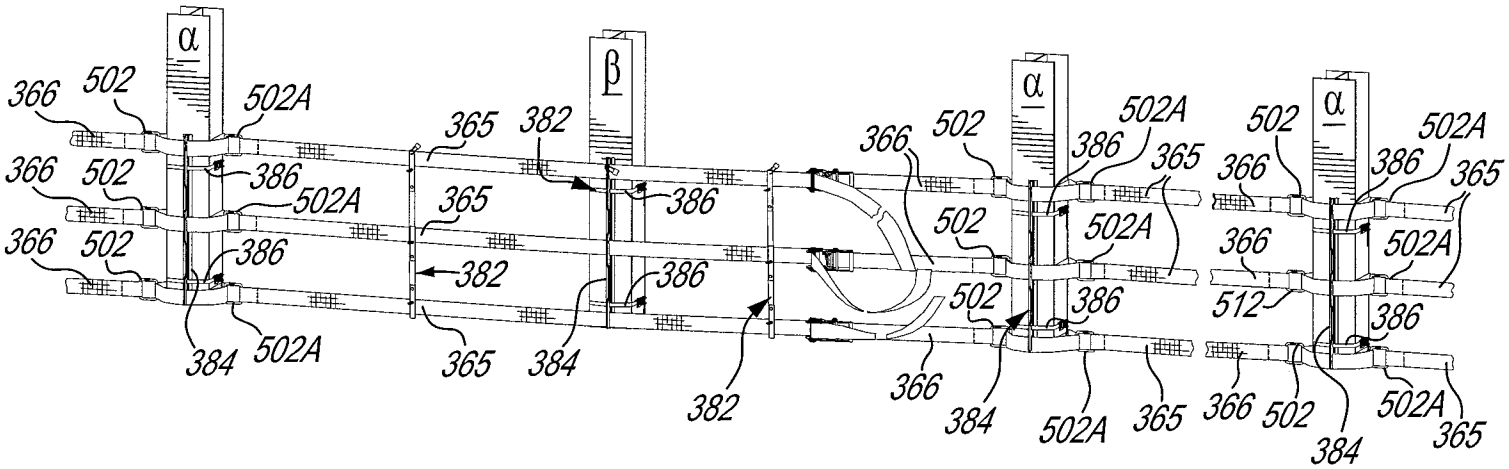
FIG. 85 shows in perspective side view an example barrier system of the present invention with a top, mid and toe strap rail which exploits the alternative strapping combination of FIG. 77 and which also exploits different types of elevation support element as the span and the terminal support elements.

FIG. 85 illustrates a barrier system of the present invention which is analogous to the barrier system illustrated in FIG. 72 but which incorporates the alternative strapping combination of FIG. 77 for daisy chaining strap members to common pillar members; the daisy chains relative to terminal pillars are as shown in FIG. 84. FIG. 85 shows a barrier system with a top, mid and toe strap rail. The system uses the elevation support element (designated previously with the reference numeral)

382 for the span elevation support elements and elevation support element (designated previously with the reference numeral 384) as terminal elevation support elements.

Thus, by exploiting anchor attachment members such as seen in FIG. 77 it is possible to (daisy) chain a two or more lengths of strap members using a common terminal pillar member while conserving a common height level on either side thereof. The connection of the anchor attachment member to the strap member may be modified in other (suitable) manner keeping in mind the desired result, namely a consistent height on both sides of a terminal pillar member.

Figure 86:
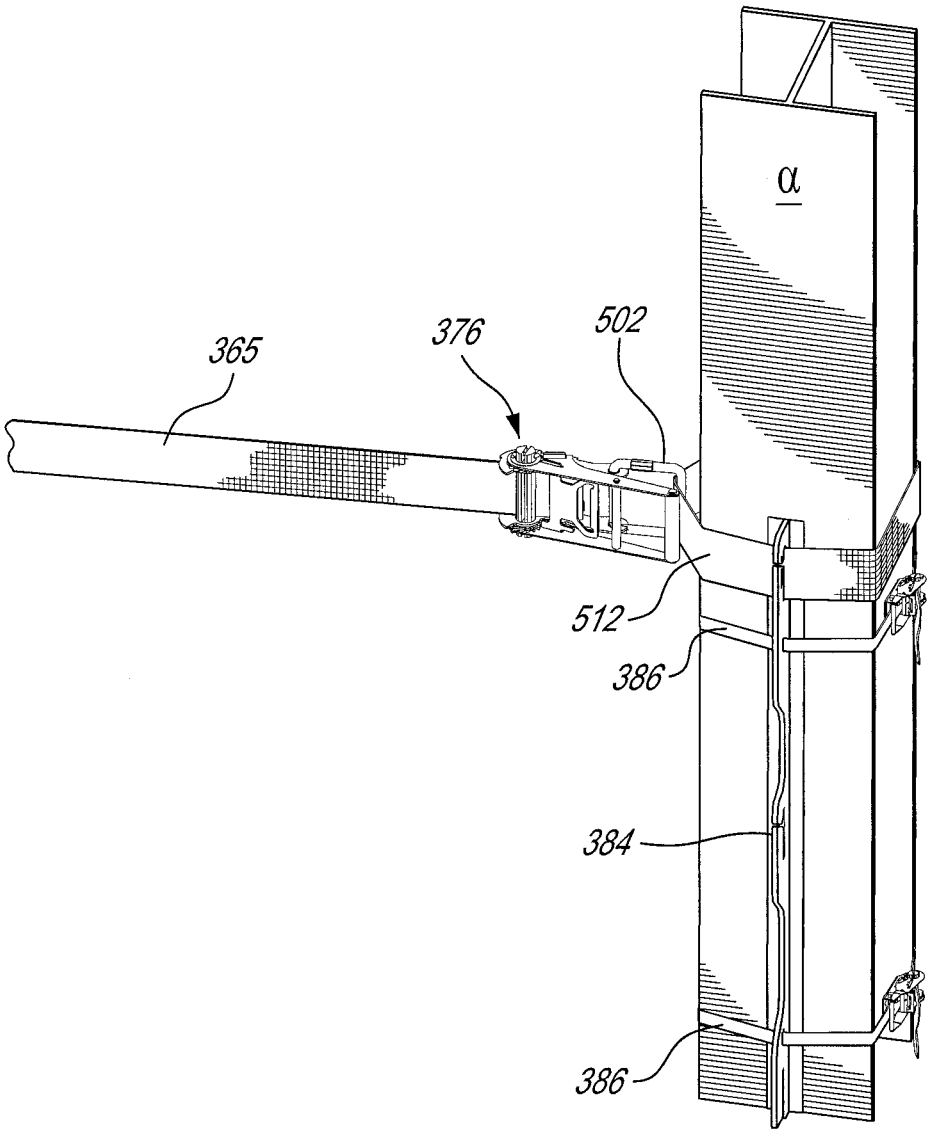
FIG. 86 is a perspective side view of a terminal pillar member to which a girdle element is attached to an alternative type strap member having a single band part.

FIG. 86 illustrates an alternative to the loop type end for a strap member. Instead of being provided with a loop end, the strap member may comprise a single band part associated with a (terminal) tensioning device 376 which itself on the one hand engages the band part and on the other hand directly engages a ring quick connect connector element 502. As may understood, the tensioning device 376, for example, includes openings or other mechanism able to (directly) engage a (long) side of a split rectangular connector ring described herein in relation to FIG. 81A etc. The attached ring connector element 502 may, as shown, be used to engage a girdle element defined by the belt member 512 as described herein.

FIGS. 95A, 95B, 95C and 95D illustrate an alternative double belt member which may be used in place of the two separate abutting belt members 512 and 512A seen in FIG. 83. The double belt has an interior belt element for engaging a pillar member (at a desired height level) which for illustration purposes is identified with the reference numeral 512*a* and an exterior belt element which for illustration purposes is identified with the reference numeral 512*b*. The exterior belt element 512*b* is provided with a pair of ring quick connector elements 502 such as shown in FIG. 81A. The exterior belt element provided for defining a V-shaped connection between rectangular connector rings as seen above in FIG. 83. The interior belt element may be stitched to the exterior belt along line 562. The free ends of the double belt may be used to friction engage a belt buckle as shown in the FIG. 95A; see FIG. 90 for the details of the belt buckle.

It is to be understood herein that structures other than those shown above by way of example may be exploited as strap members, as supports and/or anchors for barrier systems and for kits to make such barrier systems (keeping in mind the purposes herein).

Figure 74:
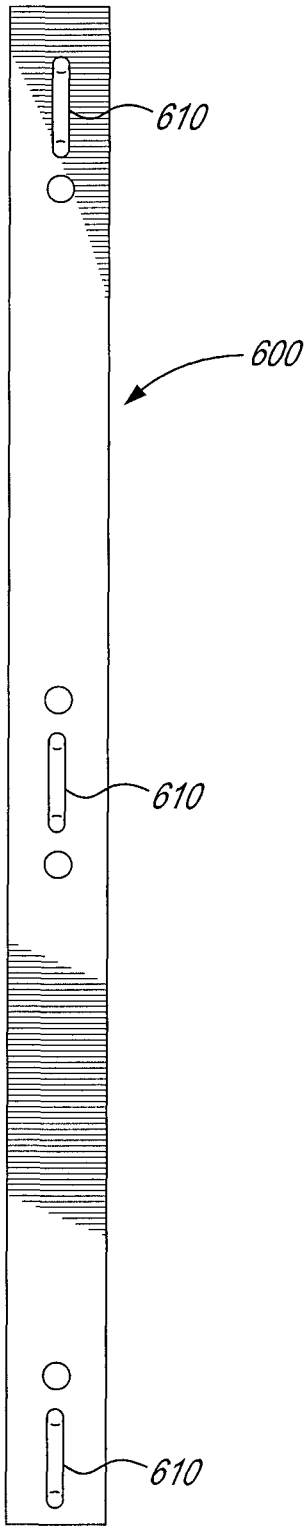
FIG. 74 illustrates a front side view of a further example elevation support element which may be exploited as part of an anchor component.
Figure 75:
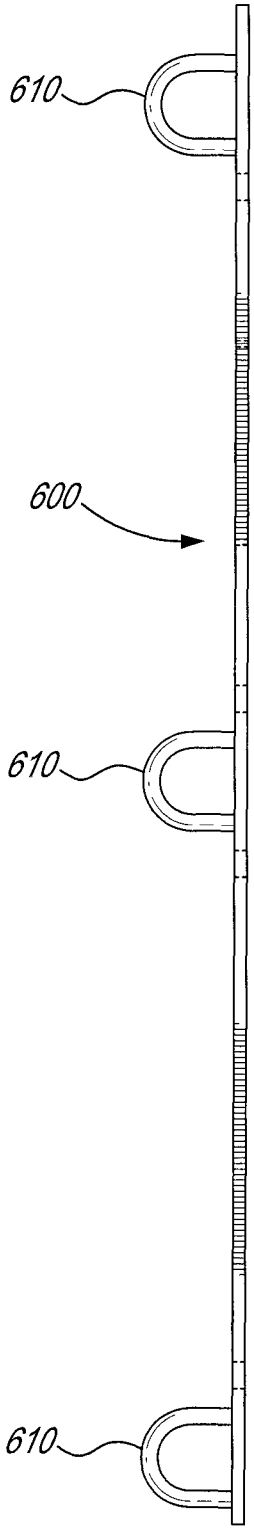
FIG. 75 is a side view of the further example elevation support element shown in FIG. 74.
Figure 76:
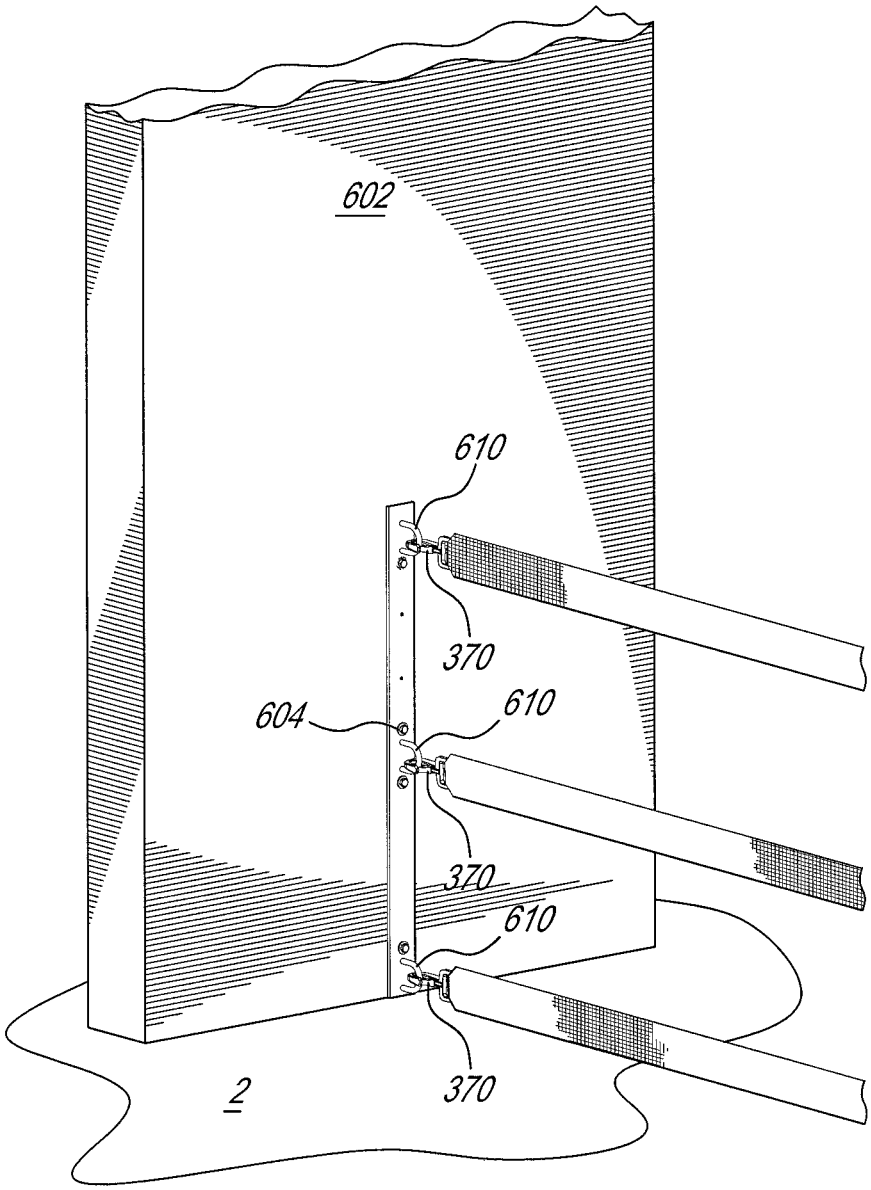
FIG. 76 is a perspective side view of the example elevation support element of FIG. 74 releasably bolted to an anchor wall and connected to top, mid and toe-rail strap members by carabiner type connectors.

For example, other types of structures may be used to anchor strap members for barrier system purposes. FIGS. 74 to 76 thus illustrate an alternate form of anchor attachment member 600 which may be attached to a pillar member by tensionable ring connectors 386 or alternatively be (releasably) bolted to a wall member or structure 602 as shown in FIG. 76; one bolt being designated 604. The anchor attachment mechanism shown exploits an alternate form of an elevation support element which is described above with respect to FIGS. 3 to 5, namely an elevation support element which exploits closed U-shaped members designated by the common reference numeral 610 in FIGS. 74 to 76. As seen from FIG. 76 carabiner type connectors 370 may be used to connect the strap members to the alternate elevation support element shown in FIGS. 74 and 75.

Figure 87:
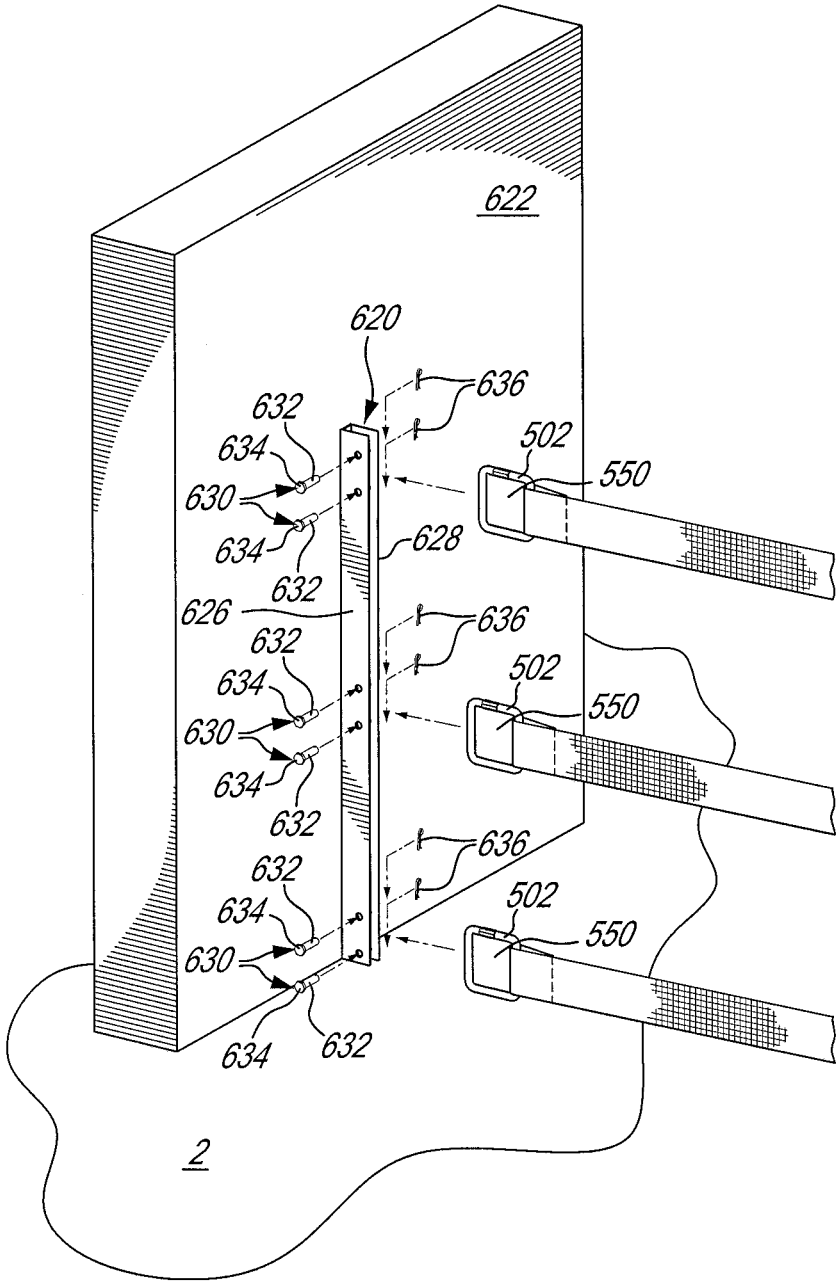
FIG. 87 is a perspective side view of an example embodiment of alternative anchor attachment members for the releasable attachment of respective strap members to an anchor element which is a wall member.
Figure 88:
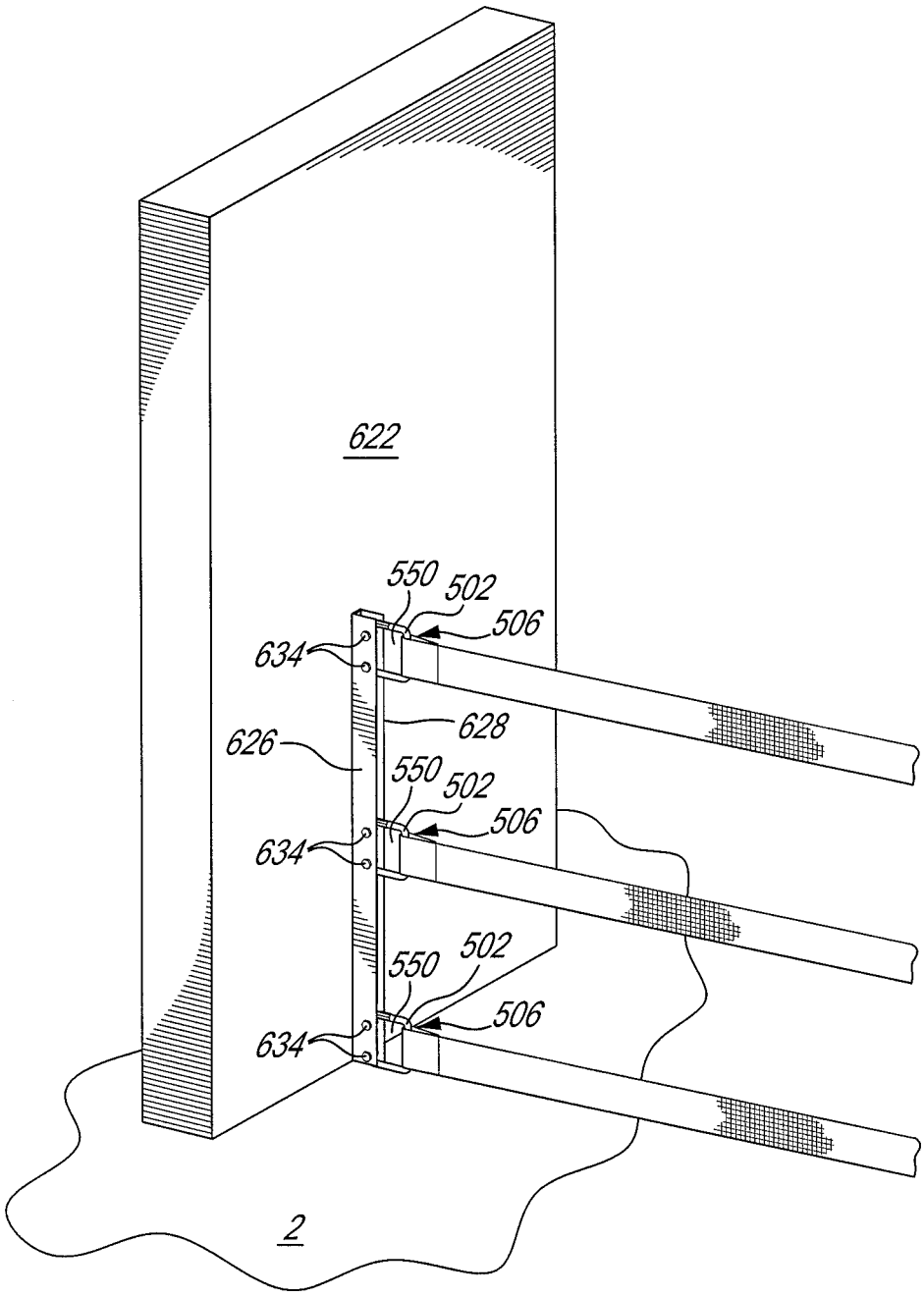
FIG. 88 is a perspective side view of the example alternative anchor attachment members of FIG. 87 with the strap members connected thereby to the wall member.

FIGS. 87 and 88 illustrate a further alternate form of anchor attachment mechanism which may be bolted to a wall member (or any other type of anchoring structure such as, for example, a pillar member). The anchor attachment mechanism comprises an elongated U shaped slot element 620 which has two opposed spaced apart arms interconnected by a base member so as to define an elongated groove or slot. The slot element 620 is bolted to the underlying support structure 622 by bolts (not shown) which engage the base member, the base abutting the support structure 622. The outwardly projecting spaced apart arms 626 and 628 of the U shaped slot element 620 are provided with a plurality of pairs of aligned openings. The anchor attachment mechanism shown exploits transverse pins (commonly identified by the reference numeral 630) which have shafts (commonly identified by the reference numeral 632) provided with a proximal head member (commonly identified by the reference numeral 634) at one end and an engagement hole at the other distal end. The transverse pins 630 are configured so that the shafts thereof may extend through a pair of aligned openings (smaller than the head 634) and be held in place by a cotter pin (commonly identified by the reference numeral 636) configured to engage the engagement hole so that the transverse pin 630 may not be withdrawn from the aligned openings as long as the cotter pin is in place. As may be seen the end of the strap members are provided with ring connector elements 502 such as shown in FIGS. 81A, 81B and 81C. These ring connector elements 502 are set (sidewise) in place in the elongated groove or slot of the slot element 620 and then the mentioned transverse pins 630 are placed in respective aligned openings through the strap apertures (i.e. openings) 550 defined by the ring connector elements 502. Once the transverse pins 630 are in place the cotter pins are engaged in respective engagement holes. As may be appreciated once the shafts 632 extend between respective aligned openings the ring connector elements 502 cannot be withdrawn from the elongated groove.

As may be appreciated if desired a barrier system of the present invention may exploit an anchor component having two terminal anchor elements wherein one terminal anchor element is a pillar member and the other is a wall member as described above.

As may be understood from the above, a kit for a barrier system herein may comprise any combination of the herein described elevation support elements, strap members as well as anchor attachment members for the erection of a temporary barrier system. A kit in accordance with the present invention may also be used (i.e. configured) to be associated with any type of suitable or desired anchor component so as to erect a desired or necessary barrier system (e.g. a safety barrier system).

We claim:

1. A barrier kit for the construction of a removable barrier system wherein said barrier system comprises an anchor component fixed to an underlying support structure, said kit comprising a barrier component, said barrier component comprising a removable strap-rail component said removable strap-rail component comprising strap means, anchor attachment means configured for the releasable attachment of a length of the strap means to said anchor component, and tensioning means for releasable tensioning of said length of said strap means when said length of the strap means is attached to said anchor component by said anchor attachment means said kit further comprising height stabilization means for releasably maintaining the strap means at a predetermined height level relative to said underlying support structure at one or more predetermined points along the tensioned length of said strap means when said strap means is tensioned by said tensioning means, said height stabilization means comprising an elongate rigid vertical body and first and second elongate vertical rigid clamp members mounted along the vertical length of said elongate vertical body, said elongate vertical body being mounted to said strap means and spaced above the underlying support structure, each said clamp member defining respective top and bottom ends and comprising a respective adjustment member mounted thereto and to said vertical body for displacement thereof relative to said elongate vertical body for engagement and disengagement of said strap means therebetween, each said clamp member comprising a connector element mounted thereto and to said vertical body, the connector element being spaced apart from said adjustment member along the vertical length of said clamp member towards one of said top and bottom ends thereof and comprising a stem, said clamp member being movable towards and away said vertical body along the length of said stem, said stem providing said clamp member and said elongate vertical body to define a clearance between said adjustment member and another one of said top and bottom ends for receiving said strap means, wherein movement of said clamp member along the length of said stem reduces the clearance gap.

2. A barrier kit for the construction of a removable barrier system wherein said barrier system comprises an anchor component fixed to an underlying support structure, said kit comprising a barrier component, said barrier component comprising a removable strap-rail component and a removable strap-support component, said removable strap-rail component comprising a strap member, a first anchor attachment member, and a second anchor attachment member, said anchor attachment members being configured for the releasable attachment of a length of the strap member to said anchor component, said removable strap-rail component further comprising tensioning means for releasable tensioning of said length of strap member when said length of strap member is attached to said anchor component by said first and second anchor attachment members, wherein said removable strap-support component comprises at least one elevation support element comprising a height support member and a releasable strap engagement member connected to said height support member, said releasable strap engagement member comprising an elongate rigid vertical body and at least one vertical rigid clamp member mounted along the vertical length of said elongate vertical body and defining top and bottom ends thereof, said elongate vertical body being mounted to said strap member spaced above the underlying support structure, said vertical clamp member providing for clamping said strap member along the width thereof against said vertical body and having a vertical length greater than the width of said strap member and comprising a clamp adjustment member mounted thereto and to said vertical body for adjusting the clamping force on said strap member, said clamp member comprising a connector element mounted thereto and to said vertical body, the connector element being spaced apart from said adjustment member along the vertical length of said clamp member towards one of said top and bottom ends thereof and comprising a stem, said clamp member being movable towards and away said vertical body along the length of said stem, said stem providing said clamp member and said elongate vertical body to define a clearance between said adjustment member and another one of said top and bottom ends for receiving said strap member, wherein movement of said clamp member along the length of said stem reduces the clearance gap, said height support member comprising a ground engagement element for engagement with said underlying support structure, and wherein said releasable strap engagement member and said height support member are configured such that said releasable strap engagement member is disposed to releasably maintain said length of strap member at a first predetermined height level relative to said underlying support structure when said length of strap member is tensioned by said tensioning means.

3. A kit as defined in claim 2 wherein said barrier component comprises a further removable strap-rail component as defined in claim 2, said further strap-rail component being a second strap-rail component comprising a respective tensioning means for releasable tensioning of a respective length of the respective strap member thereof when said length of said respective strap member is attached to said anchor component by respective first and second anchor attachment members of said second strap-rail component, wherein said elevation support element of the removable strap-support component comprises an additional releasable strap engagement member, and wherein said additional releasable strap engagement member and said height support member are configured such that said additional releasable strap engagement member is disposed to releasably maintain the respective length of the strap member of the second strap-rail component at a second predetermined height-level below said first predetermined height-level when said respective length of strap member is tensioned by the respective tensioning means of said second strap-rail component.

4. A kit as defined in claim 3 wherein said second strap-rail component is a toe-strap rail component, and wherein said additional releasable strap engagement member and said height support member are configured such that said additional releasable strap engagement member is disposed to releasably maintain the respective length of the strap member of the toe-strap rail component at a second predetermined height-level below said first predetermined height-level and adjacent said underlying support structure.

5. A kit as defined in claim 2 comprising three of said barrier components, wherein one of said barrier components is a top-rail barrier component, another of said barrier components is a toe-rail barrier component and the remaining barrier component is a mid-rail barrier component, wherein the elevation support element of the top-rail barrier component comprises a top-rail releasable strap engagement member, the top-rail releasable strap engagement member and the height support member of the top-rail barrier component being configured such that the top-rail releasable strap engagement member of the top-rail barrier component is disposed to releasably maintain the strap member of the top-rail barrier component at said first predetermined height-level, wherein the elevation support element of the mid-rail barrier component comprises a mid-rail releasable strap engagement member, the mid-rail releasable strap engagement member and the height support member of the mid-rail barrier component being configured such that the mid-rail releasable strap engagement member of the mid-rail barrier component is disposed to releasably maintain the strap member of the mid-rail barrier component at a second predetermined height-level, said second predetermined height-level being below said first predetermined height-level, wherein the elevation support element of the toe-rail barrier component comprises a toe-rail releasable strap engagement member, the toe-rail releasable strap engagement member and the height support member of the toe-rail barrier component being configured such that the toe-rail releasable strap engagement member of the toe-rail barrier component is disposed to releasably maintain the strap member of the toe-rail barrier component at a third predetermined height-level, said third predetermined height level being below said second predetermined height-level and adjacent said underlying support structure.

6. A kit as defined in claim 5 wherein a common elevation support element defines the elevation support element of each of the top-rail, mid-rail and toe-rail barrier components.

7. A kit as defined in claim 6 wherein the releasable strap engagement member for at least the top-rail barrier component comprises a second clamp member, said clamp adjustment member providing for displacement of one of said clamp member or said second clamp member relative to each other for engagement and disengagement of said strap member therebetween.

8. A kit as defined in claim 7 wherein the height support member of said common elevation support element defines one of said clamp member and said second clamp member.

9. A kit as defined in claim 2 wherein each of said anchor attachment members is configured for the releasable attachment of the length of strap member to a respective anchor element of the anchor component which is a terminal anchor element and wherein said kit her comprises height location means for releasable maintenance of said length of strap member at said first predetermined height level at least adjacent to said respective terminal anchor element.

10. A kit as defined in claim 2 wherein said kit further comprises means for releasable immobilization of an elevation support element to an intermediate pillar member of the anchor component, said intermediate pillar member being disposed between two terminal anchor elements of said anchor component.

11. A kit as defined in claim 2 wherein each of said anchor attachment members is configured for the releasable attachment of said length of strap member to a respective terminal anchor element of the anchor component, said terminal anchor element being a terminal pillar member, wherein each of said anchor attachment members comprises a strap anchor segment for defining a respective girdle element about a respective terminal pillar member, and wherein each of said anchor attachment members comprises a strap attachment element configured for attachment of a respective girdle element to the strap member.

12. A kit as defined in claim 11 wherein said strap member comprises the strap anchor segment of each of said anchor attachment members.

13. A kit as defined in claim 11 wherein said strap anchor segment of each of said anchor attachment members is separate from said strap member.

14. A kit as defined in claim 11 wherein, said removable strap-support component of said kit further comprises two terminal support elements, wherein each of said terminal support elements comprises a terminal height support member for a respective strap anchor segment, each terminal height support member comprising a ground engagement element for engagement with said underlying support structure, wherein each of said terminal support elements further comprises a strap anchor segment engagement means connected to a respective terminal height support member, wherein a respective strap anchor segment engagement means and a respective terminal height support member are configured such that said respective strap anchor segment engagement means is disposed to releasably maintain the girdle element at said first predetermined height level above said underlying support structure.

15. A kit as defined in claim 14 wherein each of said terminal support elements comprises means for releasable immobilization thereof to a respective terminal pillar member of said anchor component.

16. A kit as defined in claim 15 wherein said kit further comprises means for releasable immobilization of an elevation support element to an intermediate pillar member of said anchor component disposed between said terminal pillar members.

17. A kit as defined in claim 14 wherein the strap anchor segment of each of said anchor attachment members is separate from said strap member.

18. A kit as defied in claim 2 wherein said releasable strap engagement member comprises a grip means configured for inhibiting sideways displacement of the strap member with respect to said height support member.

19. A removable barrier system comprising an anchor component and a barrier component, said anchor component being fixed to an underlying support structure, said barrier component comprising a removable strap-rail component and a removable strap-support component, said removable strap-rail component comprising a strap member, a first anchor attachment member, and a second anchor attachment member, said anchor attachment members releasably attaching a length of the strap member to said anchor component, said removable strap-rail component further comprising tensioning means releasably tensioning said length of strap member attached to said anchor component by said first and second anchor attachment members wherein said removable strap-support component comprises at least one elevation support element comprising a height support member and a releasable strap engagement member connected to said height support member, said releasable strap engagement member comprising an elongate rigid vertical body and at least one vertical rigid clamp member mounted along the vertical length of said elongate vertical body and defining top and bottom ends thereof, said elongate vertical body being mounted to said strap member and spaced above the underlying support structure, said vertical clamp member providing for clamping said strap member along the width thereof against said vertical body and having a vertical length greater than the width of said strap member and comprising a clamp adjustment member mounted thereto and to said vertical body for adjusting the clamping force on said strap member, said clamp member comprising a connector element mounted thereto and to said vertical body, the connector element being spaced apart from said adjustment member along the vertical length of said clamp member towards one of said top and bottom ends thereof and comprising a stem, said clamp member being movable towards and away said vertical body along the length of said stem, said stem providing said clamp member and said elongate vertical body to define a clearance between said adjustment member and another one of said top and bottom ends for receiving said strap member, wherein movement of said clamp member along the length of said stem reduces the clearance gap, said height support member comprising a ground engagement element engaging said underlying support structure, and wherein said releasable strap engagement member and said height support member are configured such that said releasable strap member engagement means is disposed to releasably maintain said tensioned length of strap member at a first predetermined height level relative to said underlying support structure at a predetermined point along the tensioned length of said strap member.

20. A barrier system as defined in claim 19 wherein said anchor component comprises an intermediate pillar member disposed between two terminal anchor elements, said barrier system further comprising means for releasable immobilization of an elevation support element to said intermediate pillar member.

21. A barrier system as defined in claim 19 wherein said anchor component comprises two terminal anchor elements, each terminal anchor element being a terminal pillar member, wherein each of said anchor attachment members releasably attach said tensioned length of strap member to a respective terminal pillar member, wherein each of said anchor attachment members comprises a strap anchor segment defining a respective girdle element about a respective terminal pillar member, and wherein each of said anchor attachment members comprises a strap attachment element attaching a respective girdle element to the strap member.

22. A barrier system as defined in claim 21 wherein said anchor component comprises an intermediate pillar member disposed between said two terminal pillar members and said barrier system further comprises means for releasable immobilization of an elevation support element to said intermediate pillar member.

23. A barrier system as defined in claim 21 wherein said removable strap-support component further comprises two terminal support elements, wherein each of said terminal support elements comprises a terminal height support member for a respective strap anchor segment, each terminal height support member comprising a ground engagement element engaging said underlying support structure, wherein each of said terminal support elements further comprises a strap anchor segment engagement means connected to a respective terminal height support member, wherein a respective strap anchor segment engagement means and a respective terminal height support member are configured such that said respective strap anchor segment engagement means is disposed to releasably maintain a respective girdle element at said first predetermined height level above said underlying support structure.

24. A barrier system as defined in claim 23 wherein each of said terminal support elements comprises means for releasable immobilization thereof to a respective terminal pillar member.

25. A barrier system as defined in claim 24 wherein said anchor component comprises an intermediate pillar member disposed between said two terminal pillar members and said barrier system further comprises means for releasable immobilization of an elevation support element to said intermediate pillar member.

26. A barrier system as defined in claim 23 wherein the strap anchor segment of each of said anchor attachment members is separate from said strap member.

27. A barrier system as defined in claim 21 comprising three of said barrier components, wherein one of said barrier components is a top-rail barrier component, another of said barrier components is a toe-rail barrier component and the remaining barrier component is a mid-rail barrier component, wherein the elevation support element of the top-rail barrier component comprises a top-rail releasable strap engagement member, the top-rail releasable strap engagement member and the height support member of the top-rail barrier component being configured such that the top-rail releasable strap engagement member of the top-rail barrier component is disposed to releasably maintain the strap member of the top-rail barrier component at said first predetermined height-level, wherein the elevation support element of the mid-rail barrier component comprises a mid-rail releasable strap engagement member, the mid-rail releasable strap engagement member and the height support member of the mid-rail barrier component being configured such that the mid-rail releasable strap engagement member of the mid-rail barrier component is disposed to releasably maintain the strap member of the mid-rail barrier component at a second predetermined height-level, said second predetermined height-level being below said first predetermined height-level, wherein the elevation support element of the toe-rail barrier component comprises a toe-rail releasable strap engagement member, the toe-rail releasable strap engagement member and the height support member of the toe-rail barrier component being configured such that the toe-rail releasable strap engagement member of the toe-rail barrier component is disposed to releasably maintain the toe-rail barrier component at a third predetermined height-level, said third predetermined height level being below said second predetermined height-level and adjacent said underlying support structure.

28. A barrier system as defined in claim 27 wherein a common elevation support element defines the elevation support element of each of the top-rail, mid-rail and toe-rail barrier components.

29. A barrier system as defined in claim 27 wherein the releasable strap engagement member for at least the top-rail barrier component comprises a second clamp member, said clamp adjustment member providing for displacement of one of said clamp member or said second clamp member relative to each other for engagement and disengagement of said strap member therebetween.

30. A barrier system as defined in claim 29 wherein the height support member of said common elevation support element defines one of said clamp member and said second clamp member.

31. A barrier system as defined in claim 27 wherein said removable strap-support component further comprises two terminal support elements, wherein each of said terminal support elements comprises a terminal height support member for a respective strap anchor segment, each terminal height support member comprising a ground engagement element engaging said underlying support structure, wherein each of said terminal support elements further comprises a strap anchor segment engagement means connected to a respective terminal height support member, wherein a respective strap anchor segment engagement means and a respective terminal height support member are configured such that said respective strap anchor segment engagement means is disposed to releasably maintain the girdle element at said first predetermined height level above said underlying support structure.

32. A barrier system as defined in claim 31 wherein each of said terminal support elements comprises means for releasable immobilization thereof to a respective terminal anchor element.

33. A barrier system as defined in claim 32 wherein the strap anchor segment of each of said anchor attachment members is separate from said strap member.

34. A barrier system as defined in claim 33 wherein said anchor component comprises an intermediate pillar member disposed between said two terminal pillar members and said barrier system further comprises means for releasable immobilization of an elevation support element to said intermediate pillar member.

35. A barrier system as defined in claim 19 wherein said barrier component comprises a further removable strap-rail component as defined in claim 19, said further strap-rail component being a second strap-rail component comprising a respective tensioning means releasably tensioning a respective length of the respective strap member thereof attached to said anchor component by respective first and second anchor attachment members of said second strap-rail component, wherein said elevation support element of the removable strap-support component comprises an additional releasable strap engagement member, and wherein said additional releasable strap engagement member and said height support member are configured such that said additional releasable strap engagement member is disposed to releasably maintain the respective tensioned length of the strap member of the second strap-rail component at a second predetermined height-level below said first predetermined height-level.

36. A barrier system as defined in claim 35 wherein said second strap-rail component is a toe-strap rail component, and wherein said additional releasable strap engagement member and said height support member are configured such that said additional releasable strap engagement member is disposed to releasably maintain the respective length of the strap member of the toe-strap rail component at a second predetermined height-level below said first predetermined height-level and adjacent said underlying support structure.

37. A barrier system as defined in claim 19 wherein said releasable strap engagement member comprises a grip means configured for inhibiting sideways displacement of the strap member with respect to said height support member.

38. A strap-rail kit for a removable barrier system wherein said barrier system comprises an anchor component fixed to an underlying support structure, said anchor component comprising a terminal pillar member fixed to said underlying support structure, said kit comprising a strap member, a vertical height support member comprising an elongate rigid vertical body and at least one vertical rigid clamp member mounted along the vertical length of said elongate vertical body and defining top and bottom ends thereof, said elongate vertical body being mounted to said strap member and spaced above the underlying support structure, said vertical clamp member providing for clamping said strap member along the width thereof against said vertical body and having a vertical length greater than the width of said strap member and comprising a clamp adjustment member mounted thereto and to said vertical body for adjusting the clamping force on said strap member, said clamp member comprising a connector element mounted thereto and to said vertical body, the connector element being spaced apart from said adjustment member along the vertical length of said clamp member towards one of said top and bottom ends thereof and comprising a stem, said clamp member being movable towards and away said vertical body along the length of said stem, said stem providing said clamp member and said elongate vertical body to define a clearance between said adjustment member and another one of said top and bottom ends for receiving said strap member, wherein movement of said clamp member along the length of said stem reduces the clearance gap, and a pillar engagement element, wherein said pillar engagement element, for defining a removable girdle element about said terminal pillar member, comprises a belt-fastener and a belt member, wherein said kit further comprises a strap attachment element configured for attachment of said girdle element to the strap member, and wherein said strap member comprises tensioning means for releasable tensioning of said strap member when said strap member is attached to said girdle element and said girdle element is disposed about said terminal pillar member.

39. A kit as defined in claim 38 wherein said belt member of said pillar engagement element is separate from said strap member and wherein the strap attachment element is configured for releasable attachment of the girdle element to the strap member.

40. A kit as defined in claim 39 wherein said belt-fastener is a belt-buckle.

41. A kit as defined in claim 40 wherein said belt-buckle comprises a buckle body defining at least two belt thread apertures, said buckle body being configured to allow said belt member to be threaded through said apertures for releasable frictional engagement with said belt-buckle so as to define a respective girdle element about a respective pillar member.

42. A kit as defined in claim 38 wherein said strap attachment element comprises a ring quick connect connector element, wherein said strap member comprises a connector loop, wherein said ring quick connect connector element is configured for the releasable attachment of a respective connector loop of the strap member to said girdle element.

43. A kit as defined in claim 42 wherein said ring quick connect connector element comprises a nut member and a rectangular loop element, said rectangular loop element defining a strap aperture and being split by a gap, said rectangular loop element comprising a pair of threaded members disposed on opposite sides of said gap, said nut member being rotationally displaceable about said threaded members between an open position wherein said bolt member engages one of said thread members and said gap is unobstructed by said bolt member and a closed position wherein said nut member engages both of the threaded members such that the gap is obstructed by said nut member, said gap, when unobstructed by said bolt member, being configured for releasable displacement of a respective connector loop and a respective girdle element there through, into said strap aperture, for attachment of said connector loop to said girdle element.

44. A kit as defined in claim 38 comprising two of said pillar engagement elements, wherein each pillar engagement element, for defining a respective removable girdle element about a respective terminal pillar member, comprises a respective belt-fastener and a respective belt member, wherein each of said belt members is separate from said strap member wherein said kit further comprises two strap attachment elements, each strap attachment element being configured for releasable attachment of a respective girdle element to the strap member.

45. A kit as defined in claim 44 wherein each of said belt-fasteners is a belt-buckle.

46. A kit as defined in claim 45 wherein each belt-buckle comprises a buckle body defining at least two belt thread apertures, said buckle body being configured to allow said belt member to be threaded through said apertures for releasable frictional engagement with said belt-buckle so as to define a respective girdle element about a respective pillar member.

47. A kit as defined in claim 44 wherein said strap attachment elements each comprise a respective ring quick connect connector element, wherein said strap member comprises a pair of spaced apart connector loops, wherein each ring quick connect connector element is configured for the releasable attachment of a respective connector loop of the strap member to a respective girdle element and wherein said strap member comprises tensioning means disposed between said loop connectors for releasable tensioning of said strap member when each connector loop of said strap member is attached to a respective girdle element by a respective quick connect ring.

48. A kit as defined in claim 47 wherein each of said ring quick connect connector elements comprises a nut member and a rectangular loop element, said rectangular loop element defining a strap aperture and being split by a gap providing strap displacement between the exterior and interior of the strap aperture, said rectangular loop element comprising a pair of threaded members disposed on opposite sides of said gap, said nut member being rotationally displaceable about said threaded members between an open position wherein said bolt member engages one of said thread members and said gap is unobstructed by said bolt member and a closed position wherein said nut member engages both of the threaded members such that the gap is obstructed by said nut member, said strap passageway, when unobstructed by said bolt member, being configured for releasable displacement of a respective connector loop and a respective girdle element there through, into said strap aperture, for attachment of said connector loop to said girdle element.

49. A kit as defined in claim 48 wherein said kit further comprises height stabilization means for releasably maintaining the strap member at a predetermined height level relative to said underlying support structure at one or more predetermined points along the tensioned length of said strap means when said strap member is tensioned by said tensioning means.

50. A kit as defined in claim 38 wherein said kit further comprises height stabilization means for releasably maintaining the strap member at a predetermined height level relative to said underlying support structure at one or more predetermined points along the tensioned length of said strap means when said strap member is tensioned by said tensioning means.

* * * * *